US008743153B2

(12) United States Patent
Shibata et al.

(10) Patent No.: US 8,743,153 B2
(45) **Date of Patent: *Jun. 3, 2014**

(54) DISPLAY DEVICE FOR VEHICLE

(75) Inventors: Yukihide Shibata, Kariya (JP); Miki Kato, Kariya (JP); Makoto Inomata, Handa (JP); Tomoyuki Miyagaki, Handa (JP)

(73) Assignee: Denso Corporation, Kariya (JP)

( * ) Notice: Subject to any disclaimer, the term of this patent is extended or adjusted under 35 U.S.C. 154(b) by 456 days.

This patent is subject to a terminal disclaimer.

(21) Appl. No.: 12/516,478

(22) PCT Filed: Nov. 21, 2007

(86) PCT No.: PCT/JP2007/072568

§ 371 (c)(1),
(2), (4) Date: Dec. 2, 2009

(87) PCT Pub. No.: WO2008/065948

PCT Pub. Date: Jun. 5, 2008

(65) Prior Publication Data

US 2010/0103204 A1 Apr. 29, 2010

(30) Foreign Application Priority Data

Nov. 27, 2006 (JP) ..... 2006-318815
Oct. 22, 2007 (JP) ..... 2007-274295

(51) Int. Cl.
*G09G 5/10* (2006.01)

(52) U.S. Cl.
USPC ..... 345/690; 345/89; 340/461

(58) Field of Classification Search
USPC ..... 345/690, 204, 87–89, 102, 76, 77, 82; 340/815.4, 815.45, 461
See application file for complete search history.

(56) References Cited

U.S. PATENT DOCUMENTS 6,597,338 B2 7/2003 Onodera
6,606,100 B1 8/2003 Lonoce et al.

(Continued)

FOREIGN PATENT DOCUMENTS

EP 0 494 606 7/1992
EP 0824253 2/1998
JP 4-44626 4/1992
JP 5-18767 1/1993

(Continued)

OTHER PUBLICATIONS

International Search Report for PCT/JP 2007/072568, mailed Jan. 22, 2008.

(Continued)

*Primary Examiner* — Stephen Sherman
(74) *Attorney, Agent, or Firm* — Nixon & Vanderhye P.C.

(57) ABSTRACT

A display device for a vehicle includes a liquid crystal panel (10), a light source (40), and a controlling means (50). The liquid crystal panel includes a particular display pixel (72) and a normal display pixel (62). The controlling means controls the ratio of the gradation value of the normal display pixel to a set gradation value of the normal display pixel as a gradation ratio of the normal display pixel. At the same time, it controls the ratio of the gradation value of the particular display pixel to a set gradation value of the particular display pixel as a gradation ratio of the particular display pixel. Further, the controlling means sets first and second modes as a control mode, the first mode in which the light source emits light, and the second mode in which the light source emits light with brightness lower than in the first mode. In the first mode, the controlling means sets the gradation ratio of the normal display pixel and the gradation ratio of the particular display pixel at a particular time to a maximum ratio. In the second mode, the controlling means executes a gradation processing for making the gradation ratio of the particular display pixel at a particular time higher than the gradation ratio of the normal display pixel.

76 Claims, 60 Drawing Sheets

(56) References Cited

U.S. PATENT DOCUMENTS

| | | | | |
|---|---|---|---|---|
| 6,879,326 | B1 | 4/2005 | Herman | |
| 7,126,567 | B2 | 10/2006 | Nishikawa | |
| 7,151,517 | B2 | 12/2006 | Lee | |
| 7,755,593 | B2 * | 7/2010 | Yamamoto et al. | 345/102 |
| 2002/0118182 | A1 | 8/2002 | Weindorf et al. | |
| 2003/0214514 | A1 | 11/2003 | Lonoce et al. | |
| 2004/0027041 | A1 * | 2/2004 | Nishikawa | 313/110 |
| 2005/0237171 | A1 | 10/2005 | Mizumaki | |
| 2006/0119472 | A1 | 6/2006 | Tsuboi | |
| 2007/0013645 | A1 | 1/2007 | Baba | |
| 2009/0073327 | A1 | 3/2009 | Watanabe et al. | |

FOREIGN PATENT DOCUMENTS

| | | |
|---|---|---|
| JP | 2000-10543 | 1/2000 |
| JP | 2004-085682 | 3/2004 |
| JP | 2004-219939 | 8/2004 |
| JP | 3591535 | 9/2004 |
| JP | 2004-295086 | 10/2004 |
| JP | 2004-314860 | 11/2004 |
| JP | 2005-41355 | 2/2005 |
| JP | 2006-258783 | 9/2006 |

OTHER PUBLICATIONS

Written Opinion of the International Searching Authority and English Translation of the Written Opinion, mailed Jan. 22, 2008. (8 pages).

Office Action (5 pgs.) dated Dec. 24, 2010 issued in corresponding Chinese Application No. 200780043573.0 with an at least partial English-language translation thereof (7 pgs.).

Office Action (5 pgs.) dated Jun. 27, 2011 issued in corresponding Korean Application No. 10-2009-7010710 with an at least partial English-language translation thereof (5 pgs.).

Chinese Official Action issued for corresponding Chinese Patent Application No. 200780043573.0, dated Nov. 3, 2011.

Korean Office Action issued for Korean Patent Application No. 10-2011-7031154, dated Oct. 31, 2012 (with translation).

Korean Examination Report issued for corresponding Korean Divisional Application No. 10-2011-7031154, dated Apr. 3, 2012.

Korean Advisory Action issued for corresponding Korean Application No. 10-2009-7010710, dated May 29, 2012.

Japanese Office Action issued for corresponding Japanese Application No. 2007-274295, dated Apr. 27, 2012.

European Office Action issued for European Patent Application No. 12180930.5-1254 / 2527204, dated Dec. 4, 2012.

Korean Office Action issued for Korean Patent Application No. 10-2013-7002798, dated Apr. 30, 2013 (with English Translation) 6 pages.

Office Action issued for U.S. Appl. No. 12/100,579, dated Jan. 25, 2012.

Chinese Office Action issued for Chinese Patent Application No. 201210073417.1, dated Dec. 3, 2013 (with partial English translation).

* cited by examiner

| TINT | PIXEL GRADATION RATIO | | | | | |
|---|---|---|---|---|---|---|
| | 100% | | | 50% | | |
| | SUBPIXEL GRADATION VALUE | | | SUBPIXEL GRADATION VALUE | | |
| | R | G | B | R | G | B |
| RED | 63 | 0 | 0 | 31 | 0 | 0 |
| GREEN | 0 | 63 | 0 | 0 | 31 | 0 |
| BLUE | 0 | 0 | 63 | 0 | 0 | 31 |
| YELLOW | 63 | 31 | 0 | 31 | 15 | 0 |
| WHITE | 63 | 63 | 63 | 31 | 31 | 31 |

| TINT | SUBPIXEL GRADATION VALUE | | | SUBPIXEL GRADATION VALUE | | |
|---|---|---|---|---|---|---|
| | R | G | B | R | G | B |
| RED | 63 | 0 | 0 | 31 | 0 | 0 |
| GREEN | 0 | 63 | 0 | 0 | 31 | 0 |
| BLUE | 0 | 0 | 63 | 0 | 0 | 31 |
| YELLOW | 63 | 31 | 0 | 31 | 15 | 0 |
| WHITE | 63 | 63 | 63 | 31 | 31 | 31 |

DISPLAY DEVICE FOR VEHICLE

CROSS REFERENCE TO RELATED APPLICATIONS

This application is the U.S. national phase of International Application No. PCT/JP2007/072568 filed 21 Nov. 2007 which designated the U.S. and claims priority to Japanese Patent Applications No. 2006-318815 filed on Nov. 27, 2006, and No. 2007-274295 filed on Oct. 22, 2007, the disclosures of which are incorporated herein by reference.

TECHNICAL FIELD

Present example embodiments disclosed herein relate to a display device for a vehicle including a liquid crystal panel and a light source for illuminating it.

BACKGROUND ART

Various types of vehicle display devices that illuminate a liquid crystal panel for displaying an image in a vehicle by light emission from a light source are conventionally know. These devices include those in which the following parameters are variable: the brightness of the light source or the gradation value of the pixels of the liquid crystal panel. (Refer to JP-A-2006-258783, for example.) In these types of vehicle display devices, the visibility of a display image on the liquid crystal panel can be enhanced by taking the following measure: reducing the lightness of the display image by reducing the light emission brightness of the light source or the gradation value of each pixel at nighttime or the like when the outside fight intensity is low.

However, the above-mentioned type of display devices for vehicles present a problem. When the light emission brightness of a light source or the gradation value of each pixel is reduced, the lightness of every display image of a liquid crystal panel is reduced. Some of the display images of the liquid crystal panel must be lightly displayed. Even an image requiring some degree of lightness (for example, a warning image for giving a warning about any anomaly in the vehicle) is darkly displayed for the above reason. In this case, there is a possibility that the intended purpose of the display of the image is not achieved.

BRIEF DESCRIPTION OF PRESENTLY DISCLOSED EXAMPLE EMBODIMENTS

In view of the above-described problem, it is an object of the present disclosure to provide a display device for a vehicle that appropriately displays both an image with higher priority given to visibility and an image with higher priority given to attaining the purpose of display.

A first aspect of the present disclosure is a display device for a vehicle including: a liquid crystal panel for displaying an image in the vehicle; a light source for illuminating the liquid crystal panel by light emission; and a controller for controlling the liquid crystal panel and the light source. The liquid crystal panel includes: a particular display pixel for displaying a particular image at a particular time; and a normal display pixel for displaying a normal image at a normal time when the particular image is not displayed by the particular display pixel and at the particular time. The controller controls the ratio of the gradation value of the normal display pixel to a set gradation value of the normal display pixel as a gradation ratio of the normal display pixel. Further, it controls the ratio of the gradation value of the particular display pixel to a set gradation value of the particular display pixel as a gradation ratio of the particular display pixel. The controller sets first and second modes as a control mode, the first mode in which the light source emits light, and the second mode in which the light source emits light with brightness lower than in the first mode. In the first mode, the controller sets the gradation ratio of the normal display pixel to maximum, and sets the gradation ratio of the particular display pixel at a particular time to maximum. In the second mode, the controller executes a gradation processing of making the gradation ratio of the particular display pixel at a particular time higher than the gradation ratio of the normal display pixel.

According to the above aspect, in the first mode, the respective gradation ratios of the normal display pixel and the particular display pixel at a particular time are set to a maximum ratio. In the gradation processing in the second mode, meanwhile, the gradation ratio of the particular display pixel at a particular time becomes higher than the gradation ratio of the normal display pixel. Therefore, in the gradation processing in the second mode in which the light emission brightness of the light source is lower than in the first mode, the following can be implemented: with respect to a normal image displayed by the normal display pixel both at a normal time and at a particular time, its lightness can be reduced to enhance its visibility. In the second mode, meanwhile, the following can be implemented in the gradation processing: with respect to a particular image displayed by the particular display pixel at a particular time, a certain level of lightness can be ensured to achieve the purpose of its display. According to the foregoing, it is possible to appropriately display both a normal image with higher priority given to visibility and a particular image with higher priority given to the attaining the purpose of its display.

A set gradation value on which the gradation ratio of the normal display pixel is based and a set gradation value on which the gradation ratio of the particular display pixel is based may be different from each other or may be identical with each other.

A second aspect of the present disclosure is a display device for a vehicle including: a liquid crystal panel for displaying an image in the vehicle; a light source for illuminating the liquid crystal panel by light emission; and a controller for controlling the liquid crystal panel and the light source. The liquid crystal panel includes: a particular display pixel for displaying a particular image at a particular time; and a normal display pixel for displaying a normal image at a normal time when the particular image is not displayed by the particular display pixel and at the particular time. The controller sets first and second modes as a control mode, the first mode in which the light source emits light, and the second mode in which the light source emits light with brightness lower than in the first mode. In the second mode, the controller makes variable the gradation value of the normal display pixel at a normal time and at a particular time, and further keeps constant the gradation value of the particular display pixel at a particular time.

According to the above aspect, in the second mode in which the light emission brightness of the light source is lower than in the first mode, the gradation value of the normal display pixel at a normal time and at a particular time is variable. Therefore, it is possible to appropriately reduce the lightness of a normal image displayed by the normal display pixel both at a normal time and at a particular time to enhance the visibility of the normal image. In the second mode, meanwhile, the gradation value of the particular display pixel at a particular time is kept constant, and thus the following can be implemented regardless of the lightness of a normal image: at a particular time, a certain level of lightness of a particular image displayed by the particular display pixel can be ensured to achieve the intended purpose of a display of the particular image. According to the foregoing, it is possible to appropriately display both a normal image with higher priority given to visibility and a particular image with higher priority given to the attaining the purpose of display.

BRIEF DESCRIPTION OF THE DRAWINGS

The above and other aspects, features and advantages of the present invention will become more apparent from the following detailed description made with reference to the accompanying drawings. In the drawings.

PREFERRED EMBODIMENTS FOR CARRYING OUT THE INVENTION

First Example Embodiment

Figure 2:
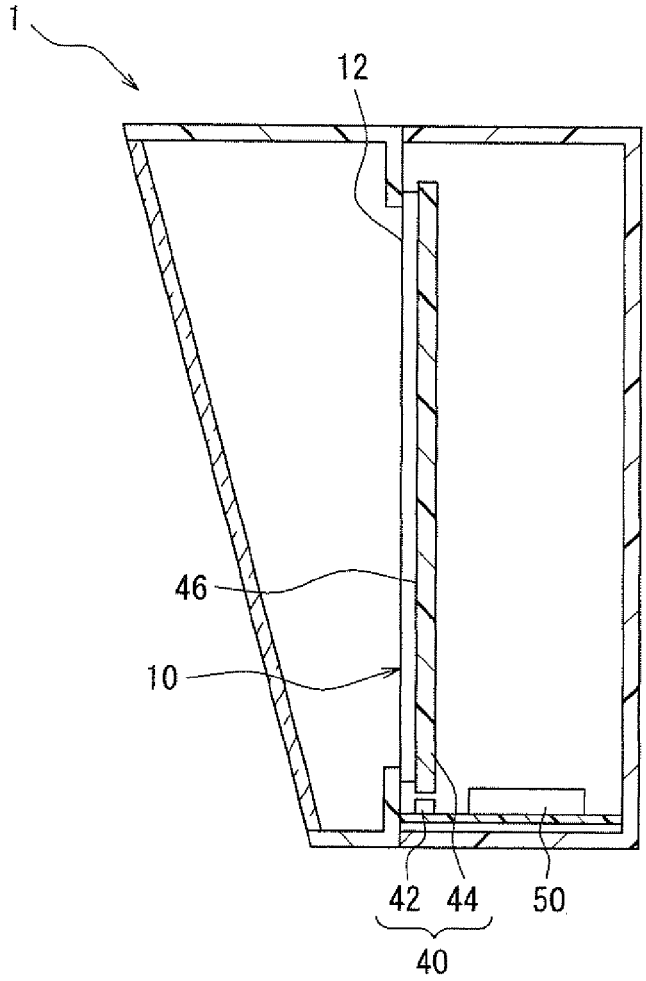
FIG. 2 is a sectional view illustrating the general configuration of a display device for a vehicle in the first example embodiment.
Figure 3:
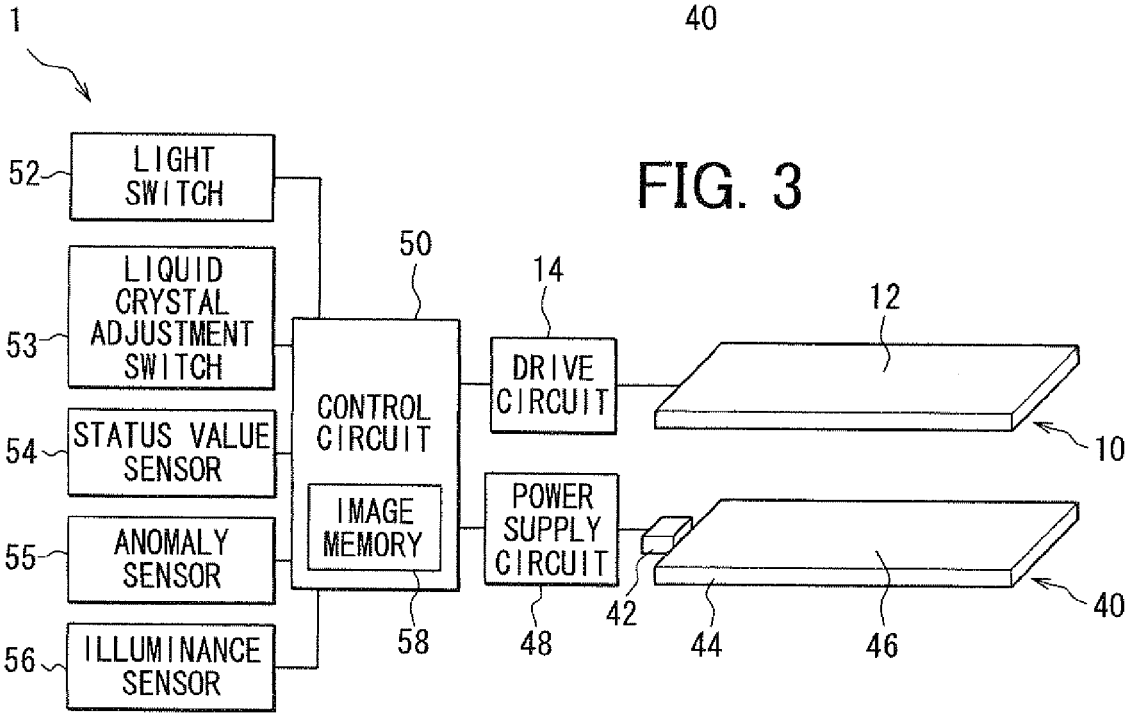
FIG. 3 is a block diagram illustrating the electric circuitry of a display device for a vehicle in the first example embodiment.

FIG. 2 illustrates the general configuration of a display device 1 for a vehicle in a first example embodiment of the invention, and FIG. 3 illustrates the electric circuitry of this device 1. Hereafter, description will be provided for the configuration of the display device 1 for a vehicle.

As illustrated in FIG. 2, the display device 1 for a vehicle is constructed of a liquid crystal panel 10, a light source 40, a control circuit 50, switches 52, 53, sensors 54, 55, 56, and the like.

The liquid crystal panel 10 is, for example, a TFT transmissive liquid crystal panel, and is installed at the front part of the compartment of a vehicle so that its screen 12 faces toward the seats in the vehicle. The screen 12 of the liquid crystal panel 10 is of dot matrix type and has multiple pixels arranged in a matrix pattern. Each of the pixels is controlled and driven according to an image signal and an image display is thereby achieved. Each pixel of the liquid crystal panel 10 in this example embodiment is constructed of subpixels R, G, B in three colors respectively provided with red, green, and blue color filters. A drive circuit 14 for the liquid crystal panel 10 is supplied with image signals in which the gradation value of these subpixels is selected on a pixel-by-pixel basis. (Refer to FIG. 3 for the Drive Circuit.)

Figures 13, 14:
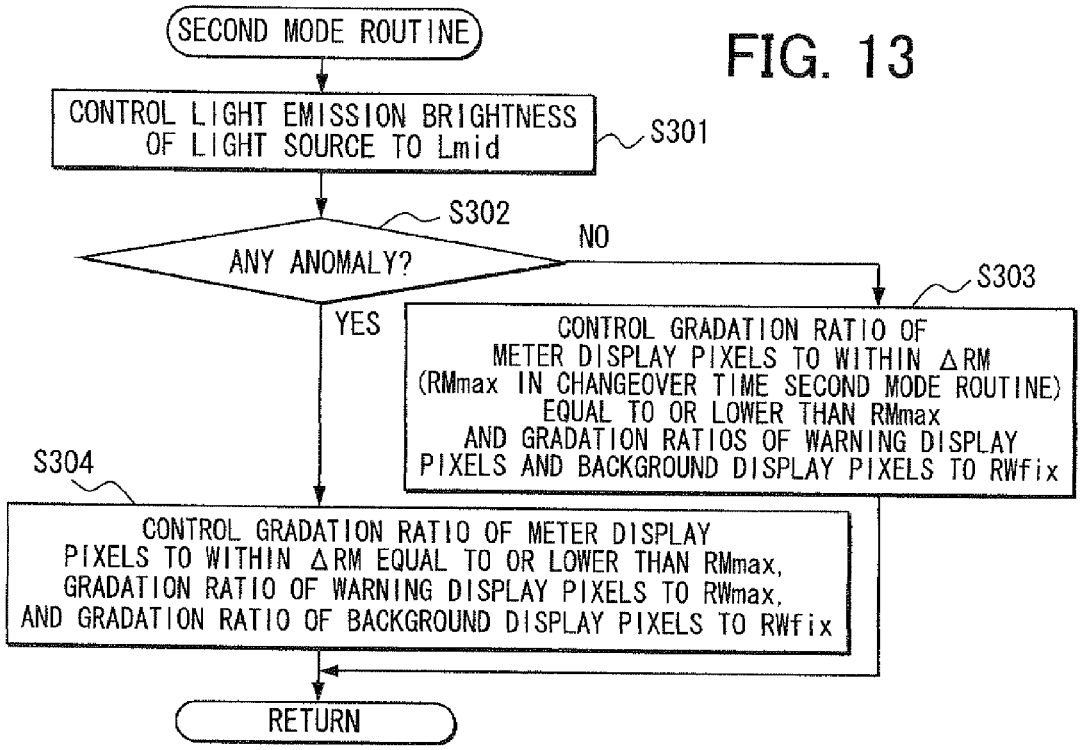
FIG. 13 is a flowchart illustrating a second mode routine in the first example embodiment.
FIG. 14 is a schematic diagram illustrating the gradation ratios of pixels in the first example embodiment as an example

A more specific description will now be given. In this example embodiment, as illustrated in FIG. 14 as an example, the following measure is taken with respect to subpixels that construct one and the same pixel and express a specific tint (hue): with respect to those of these subpixels requiring density for tint expression, the ratio of their gradation value to their set gradation value (hereafter, simply referred to as "gradation ratio") is determined so that the following is implemented: the gradation value is greater than 0 and within a range equal to or lower than the set gradation value. When there are multiple subpixels required for tint expression, it is important to take the following measure to prevent the tint from being changed: the gradation ratio of each of these subpixels is set to an identical ratio. The reason for this is as follows: when a tint is not changed, it becomes easy for an occupant of the vehicle to view a display and the display can be prevented from being mistaken.

In this example embodiment, the following image signals are supplied to the drive circuit 14: signals for selecting a gradation value realizing the gradation ratio determined as mentioned above with respect to a subpixel required for tint expression and selecting 0 as the gradation value of the remaining subpixels. In the following description, the gradation ratio of a subpixel required for tint expression of subpixels constructing pixels will be designated as "gradation ratio of pixels" in order to make the description easy to understand.

As set gradation values acting as a benchmark for gradation ratios with respect to the gradation value of a subpixel required for tint expression, a color pallet table is stored in the image memory 58, described later, of the control circuit 50. The color pallet table illustrated in FIG. 14 as an example has 64-level gradation values of 0 to 63, and an appropriate numerical value can be set from among the 64-level gradation values. A more specific description will now be given. In the example illustrated in FIG. 14, 63 is taken as the set gradation value of a subpixel R required for red color expression; 63 and 31 are respectively taken as the set gradation values of subpixels R and G required for yellow color expression; and 63, 63, 63 are respectively taken as the set gradation values of subpixels R, G, and B required for white color expression. As mentioned above, the set gradation values are equal to the maximum values of selected gradation values. Therefore, the gradation ratio obtained when this set gradation value is taken is equal to 100% as the maximum ratio. In this example embodiment, especially, the following measure is taken in the first mode, described later, in which the light source 40 is not dimmed: the gradation ratio obtained when the brightness of an image is maximized through selection of the set gradation value is taken as the maximum ratio.

Even when, for example, 64-level gradation values are stored in the image memory 58, any other numeric value than 64 and 0 may be taken as the set gradation value. A more specific description will now be given. The yellow color expression in the example illustrated in FIG. 14, 31 is taken as the set gradation value of the subpixel G when at the maximum ratio of 100%. Therefore, when the gradation ratio of the subpixel G is changed to 50%, 15 is selected as the gradation value of the subpixel G. Needless to add, the gradation ratio of the subpixel R may be changed from the maximum ratio of 100% to 50% by taking the following measure, for example, in accordance with the foregoing: 31 is taken as the set gradation value of the subpixel R required for red color expression, and 15 is selected as the gradation value of the subpixel R.

The light source 40 includes a light emission diode 42 and a diffuser panel 44. The light emission diode 42 is, for example, of chip type and is disposed diagonally behind the liquid crystal panel 10. The light emission diode 42 emits light with a level of brightness corresponding to a driving signal supplied to its power supply circuit 48. (Refer to FIG. 3.) The diffuser panel 44 is formed of optically transparent resin in a flat plate shape, and is disposed behind the liquid crystal panel 10 in parallel with the panel 10. The diffuser panel 44 diffuses light emitted from the light emission diode 42 positioned adjacently thereto, and projects it from its light emission face 46 on the liquid crystal panel 10 side. It thereby substantially uniformizes the light emission brightness of the light emission face 46 throughout its area. The thus constructed light source 40 functions as a backlight and transmissively illuminates the liquid crystal panel 10 from behind by light emission at the light emission face 46, and thereby makes luminous an image displayed on the screen 12 of the liquid crystal panel 10.

The control circuit 50 as "controller" is, for example, a microcomputer and is disposed behind the light emission diode 42. As illustrated in FIG. 3, the control circuit 50 is electrically connected to the drive circuit 14 for the liquid crystal panel 10 and the power supply circuit 48 for the light emission diode 42 of the light source 40. The control circuit 50 is also electrically connected to a light switch 52, a liquid crystal adjustment switch 53, a status value sensor 54, an anomaly sensor 55, an illuminance sensor 56, and the like mounted in the vehicle. The control circuit 50 electrically connected as mentioned above generates an image signal supplied to the drive circuit 14 and a driving signal supplied to the power supply circuit 48 based on signals from the switches 52, 53 and the sensors 54, 55, 56. It thereby controls the displaying operation of the liquid crystal panel 10 and the light emitting operation of the light source 40. Especially, control of the displaying operation of the liquid crystal panel 10 is achieved by the control circuit 50 generating an image signal based on image data stored in the image memory (e.g., image ROM) 58.

The light switch 52 is used to turn on and off a predetermined lamp of the vehicle, and especially in this example embodiment, it has the following operative positions: position lamp on position and headlamp on position in which the tail lamps are turned on; and all lamps off position in which the tail lamps are turned off. Thus, an occupant of the vehicle (hereafter, simply referred to as "occupant") can input an on/off command corresponding to a desired operative position by operating the light switch 52 to that position. The liquid crystal adjustment switch 53 is used to adjust the lightness of an image displayed on the screen 12 of the liquid crystal panel 10. Especially, in this example embodiment, it has multiple operative positions corresponding to adjustment values at multiple levels (e.g., 10 levels) defined with respect to the lightness. Thus, the occupant can input an adjustment value corresponding to a desired operative position by operating the liquid crystal adjustment switch 53 to that position.

These switches 52, 53 transmit signals indicating an entry corresponding to the respective operative positions to the control circuit 50. As mentioned above, each of the switches 52, 53 functions as an "inputting element" for accepting input from the occupant.

The status value sensor 54 detects a status value, vehicle speed in this example embodiment, pertaining to the vehicle displayed as an image on the screen 12 of the liquid crystal panel 10. The anomaly sensor 55 detects an anomaly that has occurred in the vehicle, a water temperature anomaly in engine cooling water in the example embodiment. The illuminance sensor 56 detects the intensity of light external to the vehicle. These sensors 54, 55, 56 transmit signals indicating the respective detection results to the control circuit 50.

Figure 4:
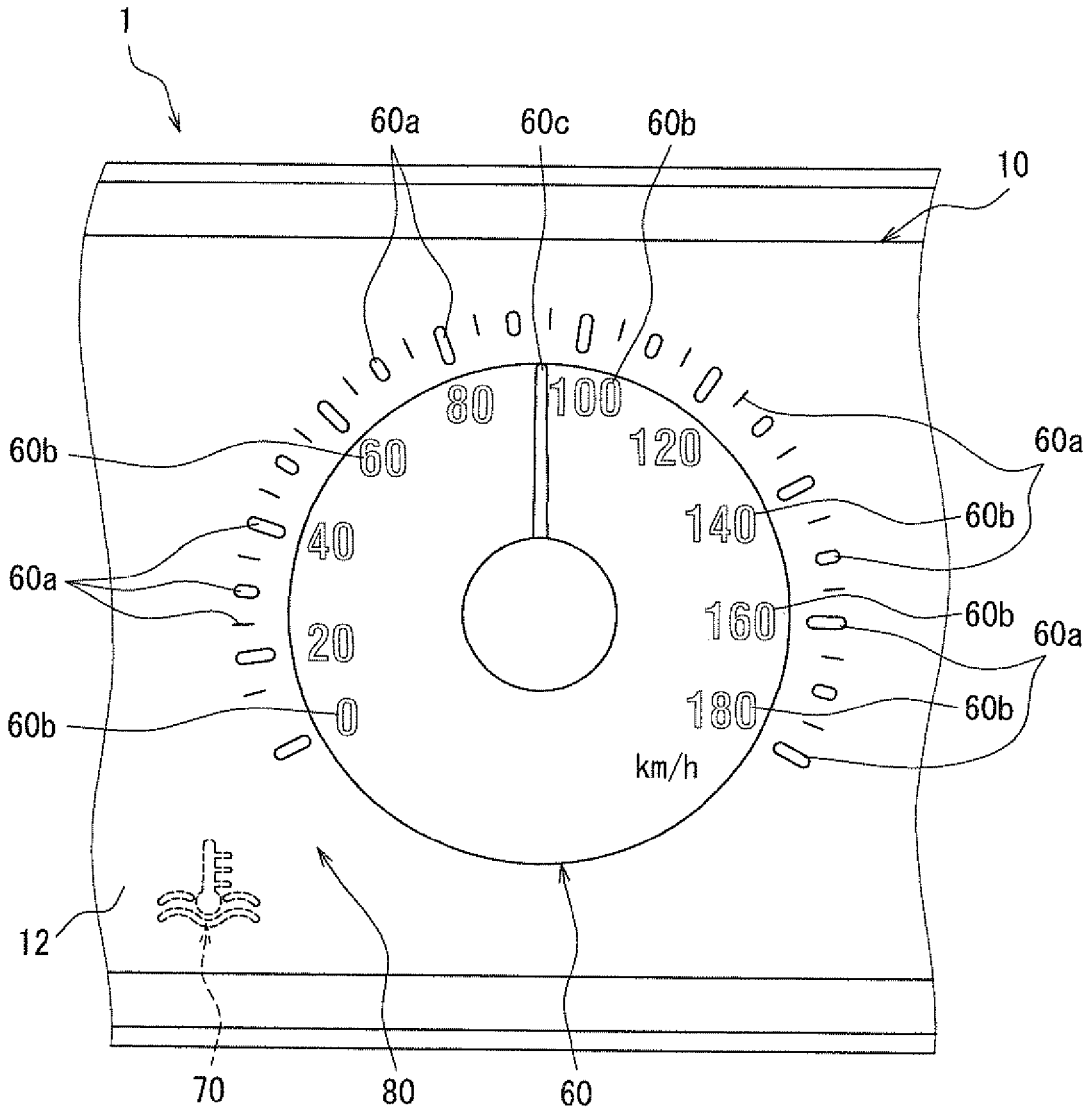
FIG. 4 is a front view illustrating a screen display of a liquid crystal panel at a normal time in the first example embodiment.
Figure 5:
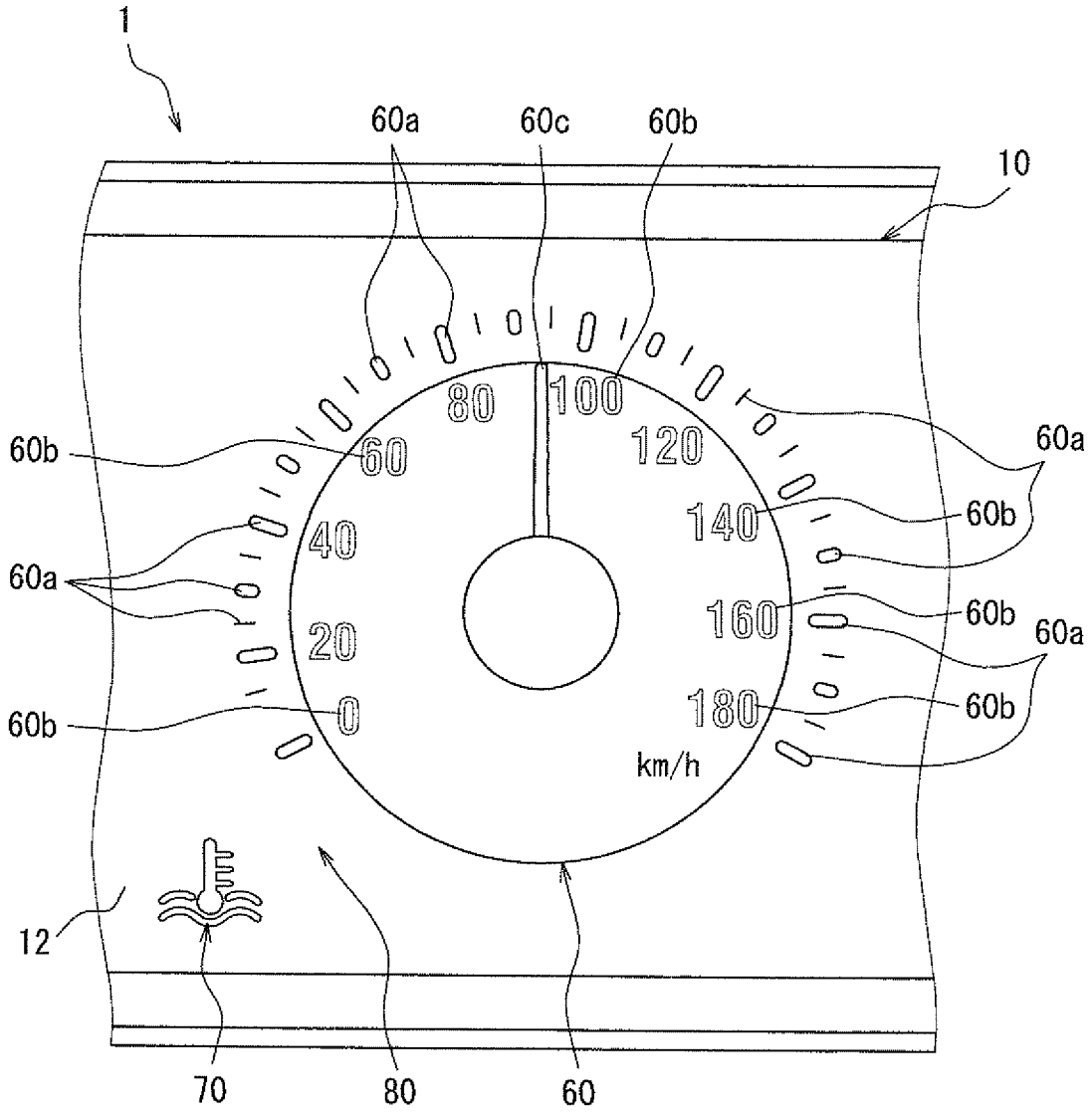
FIG. 5 is a front view illustrating a screen display of a liquid crystal panel at a time of the occurrence of an anomaly in the first example embodiment.

Description will now be provided for display images of the liquid crystal panel 10 with reference to FIGS. 4 and 5. FIG. 4 illustrates a display on the screen 12 of the liquid crystal panel 10 at a normal time, and FIG. 5 illustrates a display on the screen 12 at a time of the occurrence of an anomaly in the vehicle as a "particular time."

As illustrated in FIGS. 4 and 5, the screen 12 of the liquid crystal panel 10 displays images 60, 70, 80 and the like and thus functions as a combination meter.

A more specific description will now be given. The meter image 60 is used to indicate a status value pertaining to the vehicle, the vehicle speed detected by the status value sensor 54 in this example embodiment, to the occupant. Therefore, the meter image 60 is displayed both at a normal time illustrated in FIG. 4 and at a time of the occurrence of an anomaly illustrated in FIG. 5. The meter image 60 in this example embodiment includes a scale image 60*a*, a numeric image 60*b*, and a pointer image 60*c*. The scale image 60*a* and the numeric image 60*b* are plurally displayed in a fixed manner so that they are arranged in the circumferential direction. The pointer image 60*c* is movably displayed so as to point images 60*a*, 60*b* in the position corresponding to the vehicle speed. In FIGS. 4 and 5, only some of the multiple images 60*a*, 60*b*, 60*c* are marked with reference numerals for the sake of viewability.

When an anomaly in the vehicle, i.e., a water temperature anomaly in engine cooling water in this example embodiment, is detected by the anomaly sensor 55, the warning image 70 is used to give a warning about the occurrence of the anomaly to the occupant. Though the warning image 70 is displayed at a time of the occurrence of an anomaly illustrated in FIG. 5, therefore, it is merged into the background image 80 and is apparently not displayed at a normal time illustrated in FIG. 4.

The background image 80 is placed around the meter image 60 and the warning image 70 to render the images 60, 70 prominent. Therefore, the background image 80 is constantly displayed with a certain level of lightness both at a normal time illustrated in FIG. 4 and at a time of the occurrence of an anomaly illustrated in FIG. 5.

The meter image 60 corresponds to "normal image," and the warning image 70 corresponds to "particular image."

Figure 6:
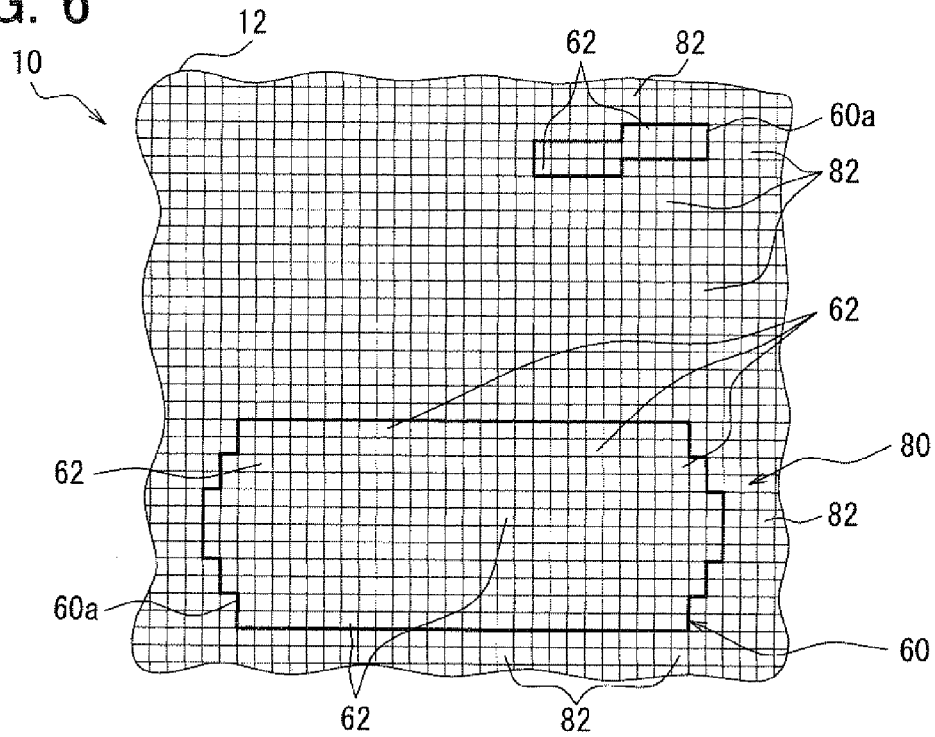
FIG. 6 is a schematic diagram illustrating the screen of a liquid crystal panel at a normal time in the first example embodiment in an enlarged manner.
Figure 7:
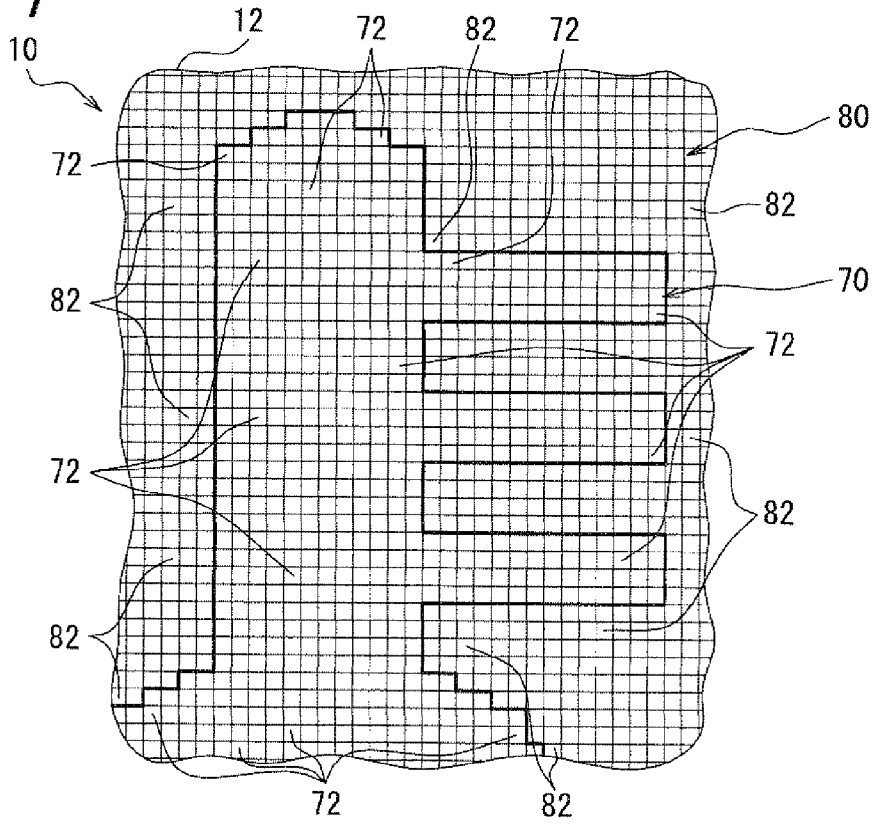
FIG. 7 is a schematic diagram illustrating the screen of a liquid crystal panel at a time of the occurrence of an anomaly in the first example embodiment in an enlarged manner.

Description will now be provided for an image display by component pixels of the screen 12 of the liquid crystal panel 10 with reference to FIGS. 6 and 7. FIG. 6 schematically illustrates a part of the screen 12 of the liquid crystal panel 10 at a normal time in an enlarged manner. FIG. 7 schematically illustrates another part of the screen 12 at a time of the occurrence of an anomaly in an enlarged manner. In FIGS. 6 and 7, only some of the multiple pixels 62, 72, 82 are marked with reference numerals for the sake of viewability.

As illustrated in FIG. 6, the meter image 60 is displayed by the gradation value of the meter display pixels 62 inside a heavy line representing a border line being controlled according to an image signal from the control circuit 50. As illustrated in FIG. 7, the warning image 70 is displayed by the gradation value of the warning display pixels 72 inside a heavy line representing a border line being controlled according to an image signal from the control circuit 50. As illustrated in FIGS. 6 and 7, the background image 80 is displayed by the gradation value of the background display pixels 82 outside a heavy line representing a border line being controlled according to an image signal from the control circuit 50.

The meter display pixels 62 correspond to "normal display pixels," and the warning display pixels 72 correspond to "particular display pixels."

Figure 1:
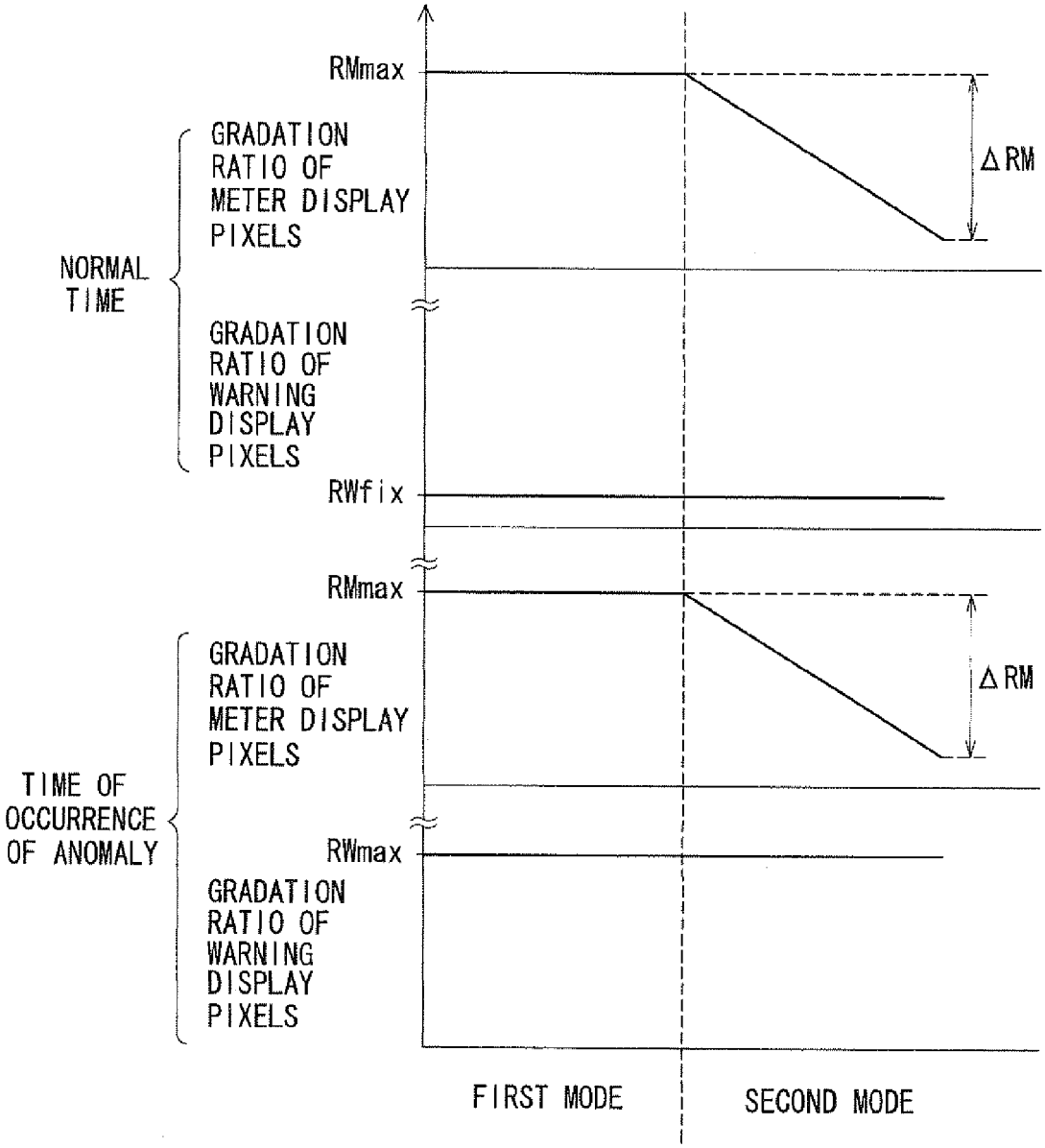
FIG. 1 is a schematic diagram illustrating the gradation ratios of pixels in a first example embodiment.
Figure 8:
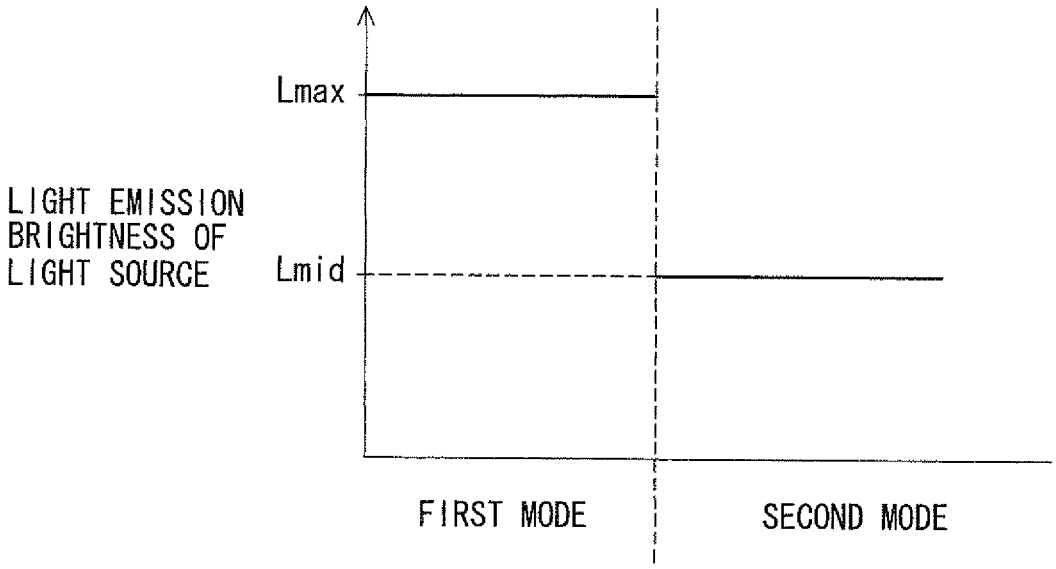
FIG. 8 is a schematic diagram illustrating the light emission brightness of a light source in the first example embodiment in an enlarged manner.
Figure 9:
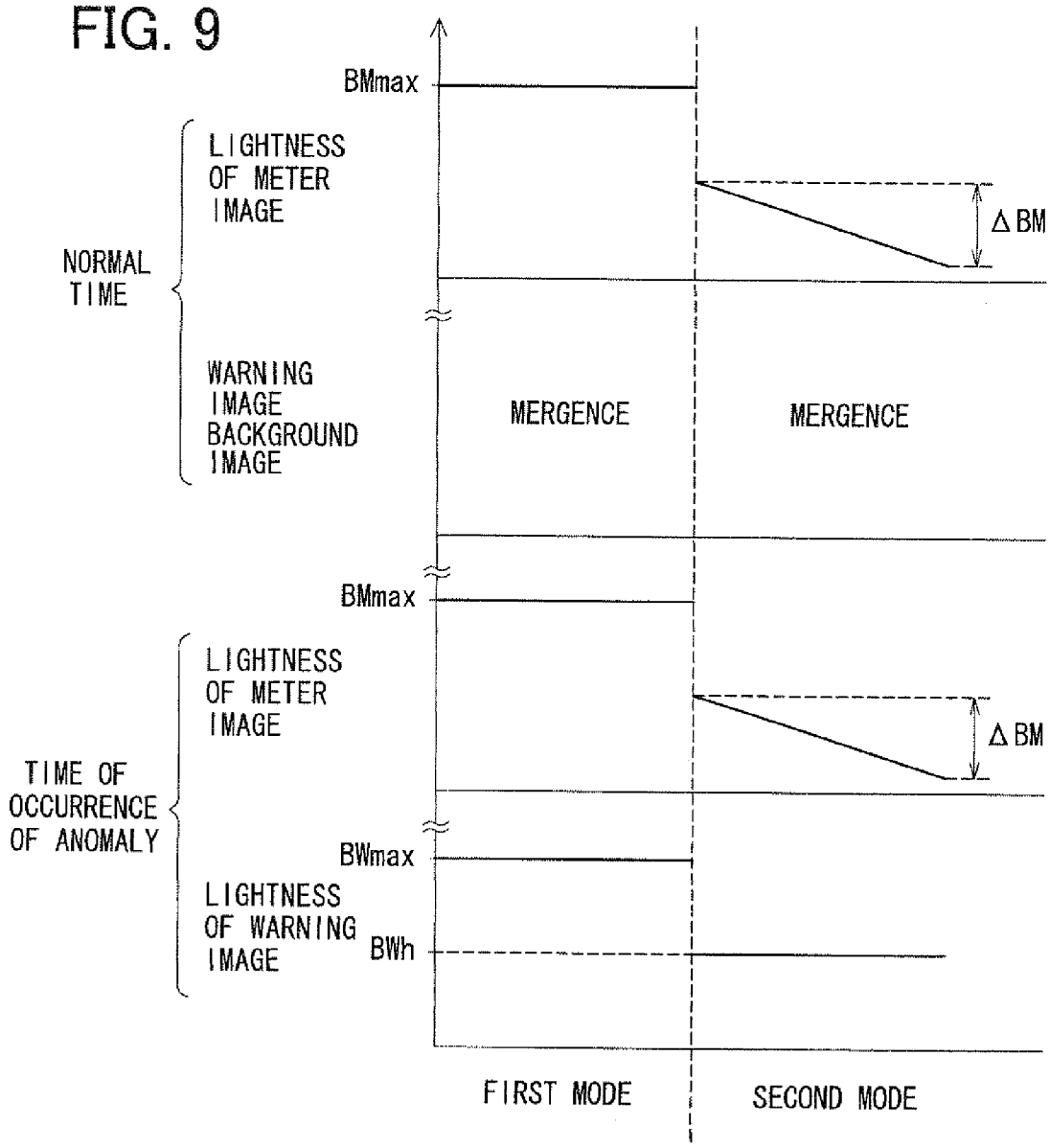
FIG. 9 is a schematic diagram illustrating the state of an image display in the first example embodiment.
Figure 10:
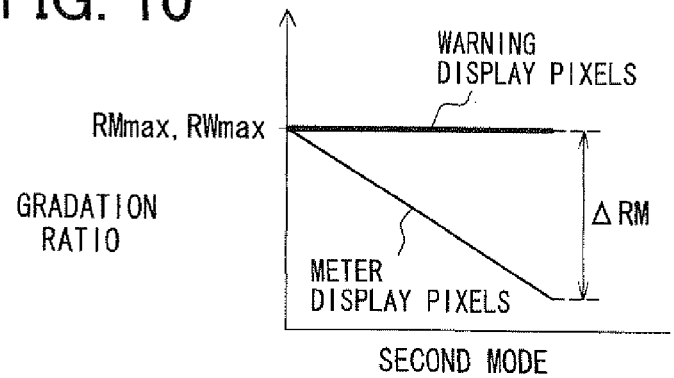
FIG. 10 is a schematic diagram illustrating the correlation characteristic of the gradation ratios of pixels in the first example embodiment.

Description will now be provided for the displaying operation of the display device 1 for a vehicle with reference to FIGS. 1 and 8 to 10. FIGS. 1 and 10 illustrate the gradation ratio of pixels; FIG. 8 illustrates the light emission brightness of the light source; and FIG. 9 illustrates the state of an image display (lightness, etc.).

(1) First Mode

The control circuit 50 sets the control mode to the first mode when it receives at least either of the following: a signal indicating the all lamps off position from the light switch 52; and a signal indicating an outside light intensity exceeding a threshold value I from the illuminance sensor 56. Therefore, the first mode is usually established at daytime when the outside light intensity is high.

In the first mode established as mentioned above, the control circuit 50 controls the light source 40 to carry out the following both at a normal time and at a time of the occurrence of an anomaly: the control circuit keeps the light emission brightness at the light emission face 46 (hereafter, simply referred to as "light emission brightness") of the light source at a maximum level of brightness Lmax (FIG. 8); and further it controls the gradation ratio of the background display pixels 82 to a fixed ratio RWfix to keep the lightness of the background image 80 constant.

At a normal time in the first mode, the control circuit 50 carries out the following regardless of the operative position of the liquid crystal adjustment switch 53. That is, at a normal time in the first mode, the control circuit 50 carries out the following regardless of the adjustment value for image lightness inputted from the occupant (hereafter, simply referred to as "inputted adjustment value"): the control circuit keeps the gradation ratio of the meter display pixels 62 at a maximum ratio RMmax (FIG. 1); and further it keeps the gradation ratio of the warning display pixels 72 at the same fixed ratio RWfix as of the background display pixels 82 (FIG. 1). At a normal time in the first mode, therefore, the meter image 60 is displayed with the maximum allowable level of lightness BMmax (FIG. 9), combined with the action of the light source 40 with the highest level of brightness Lmax. At the same time, the warning image 70 is merged into the background image 80 (FIG. 9).

An example will now be described. When 64-level gradation values of 0 to 63 are prepared, yellow is selected as the tint of the meter image 60. Further, 63 and 31, or the set gradation values of the subpixels R and G of the meter display pixels 62, are respectively selected as the gradation values of the subpixels R and G so that 100% as the maximum ratio RMmax is obtained. At the same time, 0 is selected as the gradation value of the subpixel B of the pixels 62. Red is selected as the tint of the warning image 70. Further, 15, 0, and 0 are respectively selected as the gradation values of the subpixels R, G, and B of the warning display pixels 72 so that 25% is obtained as the fixed ratio RWfix. Blue is selected as the tint of the background image 80. Further, 0, 0, and 15 are respectively selected as the gradation values of the subpixels R, G, and B of the background display pixels 82 so that 25% is obtained as the fixed ratio RWfix. As the result of this selection of tints and gradation values, the following takes place: the meter image 60 is displayed with the maximum allowable level of lightness BMmax, as mentioned above; and though the warning image 70 and the background image 80 are different from each other in tint, they are both in dark color and indistinguishably merged into each other.

At a time of the occurrence of an anomaly in the first mode, the control circuit 50 carries out the following processing regardless of the inputted adjustment value from the occupant: it keeps the gradation ratio of the meter display pixels 62 and the gradation ratio of the warning display pixels 72 at the respective maximum ratios RMmax and RWmax equal to each other (FIG. 1). At a time of the occurrence of an anomaly in the first mode, therefore, the meter image 60 and the warning image 70 are displayed with the respective maximum allowable levels of lightness BMmax and BWmax (FIG. 9), combined with the action of the light source 40 with the maximum level of brightness Lmax.

In case of the above example, the tint of the warning image 70 is red. Therefore, 63 as the set gradation value is selected as the gradation value of the subpixel R of the warning display pixels 72 so that the maximum ratio RWmax of 100% is obtained. At the same time, 0 is selected as both the gradation values of the subpixels G and B of the pixels 72. Thus, the warning image 70 is displayed with the maximum allowable level of lightness BWmax as the meter image 60 is.

(2) Second Mode

The control circuit 50 sets the control mode to the second mode when it receives both of the following: a signal indicating the position lamp on position or the headlamp on position from the light switch 52; and a signal indicating an outside light intensity equal to or lower than the threshold value I from the illuminance sensor 56. Therefore, the second mode is usually established at nighttime when the outside light intensity is low or when the vehicle runs through a dark area.

In the second mode established as mentioned above, the control circuit 50 controls the light emitting operation of the light source 40 to carry out the following processing both at a normal time and at a time of the occurrence of an anomaly: the control circuit keeps the light emission brightness of the light source at an intermediate level of brightness Lmid lower than the highest level of brightness Lmax (FIG. 8); and further it controls the gradation ratio of the background display pixels 82 to the same fixed ratio RWfix as described under Item (1) to keep the lightness of the background image 80 constant.

At a normal time in the second mode, the control circuit 50 variably controls the gradation ratio of the meter display pixels 62 to a value corresponding to the inputted adjustment value from the occupant. At this time, in this example embodiment, the gradation ratio of the meter display pixels 62 is variably controlled so that the following takes place: it is linearly reduced from the maximum ratio RMmax within a range ΔRM (FIG. 1) in response to increasing change in inputted adjustment value. At the same time, the control circuit 50 carries out the following processing regardless of the inputted adjustment value from the occupant: it keeps the gradation ratio of the warning display pixels 72 at a normal time in the second mode at the same fixed ratio RWfix as of the background display pixels 82 (FIG. 1). At a normal time in the second mode, therefore, the lightness of the meter image 60 is reduced to the occupant's desired lightness ΔBM (FIG. 9), combined with the action of the light source 40 with the intermediate level of brightness Lmid. At the same time, the warning image 70 is merged into the background image 80 (FIG. 9).

In case of the example described under Item (1), the tint of the meter image 60 is yellow. Therefore, the selected gradation value of the subpixel B of the meter display pixels 62 is fixed at 0. Further, the selected gradation values of the subpixels R and G of the pixels 62 are respectively linearly reduced between 63 and 1 and between 31 and 1 so that the following is implemented: their gradation ratios to the set gradation values 63 and 31 are identical (e.g., 100% to 10% or so). Specifically, the following measure is taken in this case: when the gradation ratio of the meter display pixels 62 is reduced to 50%, 31, 15, and 0 are respectively selected as the gradation values of the subpixels R, G, and B; and when the gradation ratio is reduced to 10%, 6, 3, and 0 are respectively selected as the gradation values of the subpixels R, G, and B.

At a time of the occurrence of an anomaly in the second mode, the control circuit 50 variably controls the gradation ratio of the meter display pixels 62 as at the above-mentioned normal time in the second mode. That is, also at a time of the occurrence of an anomaly in the second mode, the following is implemented: the gradation ratio of the meter display pixels 62 is variably controlled within the range ΔRM (FIG. 1) so that it is linearly reduced from the maximum ratio RMmax in response to increasing change in the inputted adjustment value. Further, the control circuit 50 carries out the following regardless of the inputted adjustment value from the occupant: it keeps the gradation ratio of the warning display pixels 72 at a time of the occurrence of an anomaly in the second mode at the same maximum ratio RWmax as at a time of the occurrence of an anomaly in the first mode (FIG. 1). As illustrated in FIG. 10, therefore, the following is implemented in the second mode in this example embodiment in which the values of RMmax and RWmax are identical with each other: the processing of holding the gradation ratio of the warning display pixels 72 at a time of the occurrence of an anomaly so that the following is implemented is achieved: it becomes higher than the gradation ratio of the meter display pixels 62 varied from RMmax according to the inputted adjustment value.

In case of the example described under Item (1), the tint of the warning image 70 is red. Therefore, the selected gradation values of the subpixels R, G, and B of the warning display pixels 72 are respectively set to 63, 0, and 0 and the following is thereby implemented: the gradation ratio of the selected gradation value of the subpixel R to its set gradation value is set to the maximum ratio RWmax (100%) to make it equal to or higher than the gradation ratio (e.g., 100% to 10%) of the meter image 62. As is apparent from the above example and description, setting a gradation ratio to maximum ratio RWmax means that a gradation value identical with a set gradation value at a time of the occurrence of an anomaly in the first mode is selected.

As mentioned above, at a time of the occurrence of an anomaly in the second mode, the lightness of the meter image 60 is reduced to the occupant's desired lightness ΔBM (FIG. 9), combined with the action of the light source 40 with the intermediate level of brightness Lmid. At the same time, the lightness of the warning image 70 is kept at the lightness BWh (FIG. 9) that is the highest level of lightness under the intermediate level of brightness Lmid. The lightness BWh is set to the highest possible value so that the warning image 70 can be easily viewed under the intermediate level of brightness Lmid.

As mentioned above, at a time of the occurrence of an anomaly in the second mode, the light source 40 is dimmed and further the gradation ratio of the meter display pixels 62 is linearly reduced from the maximum ratio RWmax. As a result, the lightness of the meter image 60 is reduced to the occupant's desired lightness ΔBM but the gradation ratio of the warning image 70 of the warning display pixels 72 is kept at the maximum ratio RWmax. This increases the lightness of the warning image 70 relative to that of the meter image 60. Here, for example, FIG. 10 will be considered with the vertical axis taken for the brightness of the images 60 and 70 corresponding to the pixels 62 and 72, instead of the gradation ratio. Thus, it can be easily understood that the lightness of the warning image 70 becomes relatively higher than the lightness of the meter image 60. (This is the same with FIGS. 17, 26, 31, 35, 38, 40, 42, 44, 46, 48, 50, 52, and 65 described later.) According to the foregoing, the occupant will not fail to notice the warning image 70 even when the lightness of the light source 40 is reduced by half.

(3) Mode Change

Hereafter, description will be provided for the displaying operation at a time of mode change on the assumption that the control circuit 50 in this example embodiment does not carry out mode change at the same time as the occurrence of an anomaly.

(3-1) Changeover from First Mode to Second Mode

When the control circuit 50 changes the control mode from the first mode to the second mode, it carries out the following processing: the control circuit controls the light emitting operation of the light source 40 to cause its light emission brightness to transition from the maximum level Lmax to the intermediate level of brightness Lmid described under Item (2). At the same time, the control circuit 50 maintains the following gradation ratios: it keeps the gradation ratio of the meter display pixels 62 at the maximum ratio RMmax and the gradation ratios of the warning display pixels 72 and the background display pixels 82 at the fixed ratio RWfix described under Item (1). At a time of changeover from the first mode to the second mode, therefore, the lightness of the entire screen 12 displaying the meter image 60 is reduced by an amount equivalent to the reduction in the light emission brightness of the light source 40.

(3-2) Changeover from Second Mode to First Mode

When the control circuit 50 changes the control mode from the second mode to the first mode, it carries out the following processing: the control circuit controls the light emitting operation of the light source 40 to cause its light emission brightness to transition from the intermediate level of brightness Lmid described under Item (2) to the maximum brightness Lmax. At the same time, the control circuit 50 controls the gradation ratio of the meter display pixels 62 to the maximum ratio RMmax and keeps the gradation ratio of the warning display pixels 72 and the gradation ratio of the background display pixels 82 at the fixed ratio RWfix described under Item (2). At a time of changeover from the second mode to the first mode, therefore, the lightness of the entire screen 12 displaying the meter image 60 is increased by an amount equivalent to the increase in the light emission brightness of the light source 40.

Figure 11:
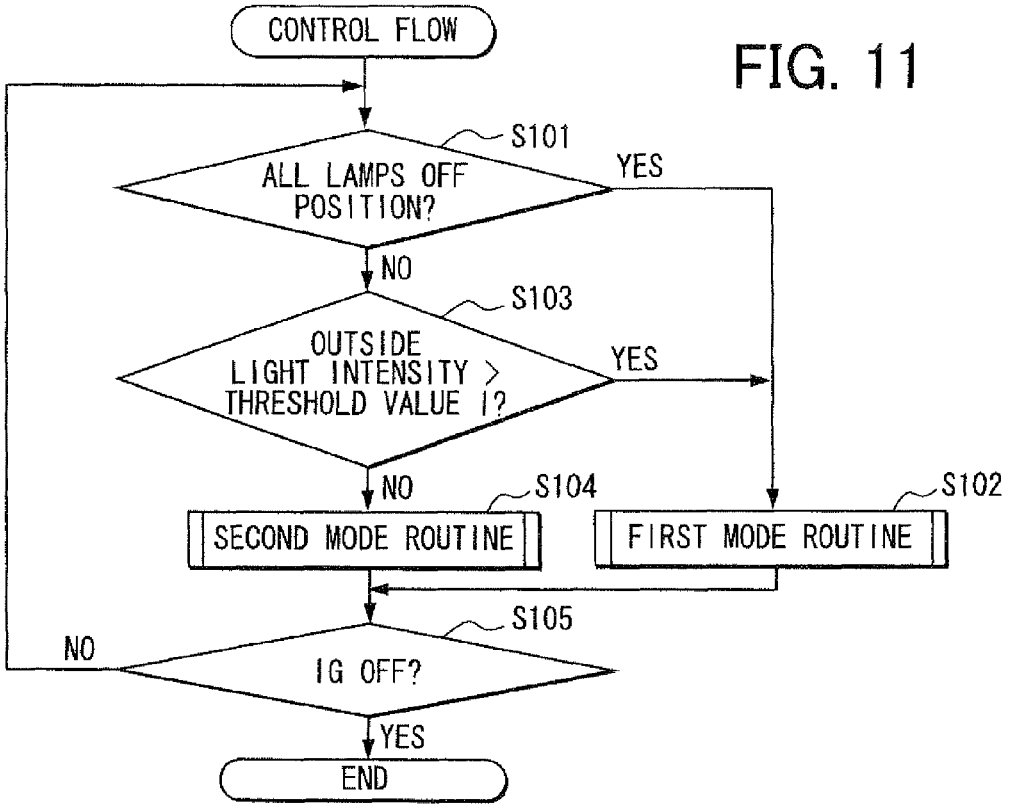
FIG. 11 is a flowchart illustrating a control flow in the first example embodiment.
Figure 12:
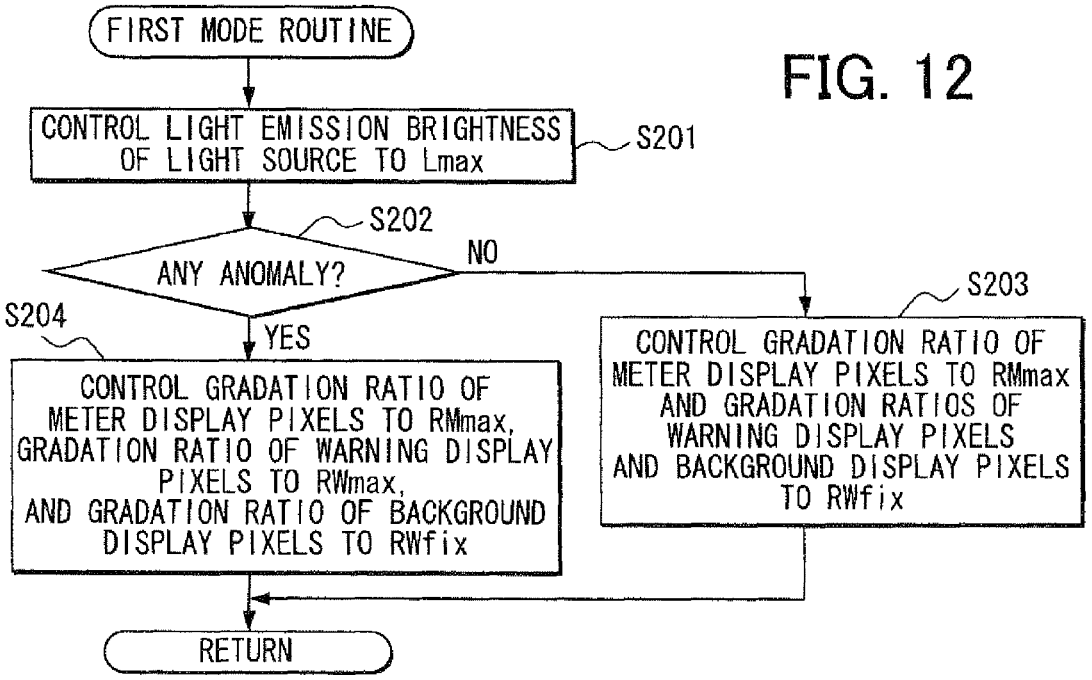
FIG. 12 is a flowchart illustrating a first mode routine in the first example embodiment.

Description will now be provided for the flow of control on the display device 1 for a vehicle carried out by the control circuit 50 with reference to FIGS. 11 to 13. This control flow is started when the ignition switch of the vehicle is turned on.

As illustrated in FIG. 11, it is determined at Step S101 of the control flow whether a signal from the light switch 52 indicates the all lamps off position. When an affirmative determination is made as a result, the flow proceeds to Step S102, and the control mode is set to the first mode and a first mode routine is executed.

When a negative determination is made at Step S101, that is, when the signal from the light switch 52 indicates the position lamp on position or the headlamp on position, the flow proceeds to Step S103. Then, it is determined whether a signal from the illuminance sensor 56 indicates an outside light intensity exceeding the threshold value I. When an affirmative determination is made as a result, the flow similarly proceeds to Step S102 and the first mode routine is executed.

When a negative determination is made at Step S103, that is, when the signal from the illuminance sensor 56 indicates an outside light intensity equal to or lower than the threshold value I, the flow proceeds to Step S104. Then, the control mode is set to the second mode and a second mode routine is executed.

After the completion of either mode routine, it is determined at Step S105 whether the ignition switch has been turned off. When an affirmative determination is made as a result, this control flow is terminated. When a negative determination is made, the flow returns to Step S101 and this control flow is continued.

The details of the first mode routine executed at Step S102 in this control flow are as illustrated in FIG. 12. A more specific description will now be given. At Step S201 of the first mode routine, the light emission brightness of the light source 40 is controlled to the maximum brightness Lmax. At Step S202, subsequently, it is determined whether a signal from the anomaly sensor 55 indicates a water temperature anomaly in engine cooling water.

When a negative determination is made at Step S202, that is, at a normal time, the flow proceeds to Step S203. Then, the gradation ratio of the meter display pixels 62 is controlled to the maximum ratio RMmax, and further the gradation ratios of the warning display pixels 72 and the background display pixels 82 are controlled to the fixed ratio RWfix. As a result, the meter image 60 with the maximum allowable level of lightness BMmax is encircled with the background image 80 and is thereby prominently displayed. At the same time, the warning image 70 is merged into the background image 80 and cannot be viewed.

When an affirmative determination is made at Step S202, that is, at a time of the occurrence of an anomaly, the flow proceeds to Step S204. Then, the gradation ratios of the meter display pixels 62 and the warning display pixels 72 are respectively controlled to the maximum ratios RMmax and RWmax, and further the gradation ratio of the background display pixels 82 is controlled to the fixed ratio RWfix. As a result, the meter image 60 and the warning image 70 with the respective maximum allowable levels of lightness BMmax and BWmax are encircled with the background image 80, and are thereby prominently displayed.

The details of the first mode routine are as described above. Meanwhile, the details of the second mode routine executed at Step S104 are as illustrated in FIG. 13. A more specific description will now be given. At Step S301 of the second mode routine, the light emission brightness of the light source 40 is controlled to the intermediate level of brightness Lmid. At Step S302, subsequently, it is determined whether a signal from the anomaly sensor 55 indicates a water temperature anomaly in engine cooling water.

When a negative determination is made at Step S302, that is, at a normal time, the flow proceeds to Step S303. Then, the gradation ratio of the meter display pixels 62 is controlled to within a range ΔRM equal to or lower than the maximum ratio RMmax according to the inputted adjustment value indicated by a signal from the liquid crystal adjustment switch 53. At Step S303, in addition, the gradation ratios of the warning display pixels 72 and the background display pixels 82 are controlled to the fixed ratio RWfix. As a result, the meter image 60 with the lightness reduced according to the inputted adjustment value is displayed amid the background image 80. At the same time, the warning image 70 is merged into the background image 80 and cannot be viewed.

However, the following processing is carried out at Step S303 of the second mode routine executed when the flow returns to Step S101 after the execution of the first mode routine and the operation mode is changed (changeover time second mode routine): the gradation ratio of the meter display pixels 62 is controlled to the maximum ratio RMmax regardless of the inputted adjustment value. Thus, the following takes place at a time of changeover from the first mode to the second mode: the lightness of the entire screen 12 displaying the meter image 60 is reduced by an amount equivalent to the reduction in the light emission brightness of the light source 40 at Step S301.

When an affirmative determination is made, conversely to such a normal time, at Step S302, that is, at a time of the occurrence of an anomaly, the flow proceeds to Step S304. Then, the gradation ratios of the meter display pixels 62 and the background display pixels 82 are controlled as at Step S303. However, the gradation value of the warning display pixels 72 is controlled to the maximum ratio RWmax. As a result, the meter image 60 with the lightness reduced according to the inputted adjustment value is displayed amid the background image 80. At the same time, the warning image 70 with the lightness BWh that is the maximum level of lightness under the intermediate level of brightness Lmid is displayed regardless of the inputted adjustment value. Moreover, it is encircled with the background image 80 and is thereby prominently displayed.

According to the first example embodiment described up to this point, the second mode can be established to reduce the lightness of the meter image 60 to the occupant's desired lightness in a situation in which the outside light intensity is low. Therefore, the meter image 60 can be provided with the visibility tailored to the occupant's taste. In the second mode, in addition, the gradation ratio of the meter display pixels 62 for displaying the meter image 60 can be varied within as wide a range as the maximum ratio or below. Therefore, it is possible to reduce the lightness of the meter image 60 and yet enhance the degree of freedom in its adjustment as much as possible. Further, even in the second mode in which the lightness of the meter image 60 is reduced, a level of lightness sufficient to enhance easy viewability can be ensured with respect to the warning image 70 displayed at a time of the occurrence of an anomaly. Therefore, it is possible to reliably achieve the intended purpose of the warning image 70 of giving a warning about the occurrence of an anomaly to alert an occupant. Thus, it is possible to appropriately display both the meter image 60 with higher priority given to visibility and the warning image 70 with higher priority given to the attainment of the purpose of display.

In a situation in which the outside light intensity is high and the meter image 60 and the warning image 70 are relatively easy to view, the first mode can be established to fix the lightness of the images 60, 70 at the maximum allowable level of lightness. Therefore, control processing required to display an image can be simplified.

At a time of changeover from the first mode to the second mode, the lightness of the meter image 60 can be largely varied according to reduction in the light emission brightness of the light source 40. Therefore, a display provided with a sharp contrast can be achieved before and after mode change. In the second mode, in addition, change in the lightness of the meter image 60 can be made smooth by this dimming of the light source 40 without finely controlling linear reduction in the gradation ratio of the meter display pixels 62.

Second Example Embodiment

Figure 15:
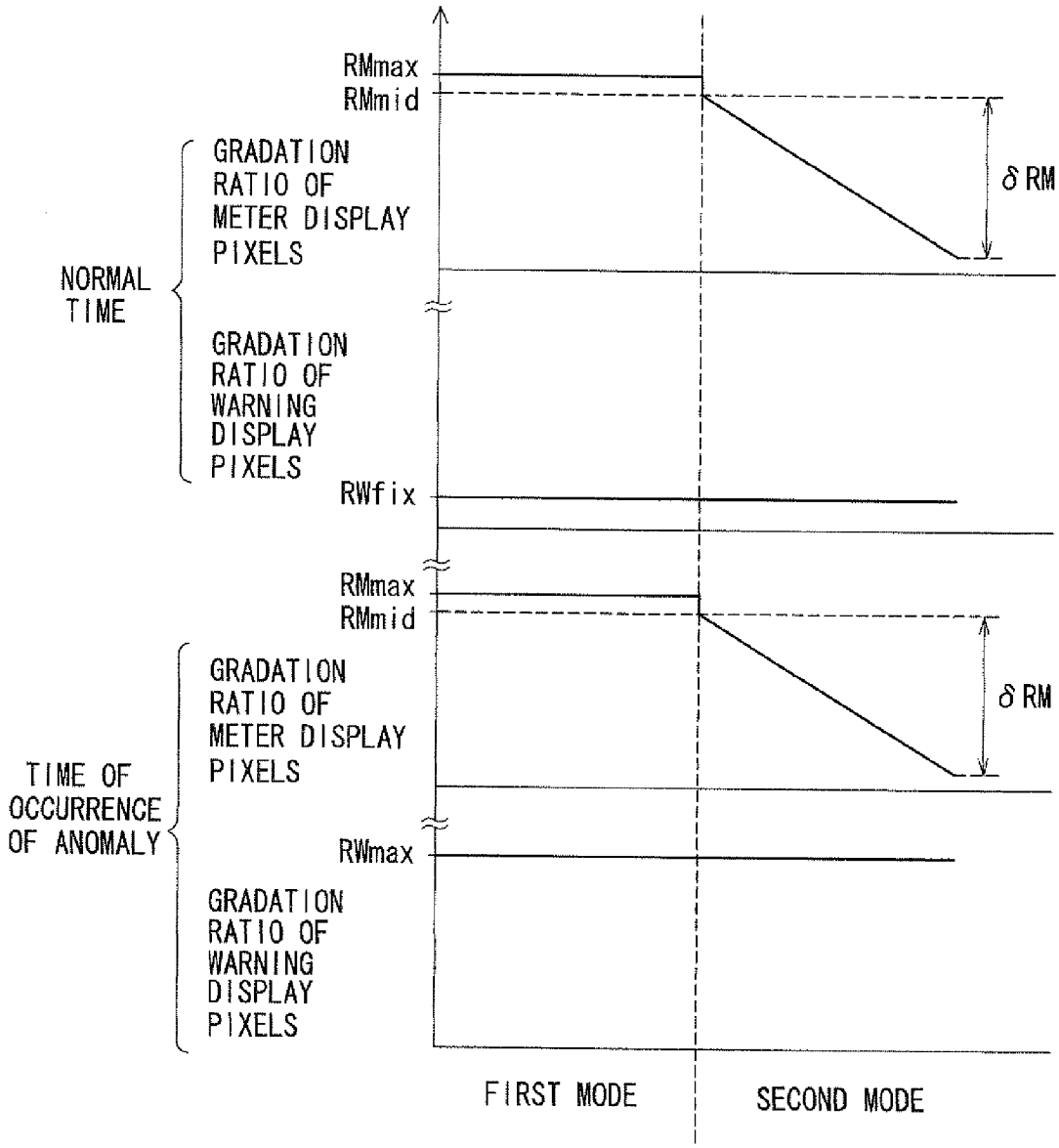
FIG. 15 is a schematic diagram illustrating the gradation ratios of pixels in a second example embodiment.
Figure 16:
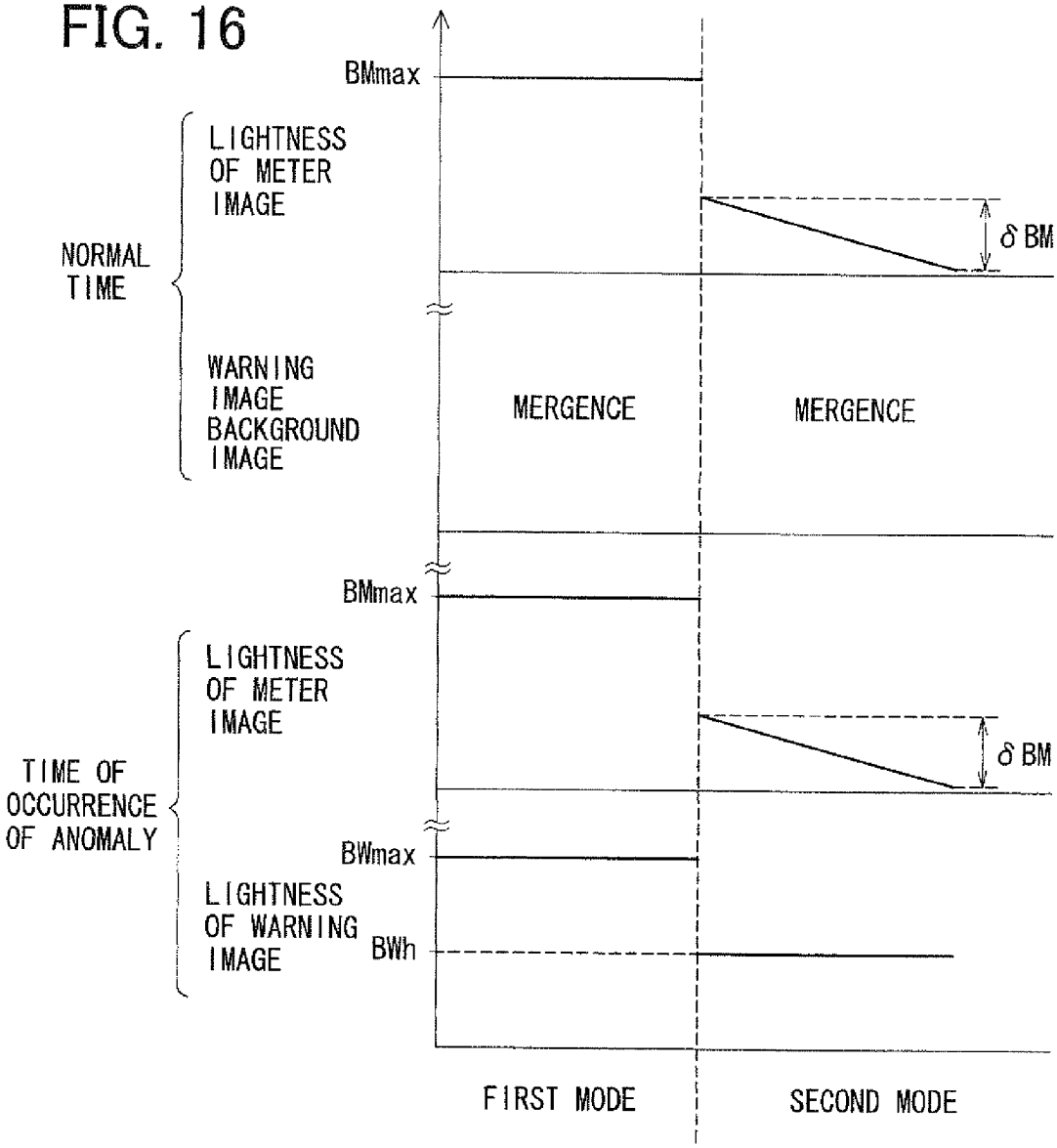
FIG. 16 is a schematic diagram illustrating the state of an image display in the second example embodiment.

As illustrated in FIGS. 15 and 16, a second example embodiment is a modification to the first example embodiment in the displaying operation of the display device 1 for a vehicle. Hereafter, description will be given with a focus on a difference from the first example embodiment, and the description of the portions of the second embodiment which is substantially the same as that of the first example embodiment has been omitted.

A more specific description will now be given. At a time of changeover from the first mode to the second mode, the control circuit 50 reduces the gradation ratio of the meter display pixels 62 from the maximum ratio RMmax to an intermediate ratio RMmid (FIG. 15). This intermediate ratio RMmid is set to a gradation ratio lower than the maximum ratio RMmax by an amount equivalent to, for example, one grade of the adjustment value for the lightness of the meter image 60. At this changeover time, therefore, the lightness of the entire screen 12 displaying the meter image 60 is reduced by an amount equivalent to the reduction in the gradation ratio of the meter display pixels 62 in addition to the reduction in the light emission brightness of the light source 40.

Figure 17:
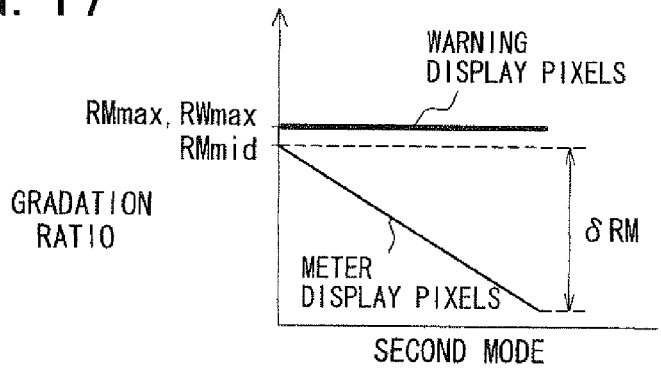
FIG. 17 is a schematic diagram illustrating the correlation characteristic of the gradation ratios of pixels in the second example embodiment and a fourth example embodiment.

At a normal time and at a time of the occurrence of an anomaly in the second mode after mode change, the control circuit 50 carries out the following processing: it variably controls the gradation ratio of the meter display pixels 62 to linearly reduce it from the intermediate ratio RMmid within a range δRM (FIG. 15) in response to increasing change in inputted adjustment value; and it thereby reduces the lightness of the meter image 60 to the occupant's desired lightness δBM (FIG. 16). As illustrated in FIG. 17, therefore, the following is implemented during in the second mode in this example embodiment in which the value of RMmid is lower than the value of RWmax: the processing of keeping the gradation ratio of the warning display pixels 72 at a time of the occurrence of an anomaly higher than the gradation ratio of the meter display pixels 62 is achieved.

Figure 18:
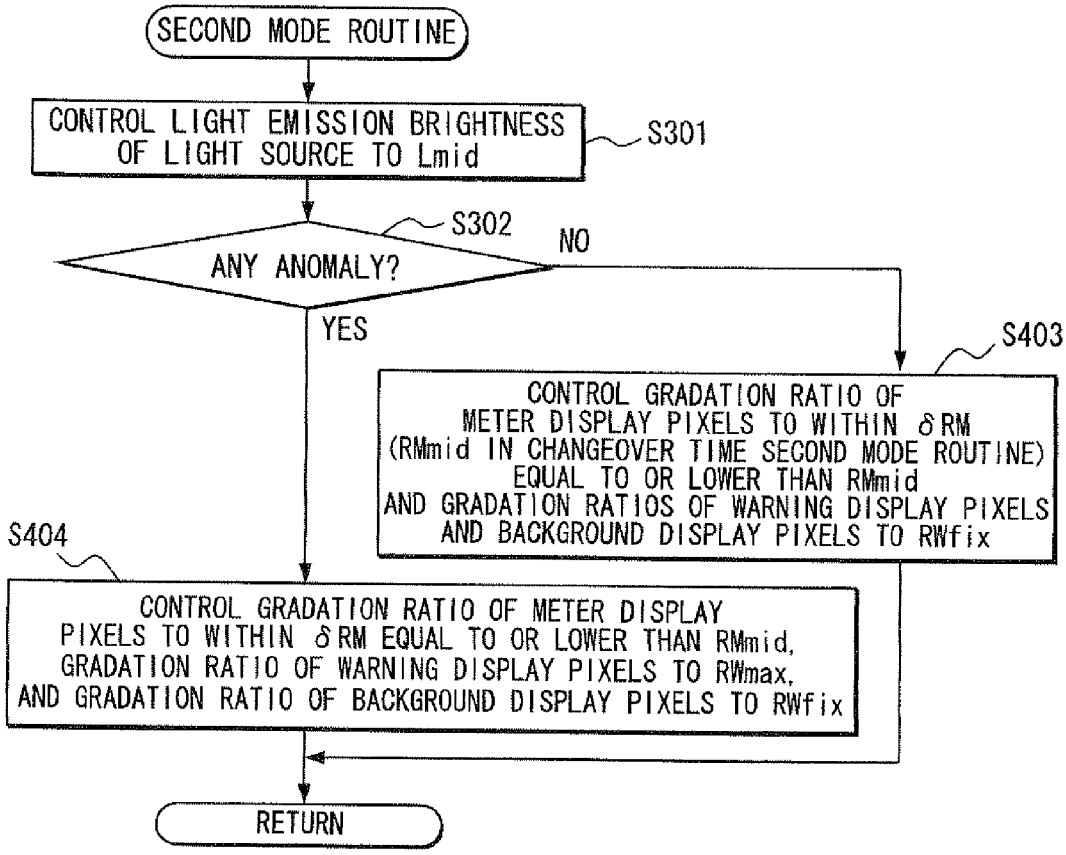
FIG. 18 is a flowchart illustrating a second mode routine in the second example embodiment.

In the control flow of the second mode routine in the second example embodiment mentioned above, the following is implemented as illustrated in FIG. 18: the gradation ratio of the meter display pixels 62 at a normal time and at a time of the occurrence of an anomaly is controlled to within the range δRM equal to or lower than the intermediate ratio RMmid. This control is carried out by the processing of Steps S403 and S404 substituted for Steps S303 and S304 in the first example embodiment according to the inputted adjustment value. At Step S403 of the changeover time second mode routine, however, the gradation ratio of the meter display pixels 62 is controlled to the intermediate ratio RMmid regardless of the inputted adjustment value.

According to the second example embodiment described up to this point, the following can be implemented at a time of changeover from the first mode to the second mode: the lightness of the meter image 60 can be dramatically varied by an amount equivalent to the reduction in the gradation ratio of the meter display pixels 62 added to an amount equivalent to the reduction in the light emission brightness of the light source 40. Therefore, a display can be provided with a noticeable sharp contrast before and after mode change.

According to the second example embodiment, further, the following can be implemented with respect to a display of the meter image 60 in the second mode in which the light emission brightness of the light source 40 is low: the maximum level of lightness can be reduced to enhance its visibility and further the display can be tailored to the occupant's taste.

Third Example Embodiment

Figure 19:
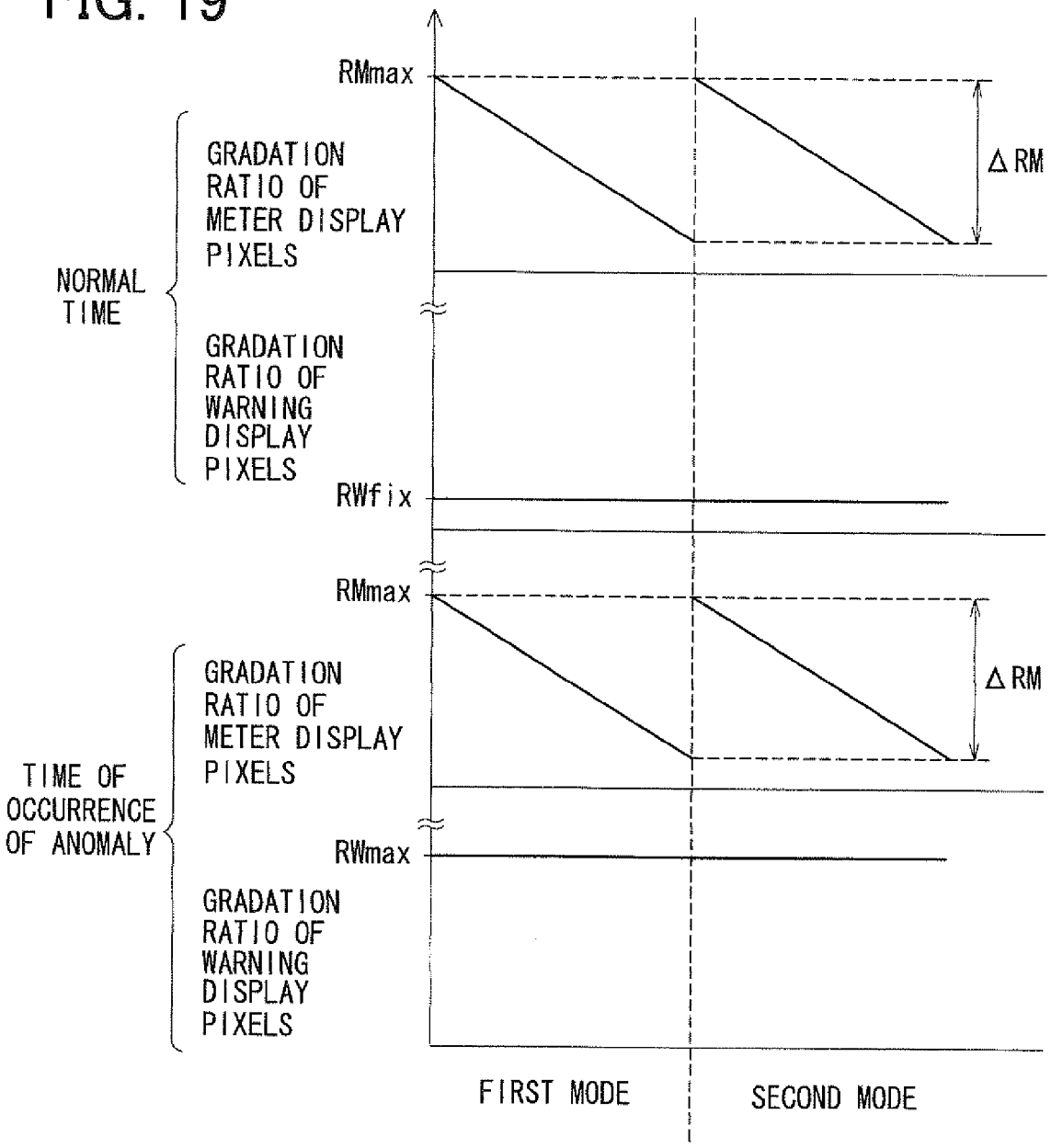
FIG. 19 is a schematic diagram illustrating the gradation ratios of pixels in a third example embodiment.
Figure 20:
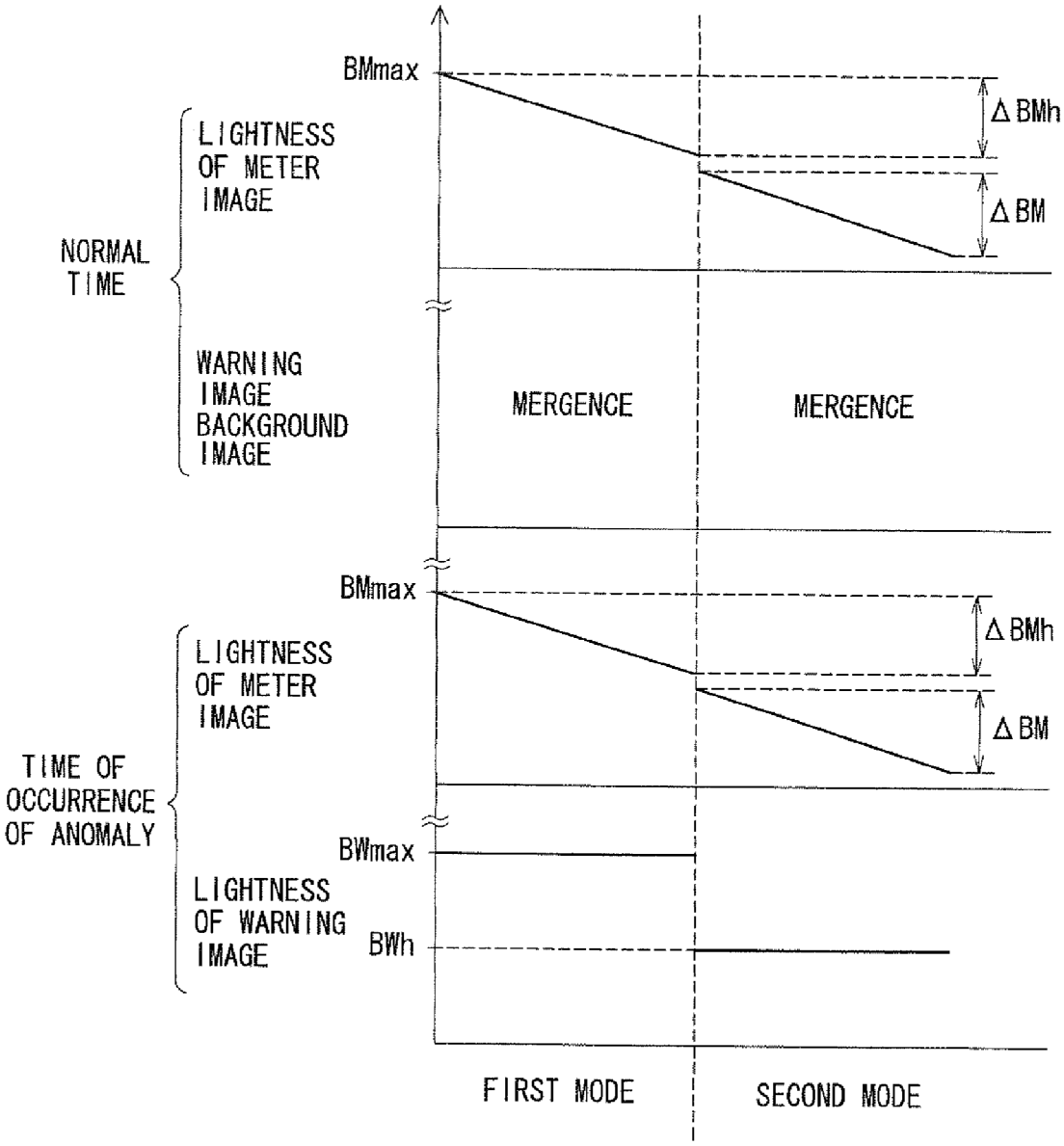
FIG. 20 is a schematic diagram illustrating the state of an image display in the third example embodiment.

As illustrated in FIGS. 19 and 20, a third example embodiment is a modification to the first embodiment in the displaying operation of the display device 1 for a vehicle. Hereafter, description will be given with a focus on a difference from the first example embodiment, and the description of the portions of the third embodiment which is substantially the same as that of the first example embodiment has been omitted.

More specific description will be given. In the first mode, the control circuit 50 controls the gradation ratio of the meter display pixels 62 as in the second mode. In the first mode, specifically, the control circuit 50 carries out the following processing in response to increasing change in inputted adjustment value both at a normal time and at a time of the occurrence of an anomaly: it variably controls the gradation ratio of the meter display pixels 62 to linearly reduce it from the maximum ratio RMmax identical with the upper-limit ratio in the second mode within the same range ΔRM (FIG.

19) as in the second mode. Therefore, the lightness of the meter image 60 is reduced to the occupant's desired lightness ΔBMh (FIG. 20).

In the third example embodiment, the gradation ratio of the meter display pixels 62 is controlled to the maximum ratio RMmax at a time of changeover from the first mode to the second mode and at a time of changeover in the opposite direction. Instead, any other control method may be adopted. For example, the gradation ratio of the meter display pixels 62 may be controlled and kept at a value immediately before mode change. Alternatively, the gradation ratio of the meter display pixels 62 may be controlled to a value set beforehand by the occupant using the liquid crystal adjustment switch 53 or the like or a value preset before product shipment.

Figure 21:
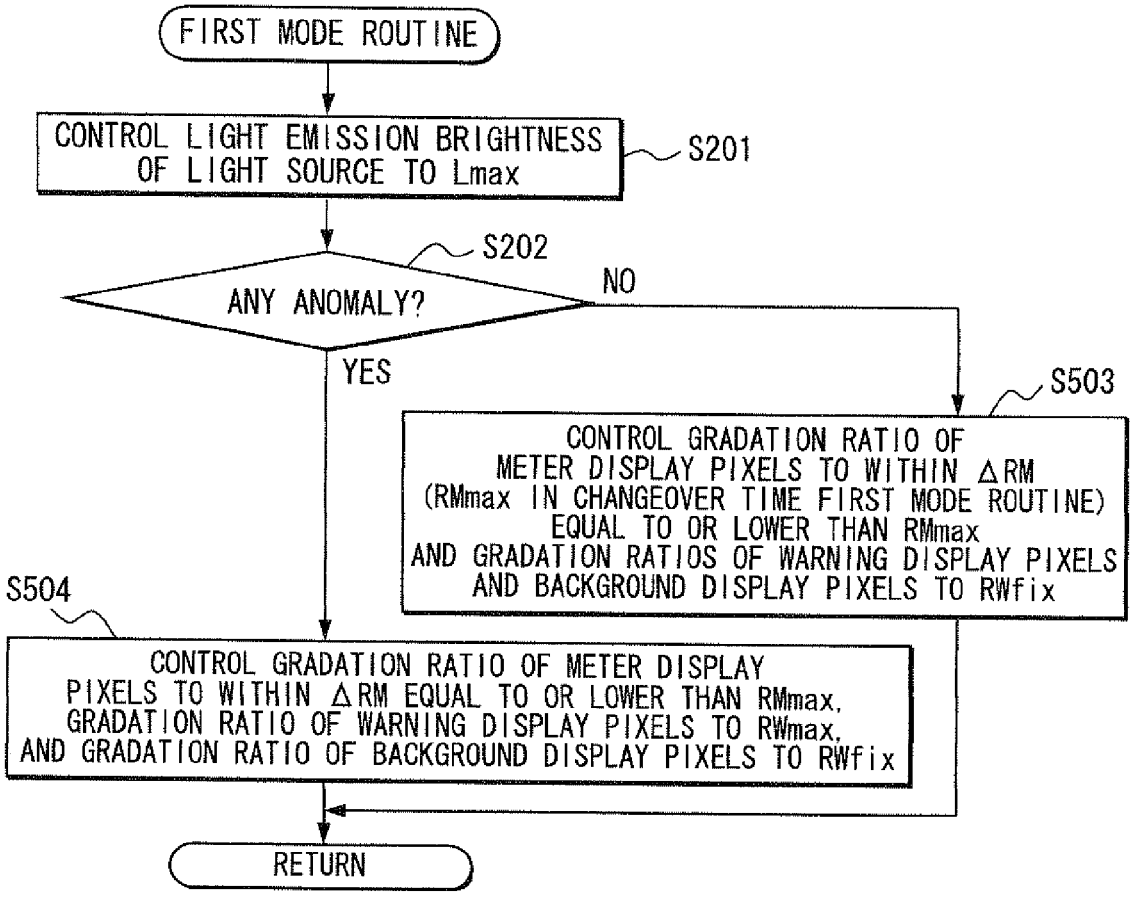
FIG. 21 is a flowchart illustrating a first mode routine in the third example embodiment.

In the control flow of the first mode routine in the third example embodiment, the following processing is carried out as illustrated in FIG. 21: the gradation ratio of the meter display pixels 62 is controlled to within the range ΔRM equal to or lower than the maximum ratio RMmax. This control is carried out by the processing of Steps S503 and S504 substituted for the processing of Steps S203 and S204 in the first example embodiment according to the inputted adjustment value. However, the following processing is carried out at Step S503 of the first mode routine executed when the flow returns to Step S101 after the execution of the second mode routine and the operation mode is changed (changeover time first mode routine): the gradation ratio of the meter display pixels 62 is controlled to the maximum ratio RMmax regardless of the inputted adjustment value.

According to the third example embodiment described up to this point, the following can be implemented not only in the second mode but also in the first mode: the gradation ratio of the meter display pixels 62 can be varied within as wide a range as the maximum ratio or below, and the lightness of the meter image 60 displayed by the meter display pixels 62 can be adjusted with a high degree of freedom. Therefore, a display of the meter image 60 tailored to the occupant's taste can be achieved anytime.

Fourth Example Embodiment

Figure 22:
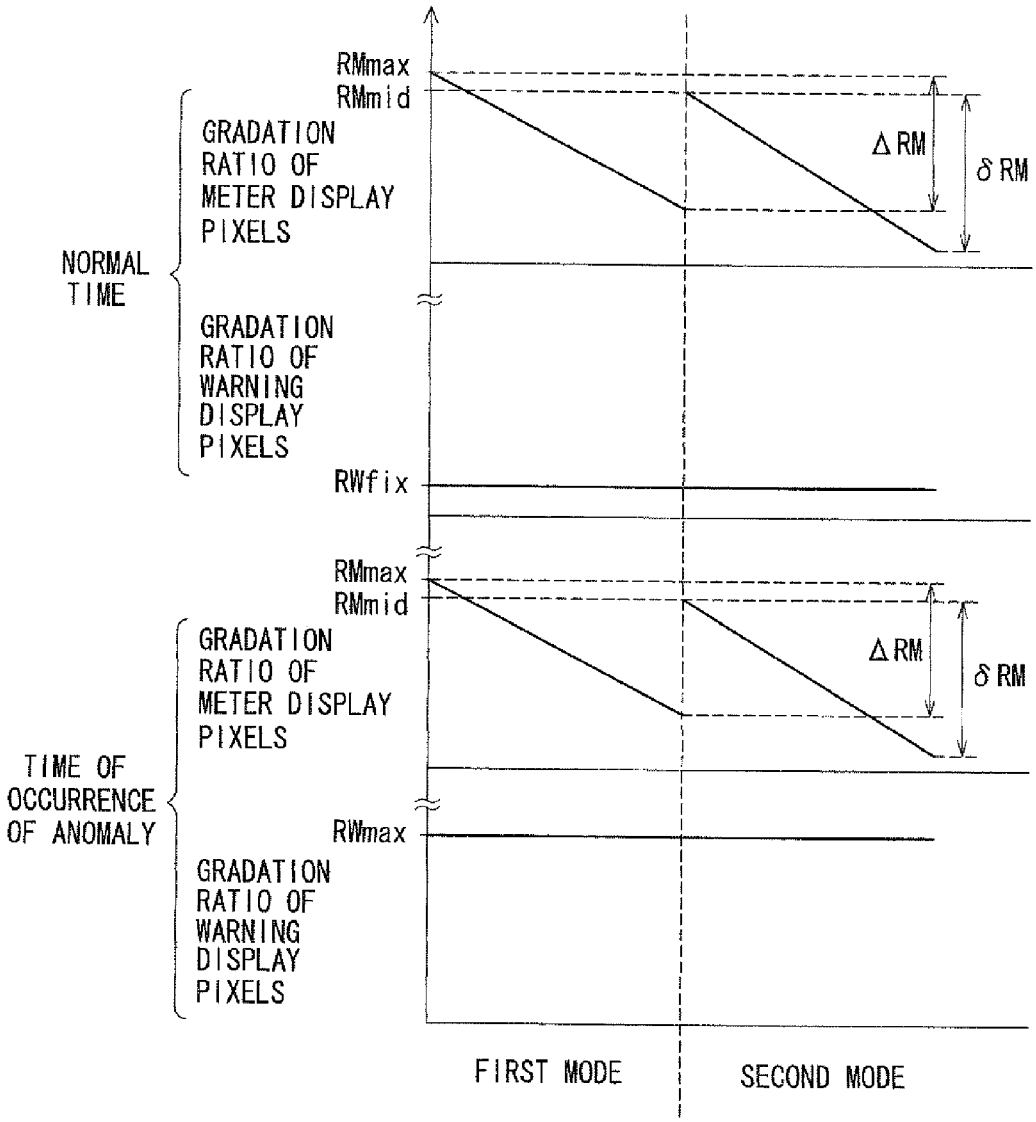
FIG. 22 is a schematic diagram illustrating the gradation ratios of pixels in the fourth example embodiment.
Figure 23:
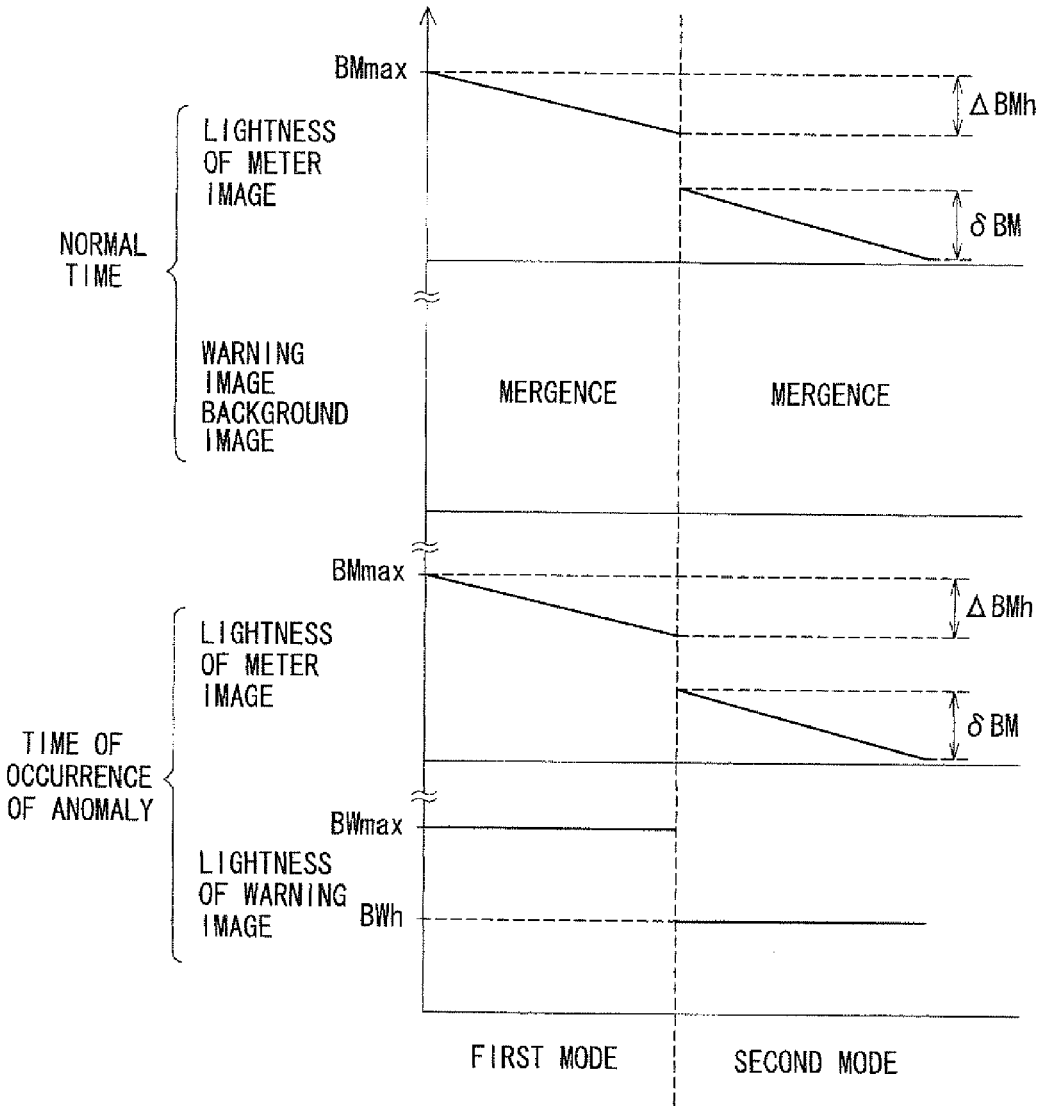
FIG. 23 is a schematic diagram illustrating the state of an image display in the fourth example embodiment.

As illustrated in FIGS. 22 and 23, a fourth example embodiment of the invention is a modification to the third embodiment in the displaying operation of the display device 1 for a vehicle. Hereafter, description will be given with a focus on a difference from the third example embodiment, and the description of the portions of the fourth embodiment which is substantially the same as that of the third example embodiment has been omitted.

A more specific description will now be given. The control circuit 50 carries out the following processing at a time of changeover from the first mode to the second mode: it controls the gradation ratio of the meter display pixels 62 to an intermediate ratio RMmid (FIG. 22) lower than the maximum ratio RMmax. This intermediate ratio RMmid is set to a gradation ratio lower than the maximum ratio RMmax by an amount equivalent to, for example, one grade of the adjustment value for the lightness of the meter image 60.

At a normal time and at a time of the occurrence of an anomaly in the second mode after mode change, the control circuit 50 carries out the following processing: it variably controls the gradation ratio of the meter display pixels 62 within a range δRM (FIG. 22) as in the second example embodiment described above. The variable range δRM in this example embodiment is equal to or lower than the intermediate ratio RMmid and wider than the variable range ΔRM in the first mode. A more specific description will now be given. At a normal time and at a time of the occurrence of an anomaly in the second mode, the gradation ratio of the meter display pixels 62 is variably controlled so that the following is implemented: it is linearly reduced within the range δRM in which RMmid is the upper-limit ratio in response to increasing change in inputted adjustment value. In the second mode, therefore, the lightness of the meter image 60 is adjusted to the occupant's desired lightness δBM (FIG. 23) so that the maximum level of lightness is reduced more than in the first mode. In addition, the range of this adjustment is larger than in the first mode.

As mentioned above, the following is achieved during in the second mode in the fourth example embodiment in which the value of RMmid is smaller than the value of RWmax as illustrated in FIG. 17: the gradation processing of keeping the gradation ratio of the warning display pixels 72 at a time of the occurrence of an anomaly higher than the gradation ratio of the meter display pixels 62 is achieved. The control flow of the second mode routine in the above-mentioned fourth example embodiment is identical with the above-mentioned second mode routine (FIG. 18) in the second example embodiment.

According to the fourth example embodiment described up to this point, the following can be implemented with respect to a display of the meter image 60 in the second mode in which the light emission brightness of the light source 40 is low: the maximum level of lightness can be reduced to enhance its visibility and further the range of lightness adjustment can be widened to enhance response to an occupant's taste.

Fifth Example Embodiment

Figure 24:
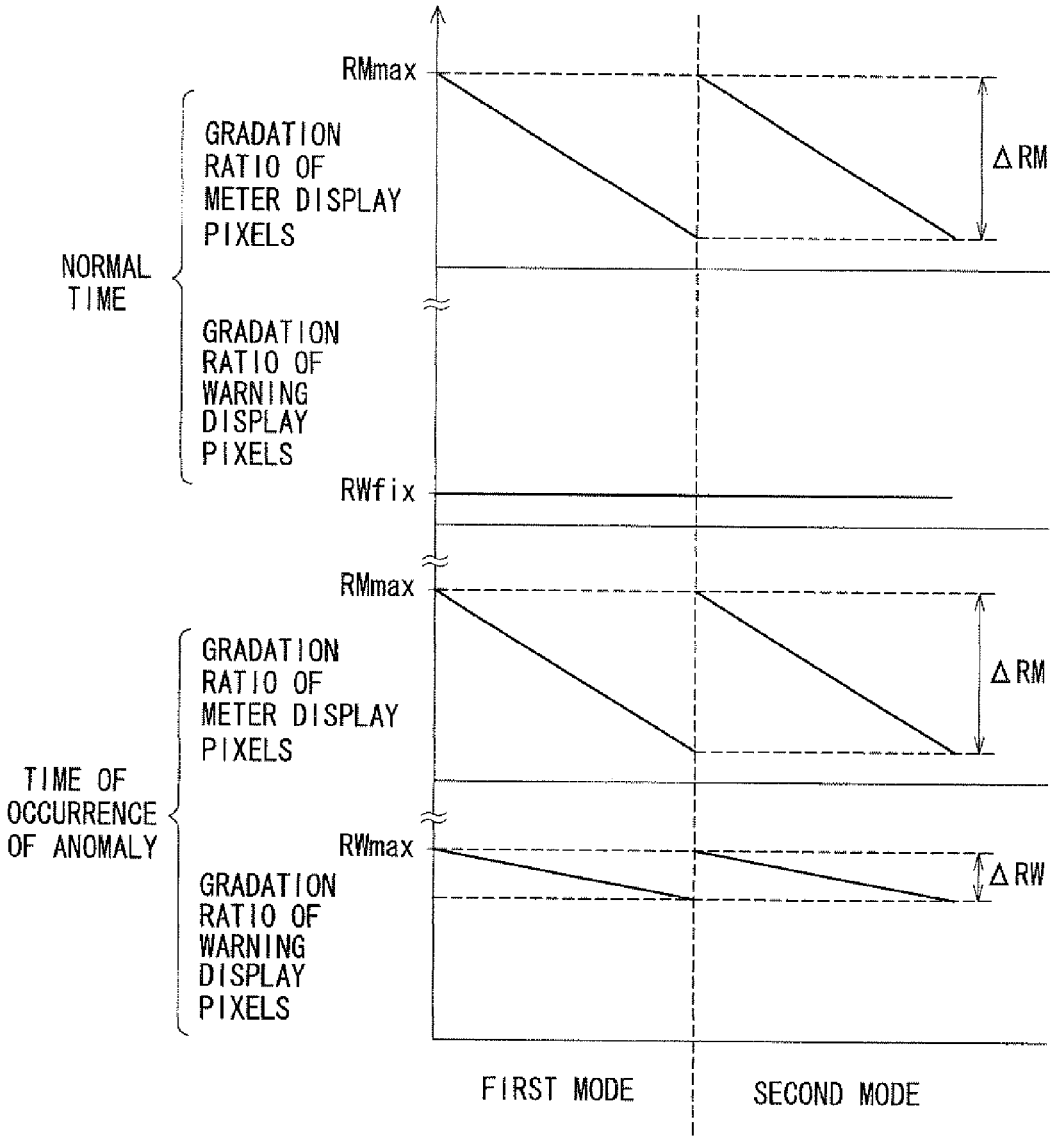
FIG. 24 is a schematic diagram illustrating the gradation ratios of pixels in a fifth example embodiment.
Figure 25:
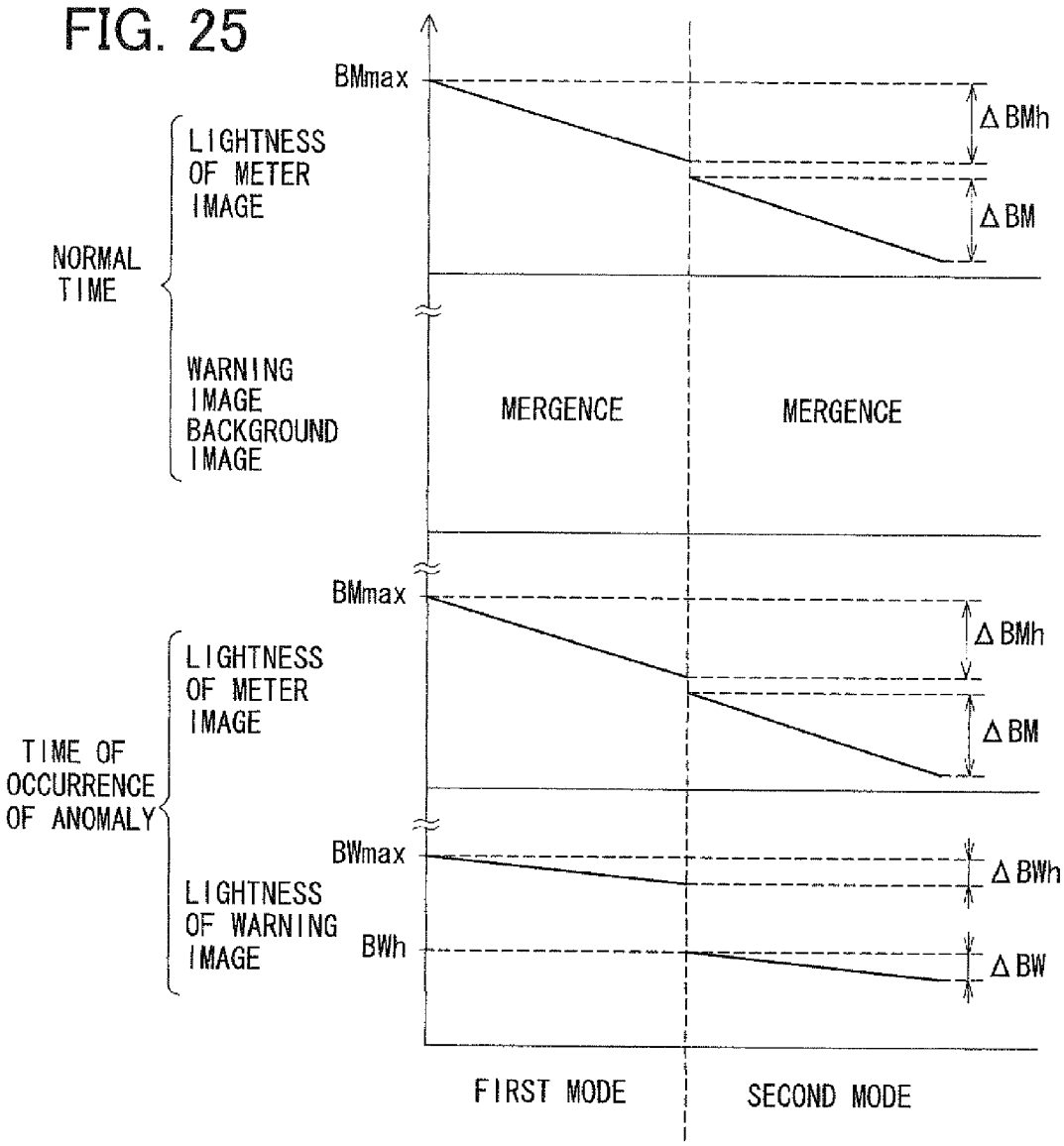
FIG. 25 is a schematic diagram illustrating the state of an image display in the fifth example embodiment.

As illustrated in FIGS. 24 and 25, a fifth example embodiment is a modification to the third example embodiment in the displaying operation of the display device 1 for a vehicle. Hereafter, description will be given with a focus on a difference from the third example embodiment, and the description of the portion of the fifth embodiment which is substantially the same as that of the third example embodiment has been omitted.

A more specific description now will be given. At a time of the occurrence of an anomaly both in the first mode and in the second mode, the control circuit 50 variably controls the gradation ratio of the warning display pixels 72 according to the inputted adjustment value. At this time in this example embodiment, the gradation ratio of the warning display pixels 72 is variably controlled so that the following is implemented in response to increasing change in inputted adjustment value: it is linearly reduced from the maximum ratio RWmax identical with the maximum gradation ratio RMmax of the meter display pixels 62 within a range ΔRW (FIG. 24) narrower than the variable range ΔRM of the meter display pixels 62. Therefore, the gradation ratio of the warning display pixels 72 at a time of the occurrence of an anomaly in each mode is adjusted to within the range ΔRW in which the identical value RWmax is its upper-limit ratio. This makes it possible to appropriately vary the lightness of the warning image 70 to the occupant's desired levels of lightness ΔBWh and ΔBW (FIG. 25) including the maximum levels of lightness under the respective levels of light source brightness Lmax and Lmid.

Figure 26:
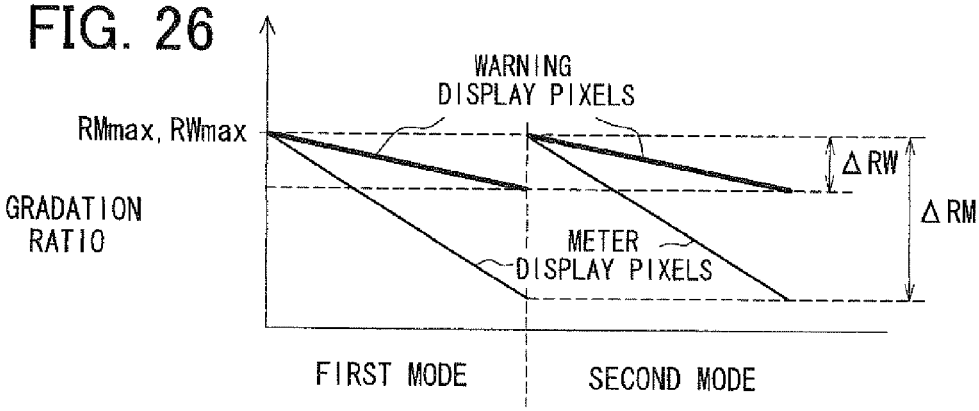
FIG. 26 is a schematic diagram illustrating the correlation characteristic of the gradation ratios of pixels in the fifth example embodiment.

In the fifth example embodiment, as mentioned above, the following processing is achieved astride the first mode and the second mode as illustrated in FIG. 26: the gradation ratio of the warning display pixels 72 at a time of the occurrence of an anomaly is varied according to the inputted adjustment value so that it becomes higher than the gradation ratio of the meter display pixels 62 varied according to the inputted adjustment value.

Figure 27:
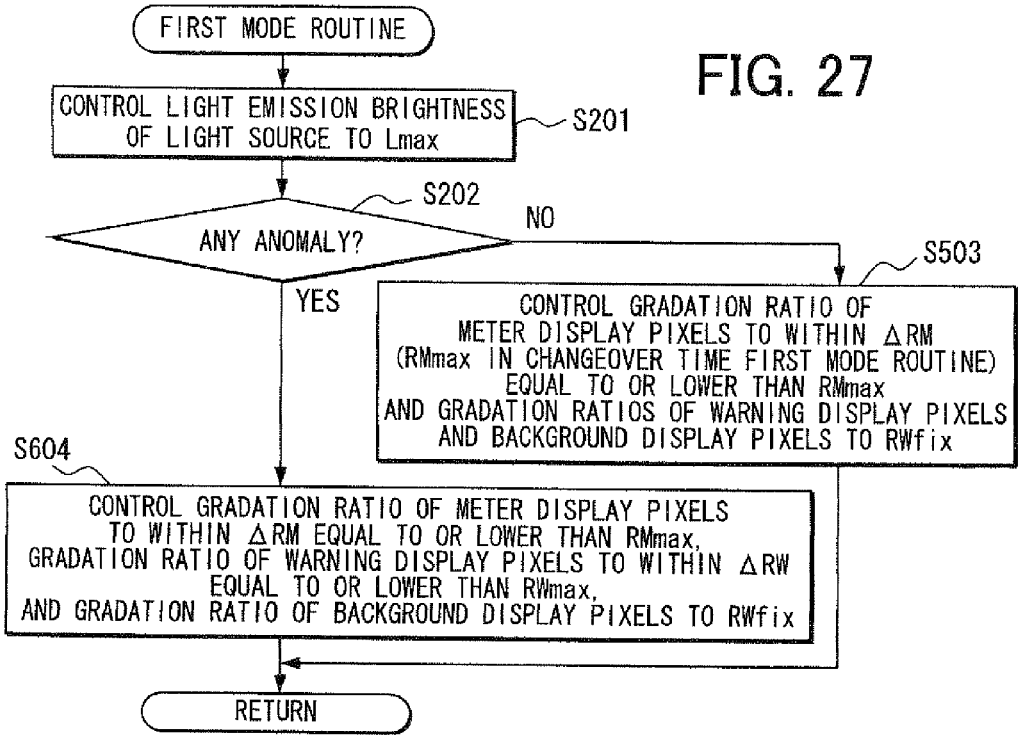
FIG. 27 is a flowchart illustrating a first mode routine in the fifth example embodiment.
Figure 28:
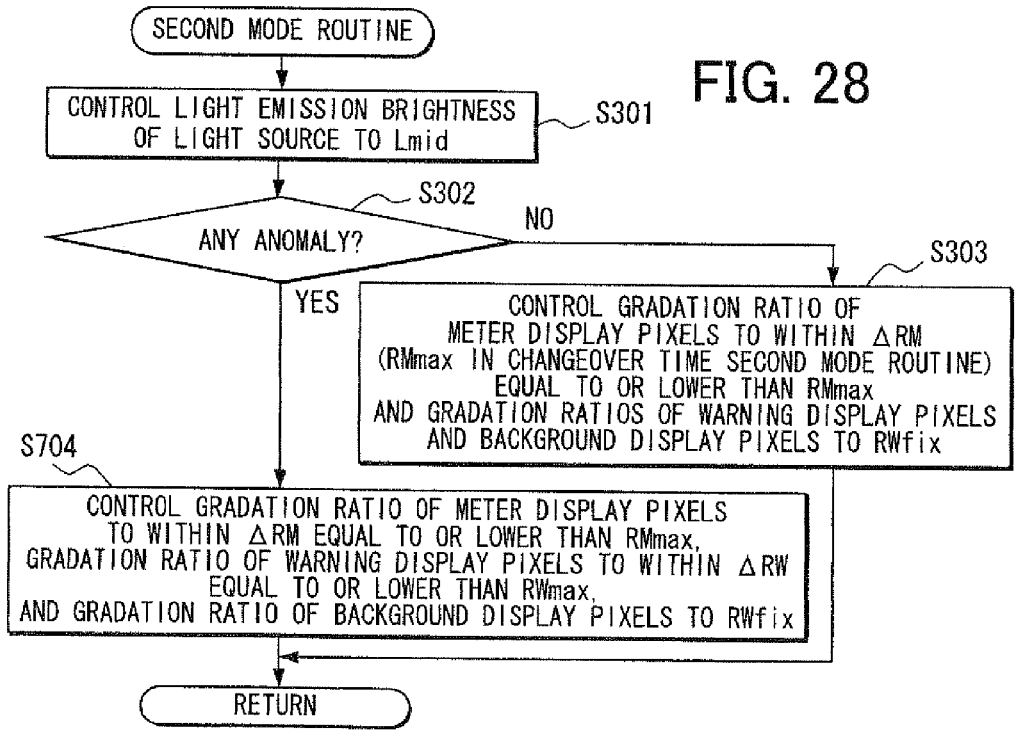
FIG. 28 is a flowchart illustrating a second mode routine in the fifth example embodiment.

In the control flow of the first mode routine and the second mode routine in the above-mentioned fifth example embodiment, the following processing is respectively carried out as illustrated in FIGS. 27 and 28: the gradation ratio of the warning display pixels 72 at a time of the occurrence of an anomaly is controlled to within the range ΔRW equal to or lower than the maximum ratio RWmax. This control is carried out by the processing of Steps S604 and S704 substituted for the processing of Steps S504 and S304 in the third example embodiment according to the inputted adjustment value.

According to the fifth example embodiment, described up to this point, the following can be implemented regardless of the light emission brightness of the light source 40: the lightness of the warning image 70 relative to that of the meter image 60 can be enhanced to the occupant's taste, and the purpose of a display of the warning image 70 can be achieved.

Sixth Example Embodiment

Figure 29:
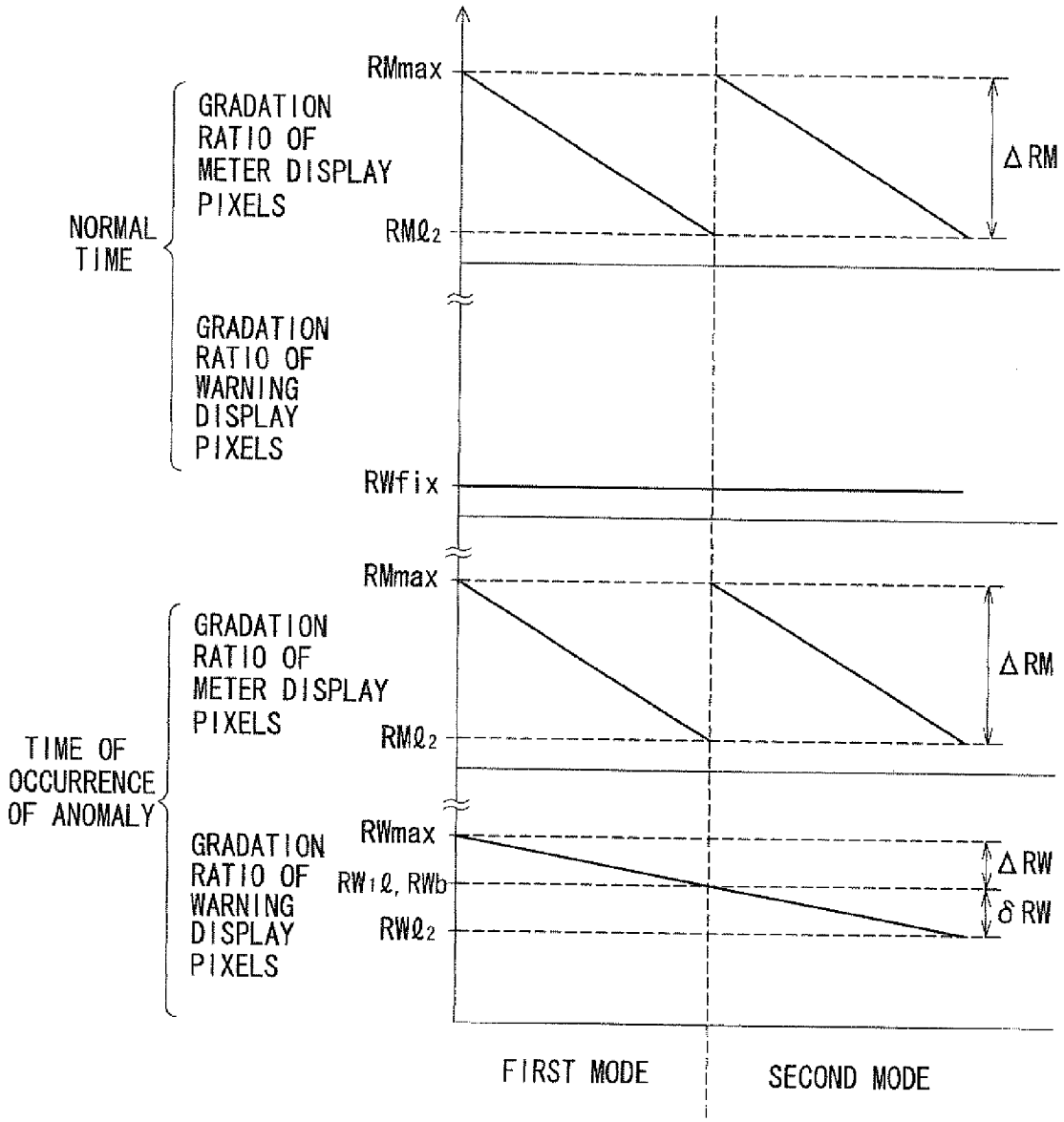
FIG. 29 is a schematic diagram illustrating the gradation ratios of pixels in a sixth example embodiment.
Figure 30:
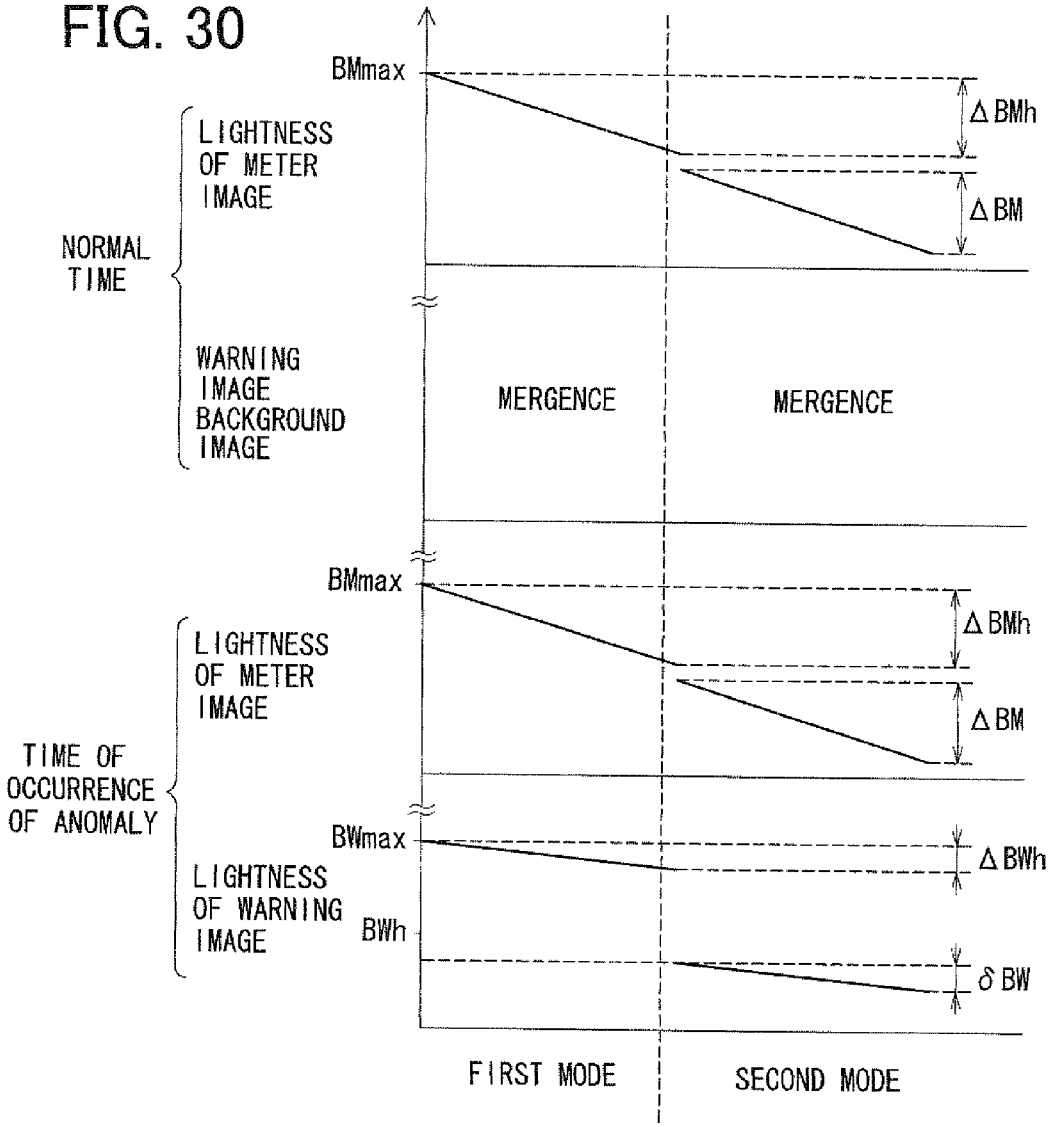
FIG. 30 is a schematic diagram illustrating the state of an image display in the sixth example embodiment.

As illustrated in FIGS. 29 and 30, a sixth example embodiment is a modification to the fifth embodiment in the displaying operation of the display device 1 for a vehicle. Hereafter, description will be given with a focus on a difference from the fifth embodiment, and the description of the portions of the sixth embodiment which is substantially the same as that of the fifth example embodiment has been omitted.

A more specific description will now be given. At a time of the occurrence of an anomaly in the second mode, the control circuit 50 carries out the following processing according to the inputted adjustment value: it variably controls the gradation ratio of the warning display pixels 72 within a range δRW (FIG. 29) equal to or lower than a reference ratio RWb lower than the maximum ratio RWmax; and it thereby controls the lightness of the warning image 70 to the occupant's desired lightness δBW (FIG. 30). The width of the range δRW is made identical with or different from that of the variable range ΔRW of the warning display pixels 72 at a time of the occurrence of an anomaly in the first mode. The reference ratio RWb equivalent to the upper-limit ratio in the range δRW is made identical with the minimum ratio $RWI_1$ in the variable range ΔRW. In this example embodiment, further, the minimum ratio $RWI_2$ in the range δRW is made higher than the minimum ratio $RMI_2$ in the variable range ΔRM of the meter display pixels 62 in the second mode.

Figure 31:
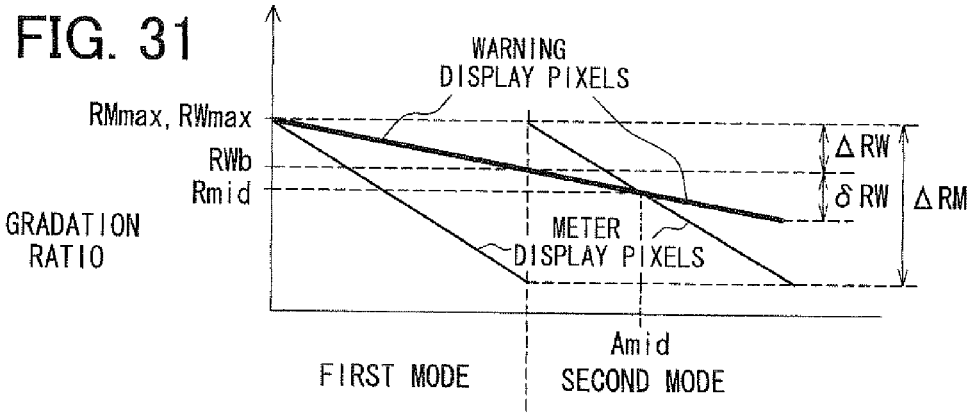
FIG. 31 is a schematic diagram illustrating the correlation characteristic of the gradation ratios of pixels in the sixth example embodiment.

In the second mode in the above-mentioned sixth example embodiment, the values of RMmax and RWmax are equal to each other, and thus the following takes place as illustrated in FIG. 31: the inequality relation between the gradation ratio of the meter display pixels 62 and the gradation ratio of the warning display pixels 72 is inverted at the intermediate value Amid of the inputted adjustment value.

That is, when the inputted adjustment value is increased and becomes higher than the intermediate value Amid, the following takes place: the gradation ratios of the pixels 62, 72 are linearly reduced from the common set intermediate ratio Rmid within the ranges ΔRM and δRW in response to this increasing change. As a result, the processing of varying the gradation ratio of the warning display pixels 72 at a time of the occurrence of an anomaly according to the inputted adjustment value so that the following is implemented is achieved: the gradation ratio of the warning display pixels is made higher than the gradation ratio of the meter display pixels 62 corresponding to the inputted adjustment value.

Meanwhile, when the inputted adjustment value is reduced and becomes lower than the intermediate value Amid, the following takes place: the gradation ratios of the pixels 62, 72 are linearly increased from the common set intermediate ratio Rmid in response to this reducing change. As a result, the processing of varying the gradation ratio of the warning display pixels 72 at a time of the occurrence of an anomaly according to the inputted adjustment value so that the following is implemented is achieved: the gradation ratio of the warning display pixels is made lower than the gradation ratio of the meter display pixels 62 corresponding to the inputted adjustment value.

Figure 32:
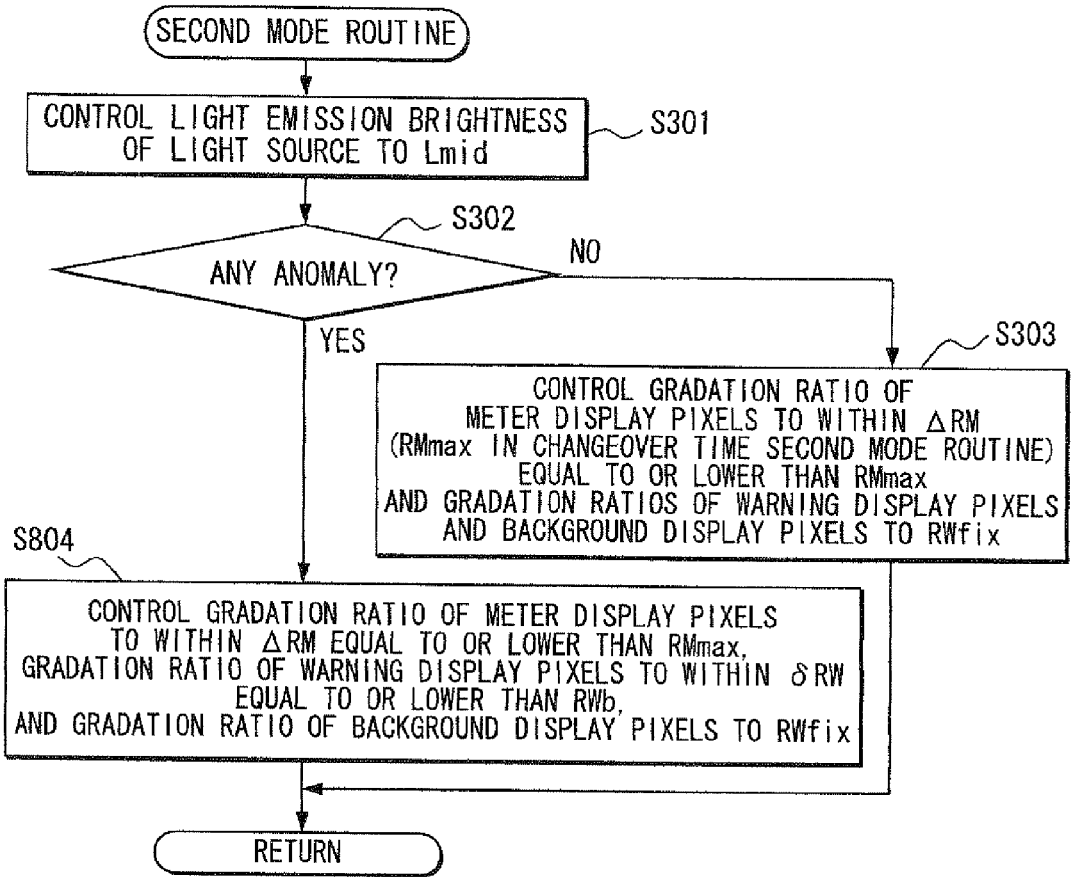
FIG. 32 is a flowchart illustrating a second mode routine in the sixth example embodiment.

In the control flow of the second mode routine in the above-mentioned sixth example embodiment, the following processing is carried out as illustrated in FIG. 32: the gradation ratio of the warning display pixels 72 at a time of the occurrence of an anomaly is controlled to within the range δRW equal to or lower than the reference ratio RWb. This is done by the processing of Step S804 substituted for the processing of Step S704 in the fifth example embodiment.

In the second mode in the sixth example embodiment described up to this point, either of the following processing can be selected by input from the occupant: the processing of maintaining the relation in which the gradation ratio of the warning display pixels 72 is higher than that of the meter display pixels 62 and variably controlling the gradation ratios of these pixels; and the processing of maintaining the relation in which the gradation ratio of the warning display pixels 72 is lower than that of the meter display pixels 62 and variably controlling the gradation ratios of these pixels. In the second mode in which the light emission brightness of the light source 40 is low, therefore, both of the following cases can be coped with in a timely manner: cases where the lightness of the warning image 70 is ensured and the relative lightness of the meter image 60 is reduced; and cases where the lightness of the meter image 60 is ensured and the relative lightness of the warning image 70 is reduced.

Seventh Example Embodiment

Figure 33:
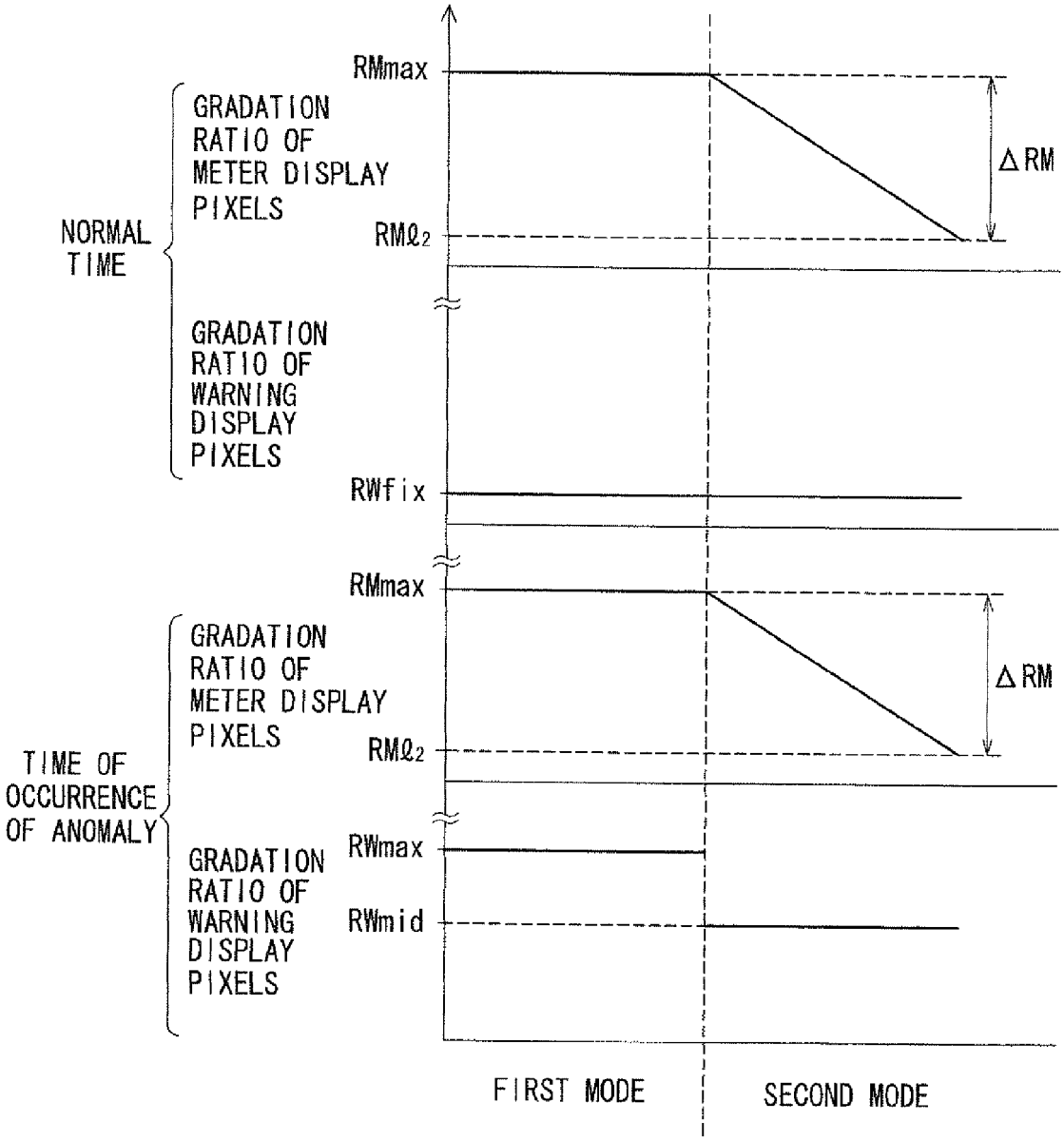
FIG. 33 is a schematic diagram illustrating the gradation ratios of pixels in a seventh example embodiment.
Figure 34:
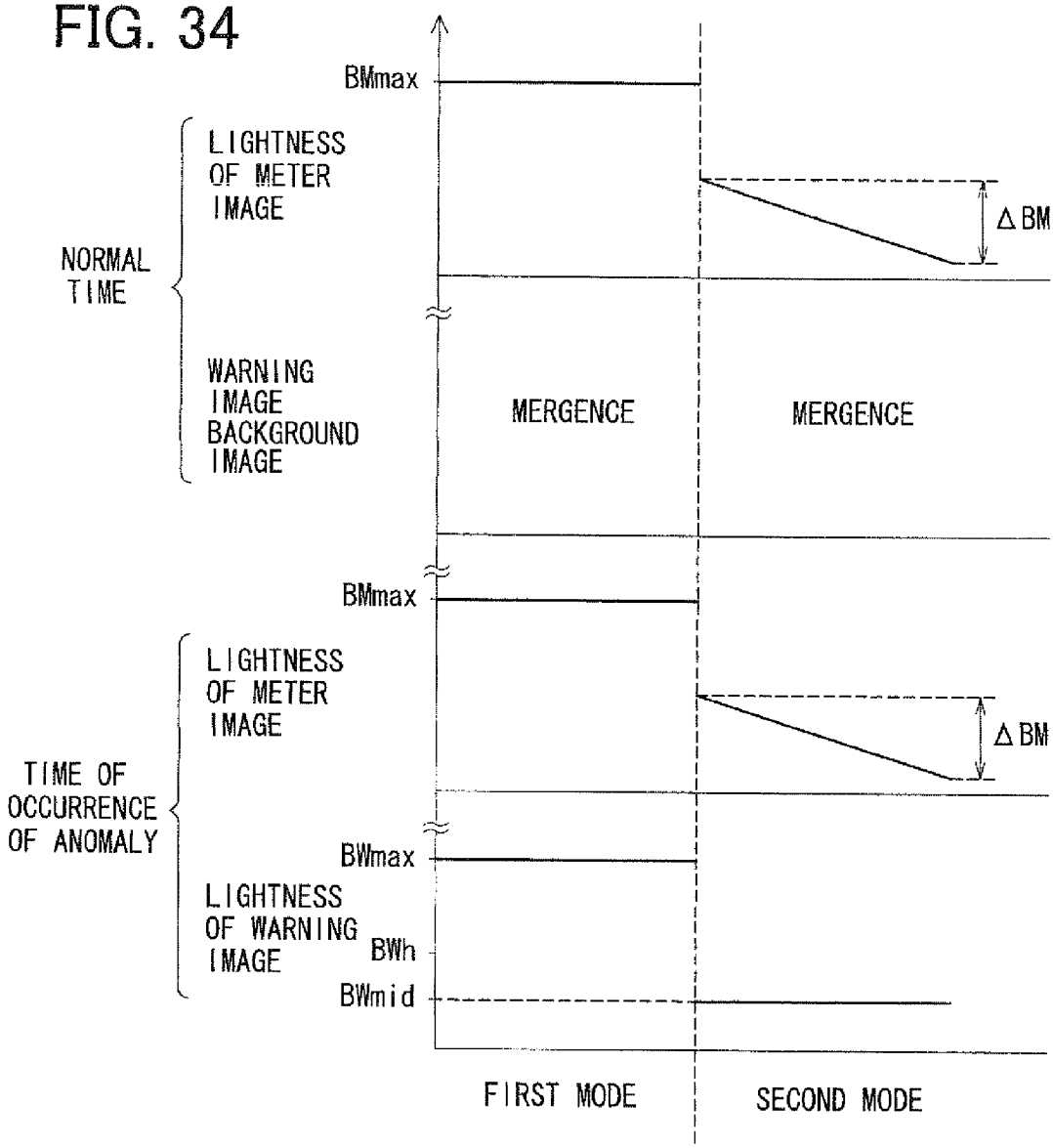
FIG. 34 is a schematic diagram illustrating the state of an image display in the seventh example embodiment.

As illustrated in FIGS. 33 and 34, a seventh example embodiment of the invention is a modification to the first example embodiment in the displaying operation of the display device 1 for a vehicle. Hereafter, description will be given with a focus on a difference from the first example embodiment, and the description of the portions of the seventh embodiment which is substantially the same as that of the first example embodiment has been omitted.

A more specific description will now be given. In the second mode, the control circuit 50 keeps the gradation ratio of the warning display pixels 72 at a time of the occurrence of an anomaly at an intermediate ratio RWmid (FIG. 33) lower than the maximum ratio RWmax in the first mode. It thereby displays the warning image 70 with a level of lightness BWmid (FIG. 34) reduced more than in the first example embodiment. This intermediate ratio RWmid is set to a value higher than the minimum ratio $RMI_2$ (FIG. 33) in the variable range ΔRM of the meter display pixels 62 in the second mode. Thus, the lightness BWmid of the warning image 70 is reduced to the extent that its property of giving a warning about an anomaly in the vehicle is not impaired.

Figure 35:
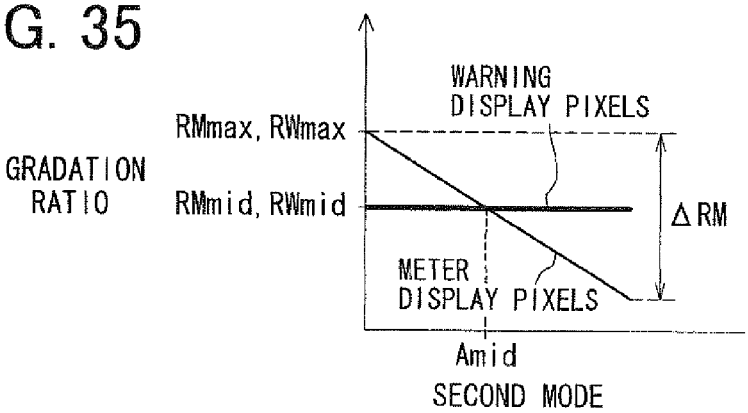
FIG. 35 is a schematic diagram illustrating the correlation characteristic of the gradation ratios of pixels in the seventh example embodiment.

In the second mode of the above-mentioned seventh example embodiment, the values of RMmax and RWmax are equal to each other, and thus the following takes place as illustrated in FIG. 35: the inequality relation between the gradation ratio of the meter display pixels 62 and the gradation ratio of the warning display pixels 72 is inverted at the intermediate value Amid of the inputted adjustment value.

That is, when the inputted adjustment value is increased and becomes higher than the intermediate value Amid, the following takes place: the gradation ratio of the meter display pixels 62 is linearly reduced from the set intermediate ratio RMmid equal to the gradation ratio RWmid of the warning display pixels 72 in response to this increasing change. As a result, the processing of holding the gradation ratio of the warning display pixels 72 at a time of the occurrence of an anomaly so that the following is implemented is achieved: the gradation ratio of the warning display pixels is made higher than the gradation ratio of the meter display pixels 62 corresponding to the inputted adjustment value.

Meanwhile, when the inputted adjustment value is reduced and becomes lower than the intermediate value Amid, the following takes place: the gradation ratio of the meter display pixels 62 is linearly increased from the set intermediate ratio RMmid in response to this reducing change. As a result, the processing of holding the gradation ratio of the warning display pixels 72 at a time of the occurrence of an anomaly so that the following is implemented is achieved: the gradation ratio of the warning display pixels is made lower than the gradation ratio of the meter display pixels 62 corresponding to the inputted adjustment value.

In the control flow of the second mode routine in the above-mentioned seventh example embodiment, the following processing is carried out: at Step S304 in the first example embodiment illustrated in FIG. 13, the gradation ratio of the warning display pixels 72 at a time of the occurrence of an anomaly is controlled to the constant intermediate ratio RWmid in place of the maximum ratio RWmax.

In the second mode in the seventh example embodiment described up to this point, either of the following processing can be selected by input from the occupant: the processing of reducing the gradation ratio of the meter display pixels 62 to a value lower than the gradation ratio of the warning display pixels 72; and the processing of increasing the gradation ratio of the meter display pixels 62 to a value higher than the gradation ratio of the warning display pixels 72. In the second mode in which the light emission brightness of the light source 40 is low, therefore, both of the following cases can be coped with in a timely manner: cases where the lightness of the meter image 60 is reduced to ensure its visibility; and cases where the meter image 60 is lightly displayed to the occupant's taste.

Eighth Example Embodiment

Figure 36:
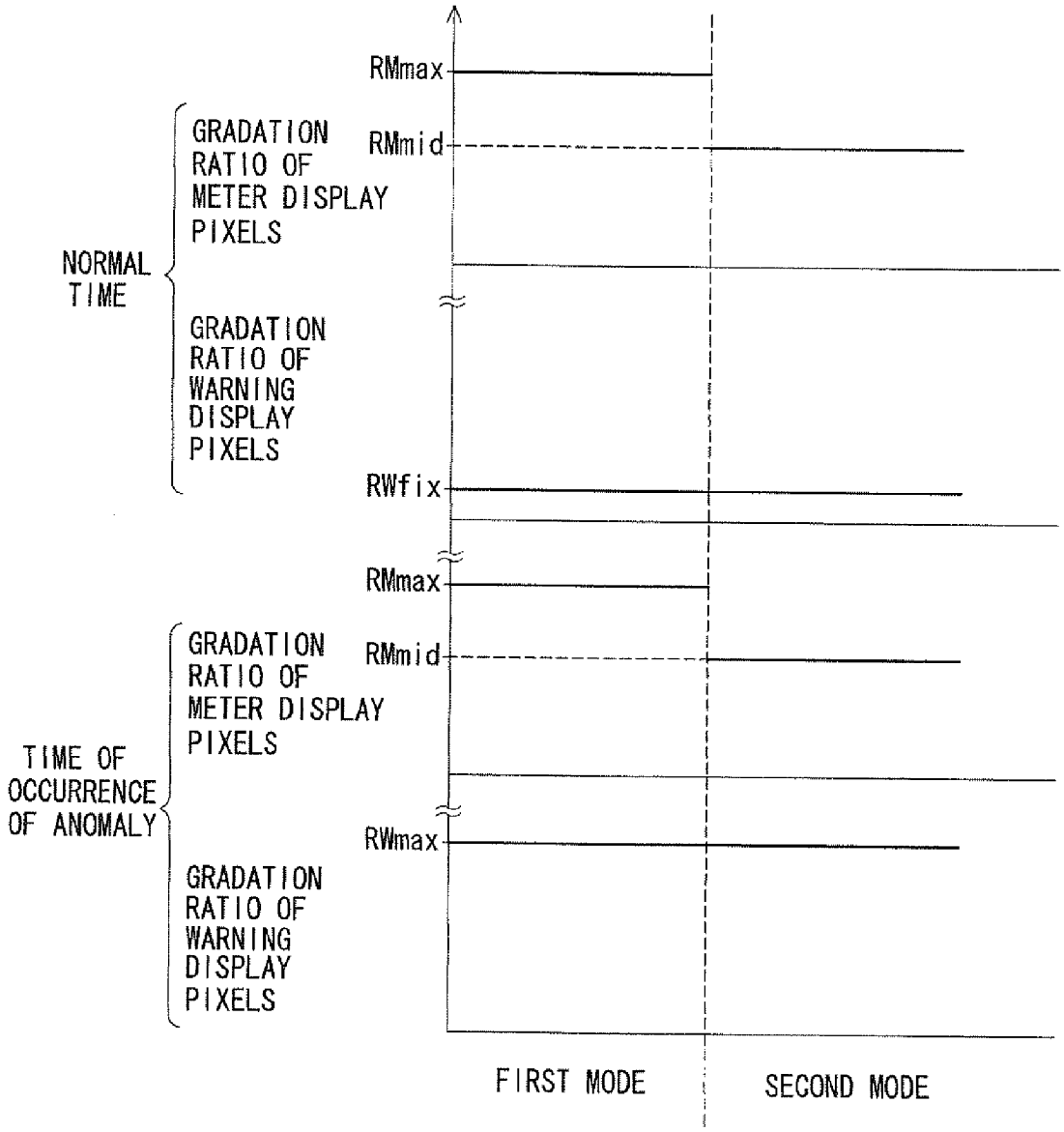
FIG. 36 is a schematic diagram illustrating the gradation ratios of pixels in an eighth example embodiment.
Figure 37:
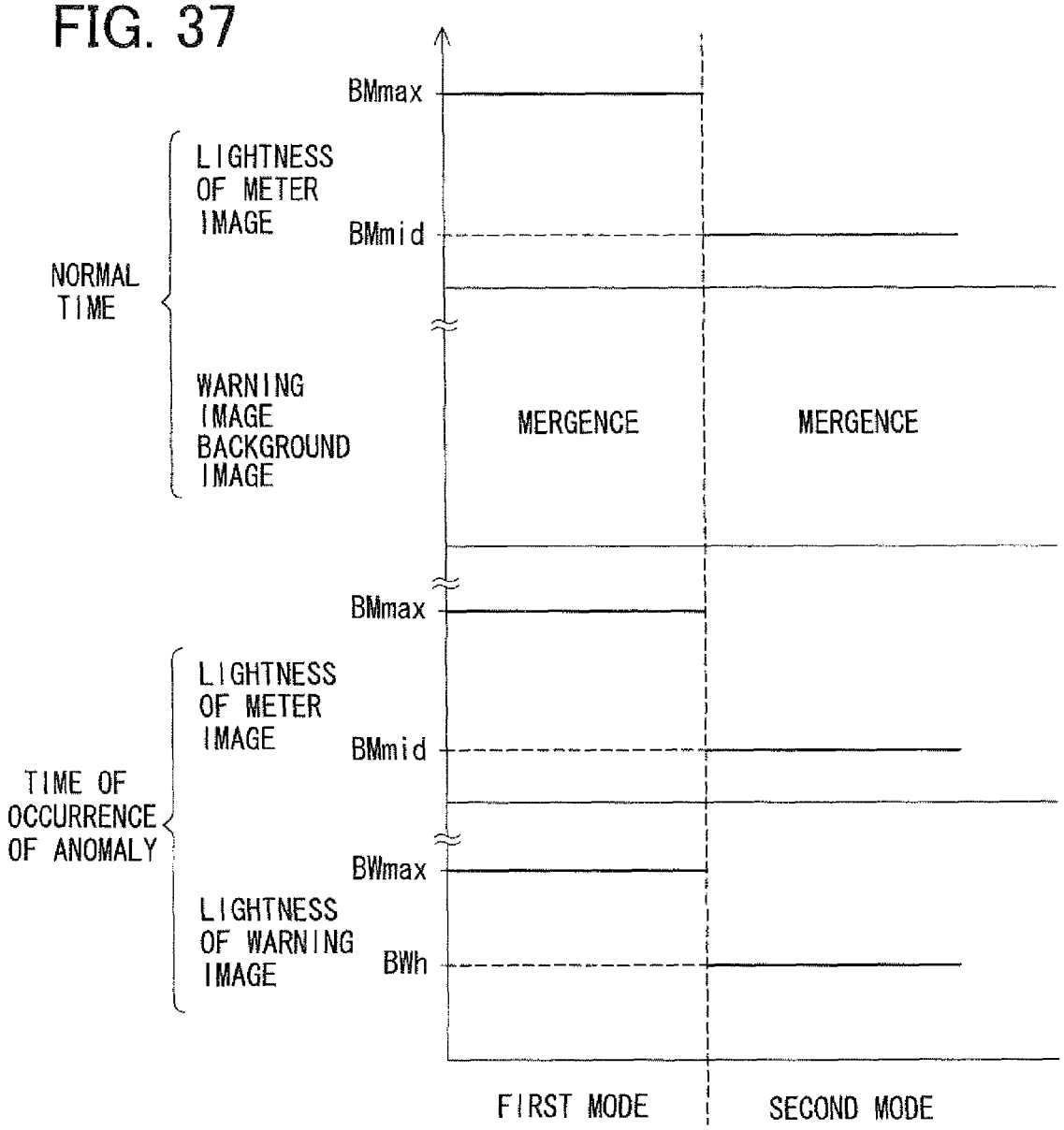
FIG. 37 is a schematic diagram illustrating the state of an image display in the eighth example embodiment.

As illustrated in FIGS. 36 and 37, an eighth example embodiment is a modification to the first example embodiment in the displaying operation of the display device 1 for a vehicle. Hereafter, description will be given with a focus on a difference from the first example embodiment, and the description of the portions of the eighth embodiment which is substantially the same as that of the first embodiment has been omitted.

A more specific description will now be given. At a time of changeover from the first mode to the second mode, the control circuit 50 reduces the gradation ratio of the meter display pixels 62 from the maximum ratio RMmax to an intermediate ratio RMmid (FIG. 36) as in the above-mentioned second example embodiment. It thereby dramatically varies the lightness of the meter image 60.

Figure 38:
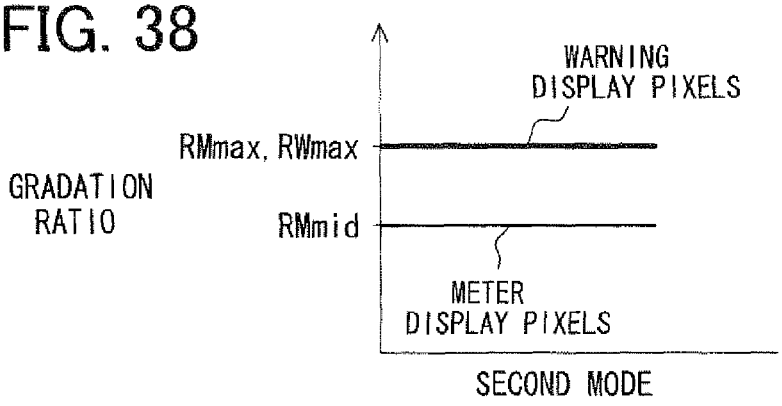
FIG. 38 is a schematic diagram illustrating the correlation characteristic of the gradation ratios of pixels in the eighth example embodiment.

Meanwhile, at a normal time and at a time of the occurrence of an anomaly in the second mode after mode change, the control circuit 50 carries out the following processing: it keeps the gradation ratio of the meter display pixels 62 at the intermediate ratio RMmid (FIG. 36), and thereby displays the meter image 60 with a level of lightness BMmid (FIG. 37) lower than in the first mode. Thus, in this example embodiment in which the value of RMmid is smaller than the value of RWmax, as illustrated in FIG. 38, the following is implemented while in the second mode: the processing of keeping the gradation ratio of the warning display pixels 72 at a time of the occurrence of an anomaly higher than the gradation ratio of the meter display pixels 62 is achieved.

Figure 39:
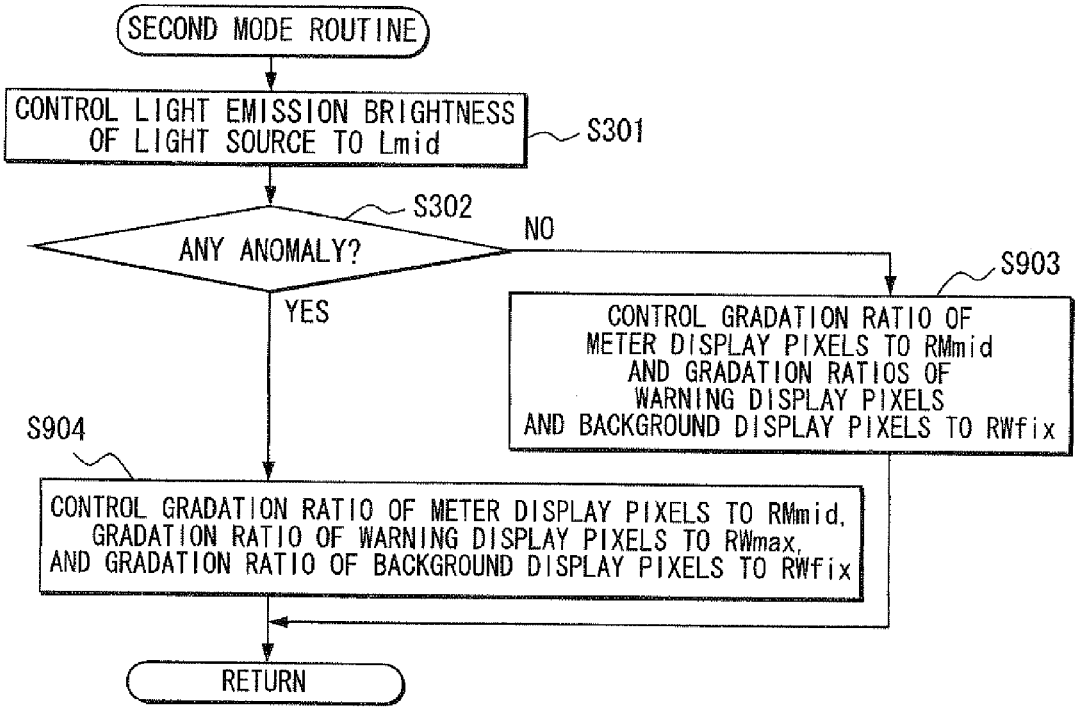
FIG. 39 is a flowchart illustrating a second mode routine in the eighth example embodiment.

In the control flow of the second mode routine in the eighth example embodiment mentioned above, the following processing is carried out regardless of the inputted adjustment value: the gradation ratio of the meter display pixels 62 at a normal time and at a time of the occurrence of an anomaly is controlled to the intermediate ratio RMmid as illustrated in FIG. 39. This is done by the processing of Steps S903 and S904 substituted for the processing of Steps S303 and S304 in the first example embodiment. In this example embodiment, the gradation ratio of the meter display pixels 62 is also controlled to the intermediate ratio RMmid at Step S903 of the changeover time second mode routine.

According to the eighth example embodiment described up to this point, the following can be implemented even in the second mode in which the light emission brightness of the light source 40 is low: the lightness of the warning image 70 relative to that of the meter image 60 can be constantly increased to achieve the purpose of a display of the warning image 70.

Ninth Example Embodiment

Figure 40:
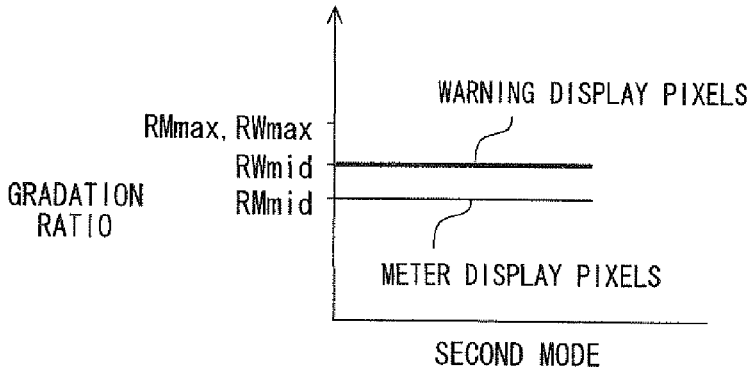
FIG. 40 is a schematic diagram illustrating the correlation characteristic of the gradation ratios of pixels in a ninth example embodiment.

As illustrated in FIG. 40, a ninth example embodiment is a modification to the eighth example embodiment in the displaying operation of the display device 1 for a vehicle. Hereafter, description will be given with a focus on a difference from the eighth example embodiment, and the description of the portions of the ninth embodiment which is substantially the same as that of the eighth example embodiment has been omitted.

A more specific description will now be given. In the second mode, the control circuit 50 keeps the gradation ratio of the warning display pixels 72 at a time of the occurrence of an anomaly at an intermediate ratio RWmid (FIG. 40) as in the above-mentioned seventh example embodiment. In this example embodiment, this kept ratio RWmid is set to a value higher than the gradation ratio RMmid of the meter display pixels 62. Thus, the following is implemented while in the second mode: the processing of keeping the gradation ratio of the warning display pixels 72 at a time of the occurrence of an anomaly higher than the gradation ratio of the meter display pixels 62 is achieved. In the control flow of the second mode routine in the above-mentioned ninth example embodiment, the following processing is carried out at Step S904 in the eighth example embodiment illustrated in FIG. 39: the gradation ratio of the warning display pixels 72 at a time of the occurrence of an anomaly is controlled to the intermediate ratio RWmid in place of the maximum ratio RWmax.

Also according to the above-mentioned ninth example embodiment, the following can be implemented in the second mode in which the light emission brightness of the light source 40 is low: the lightness of the warning image 70 relative to that of the meter image 60 can be constantly increased to achieve the purpose of a display of the warning image 70.

10th Example Embodiment

Figure 41:
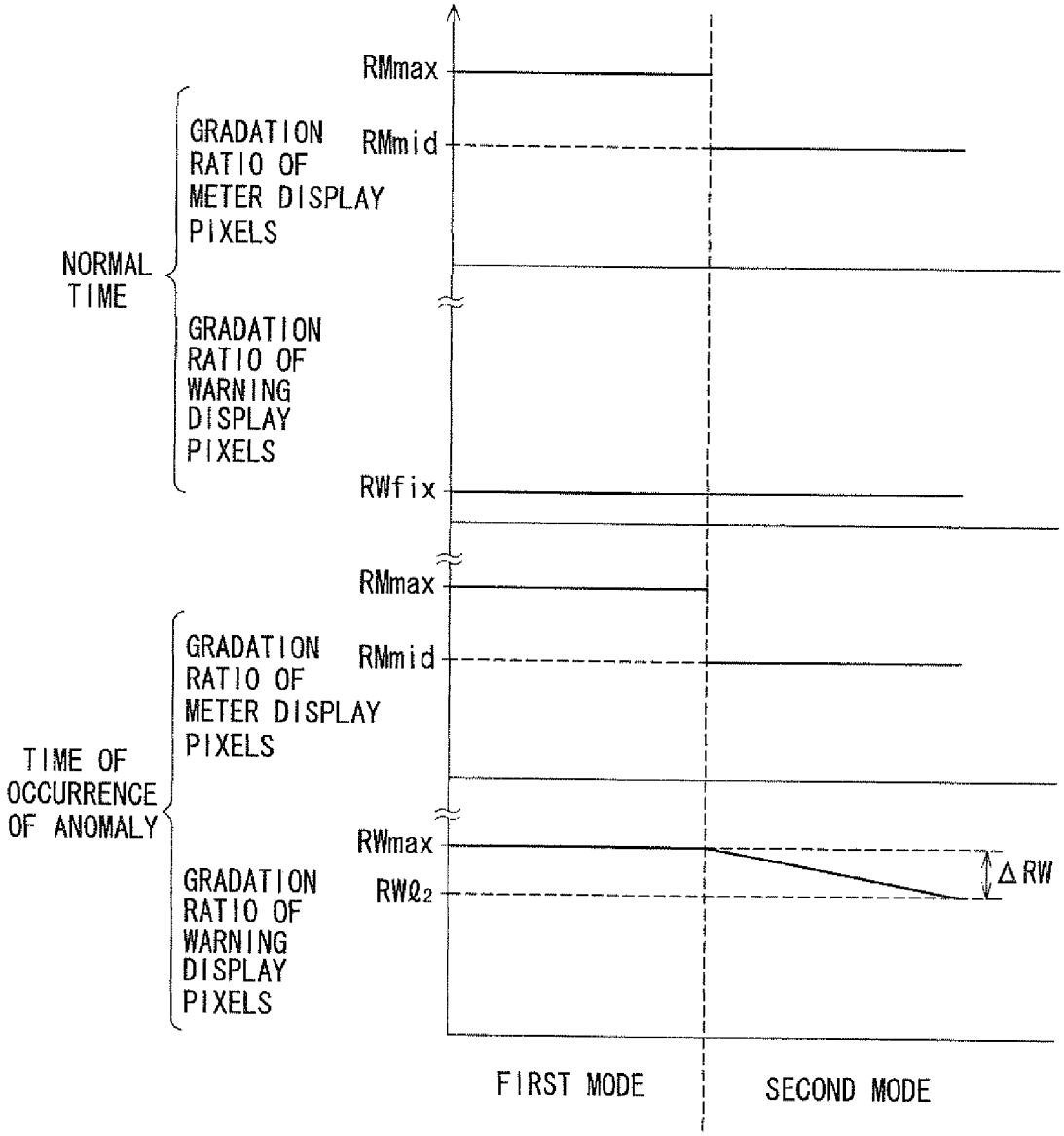
FIG. 41 is a schematic diagram illustrating the gradation ratios of pixels in a 10th example embodiment.

As illustrated in FIG. 41, a 10th example embodiment is a modification to the eighth example embodiment in the displaying operation of the display device 1 for a vehicle. Hereafter, description will be given with a focus on a difference from the eighth example embodiment, and the description of the portions of the 10th embodiment which is substantially the same as that of the eighth example embodiment has been omitted.

Figure 42:
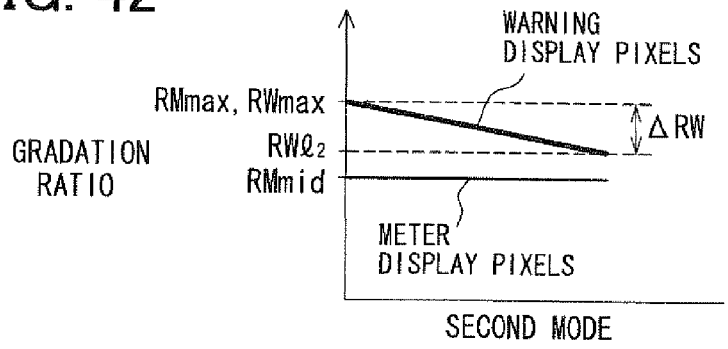
FIG. 42 is a schematic diagram illustrating the correlation characteristic of the gradation ratios of pixels in the 10th example embodiment.

A more specific description will now be given. With respect to the gradation ratio of the warning display pixels 72, the control circuit 50 carries out the above-mentioned variable control as in the fifth example embodiment only at a time of the occurrence of an anomaly in the second mode. That is, it variably controls the gradation ratio of the warning display pixels 72 so that the following is implemented in response to increasing change in inputted adjustment value: the gradation ratio of the warning display pixels is linearly reduced within a range ΔRW (FIG. 41) equal to or lower than the maximum ratio RWmax identical with its gradation ratio at a time of the occurrence of an anomaly in the first mode. In this example embodiment, however, the minimum ratio $RWI_2$ in the range ΔRW is set to a value higher than the gradation ratio RMmid of the meter display pixels 62 in the second mode. Thus, the following is implemented in the second mode as illustrated in FIG. 42: the processing of varying the gradation ratio of the warning display pixels 72 at a time of the occurrence of an anomaly according to the inputted adjustment value so that it is constantly higher than the gradation ratio of the meter display pixels 62 is achieved.

Figure 43:
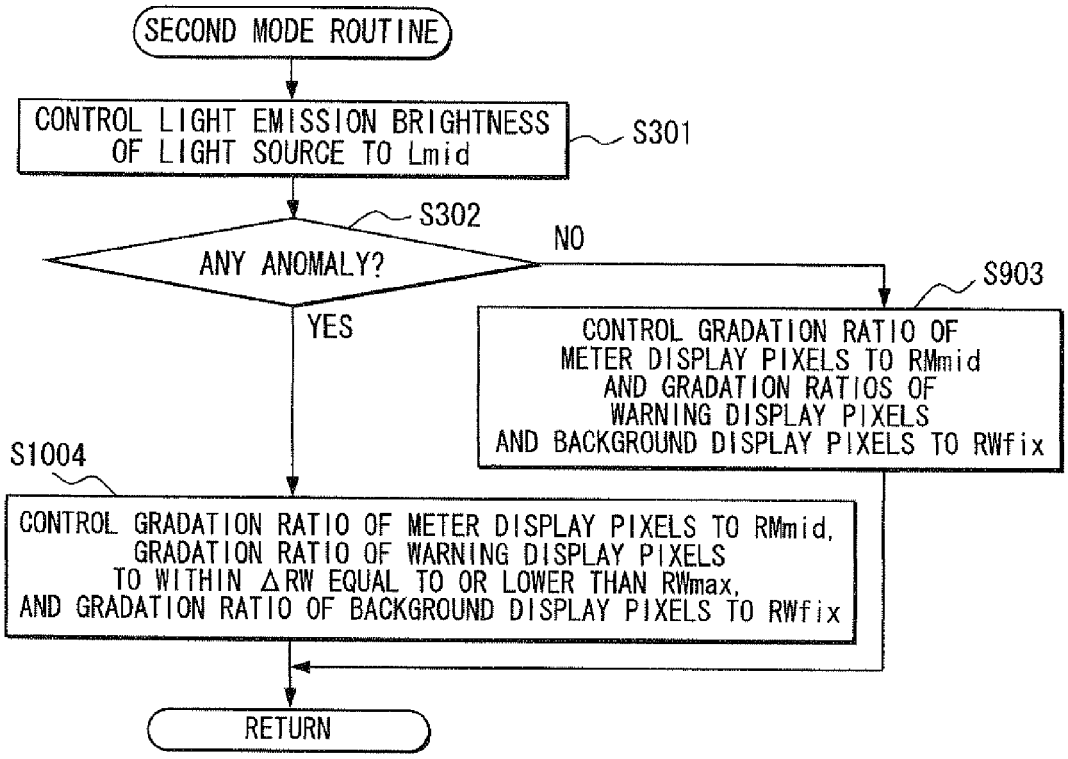
FIG. 43 is a flowchart illustrating a second mode routine in the 10th example embodiment.

In the control flow of the second mode routine in the above-mentioned 10th example embodiment, the following is implemented as illustrated in FIG. 43: the gradation ratio of the warning display pixels 72 at a time of the occurrence of an anomaly is controlled to within the range ΔRW equal to or lower than the maximum ratio RWmax. This is done by the processing of Step S1004 substituted for Step S904 in the eighth example embodiment.

In the 10th example embodiment described up to this point, the following measure may be taken with respect to the variable range of the gradation ratio of the warning display pixels 72 at a time of the occurrence of an anomaly in the second mode: the maximum ratio may be set to a value lower than RWmax as long as the minimum ratio is higher than the gradation ratio RMmid of the meter display pixels 62 in the second mode. (This processing is equivalent to Step S1004 of the second mode routine.).

According to the 10th example embodiment described up to this point, the following can be implemented even in the second mode in which the light emission brightness of the light source 40 is low: the lightness of the meter image 60 can be reduced without fail, and further such a level of lightness of the warning image 70 that the occupant's taste is satisfied and the purpose of its display is achieved can be ensured.

11th Example Embodiment

Figure 44:
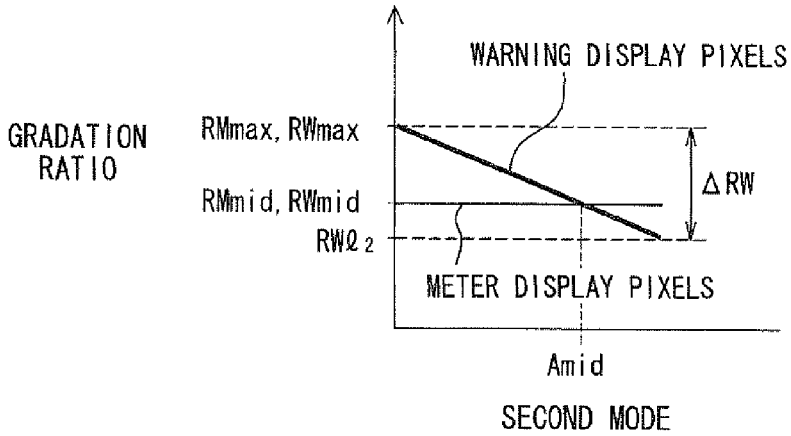
FIG. 44 is a schematic diagram illustrating the correlation characteristic of the gradation ratios of pixels in an 11th example embodiment.

As illustrated in FIG. 44, an 11th example embodiment of the invention is a modification to the 10th example embodiment in the displaying operation of the display device 1 for a vehicle. Hereafter, description will be given with a focus on a difference from the 10th example embodiment, and the description of the portions of the 11th embodiment which is substantially the same as that of the 10th example embodiment has been omitted.

A more specific description will now be given. The control circuit 50 carries out the following processing at a time of the occurrence of an anomaly in the second mode with respect to the variable range ΔRW (FIG. 44) of the warning display pixels 72, equal to or lower than the maximum ratio RWmax: the control circuit sets the minimum ratio $RWI_2$ in the variable range to a value lower than the gradation ratio RMmid of the meter display pixels 62 in the second mode. Therefore, in the second mode in the 11th example embodiment in which the value of RMmid is smaller than the value of RWmax, as illustrated in FIG. 44, the following takes place: the inequality relation between the gradation ratio of the meter display pixels 62 and the gradation ratio of the warning display pixels 72 is inverted at the intermediate value Amid of the inputted adjustment value.

That is, when the inputted adjustment value is reduced and becomes lower than the intermediate value Amid, the following takes place: the gradation ratio of the warning display pixels 72 is linearly increased from the set intermediate ratio RWmid equal to the gradation ratio RMmid of the meter display pixels 62 in response to this reducing change. As a result, the processing of varying the gradation ratio of the warning display pixels 72 at a time of the occurrence of an anomaly so that the following is implemented according to the inputted adjustment value is achieved: the gradation ratio of the warning display pixels is higher than the gradation ratio of the meter display pixels 62.

Meanwhile, when the inputted adjustment value is increased and becomes higher than the intermediate value Amid, the following takes place: the gradation ratio of the warning display pixels 72 is linearly reduced from the set intermediate ratio RWmid in response to this increasing change. As a result, the processing of varying the gradation ratio of the warning display pixels 72 at a time of the occurrence of an anomaly so that the following is implemented according to the inputted adjustment value is achieved: the gradation ratio of the warning display pixels at a time of the occurrence of an anomaly is lower than the gradation ratio of the meter display pixels 62.

The control flow of the second mode routine in the above-mentioned 11th example embodiment is identical with that in the 10th example embodiment illustrated in FIG. 43. In the 11th example embodiment, the following measure may be taken with respect to the variable range of the gradation ratio of the warning display pixels 72 at a time of the occurrence of an anomaly in the second mode: the variable range may be so set that it is lower than RWmax and higher than RMmid as long as the minimum ratio is lower than the gradation ratio RMmid of the meter display pixels 62 in the second mode. (This processing is equivalent to Step S1004 of the second mode routine.)

In the second mode in the 11th example embodiment described up to this point, either of the following processing can be selected by input from the occupant: the processing of increasing the gradation ratio of the warning display pixels 72 to a value higher than the gradation ratio of the meter display pixels 62; and the processing of reducing the gradation ratio of the warning display pixels 72 to a value lower than the gradation ratio of the meter display pixels 62. In the second mode in which the light emission brightness of the light source 40 is low, therefore, both of the following cases can be coped with in a timely manner: cases where the lightness of the warning image 70 is ensured to achieve the purpose of its display; and cases where the lightness of the warning image 70 is reduced to the occupant's taste.

12th Example Embodiment

Figure 45:
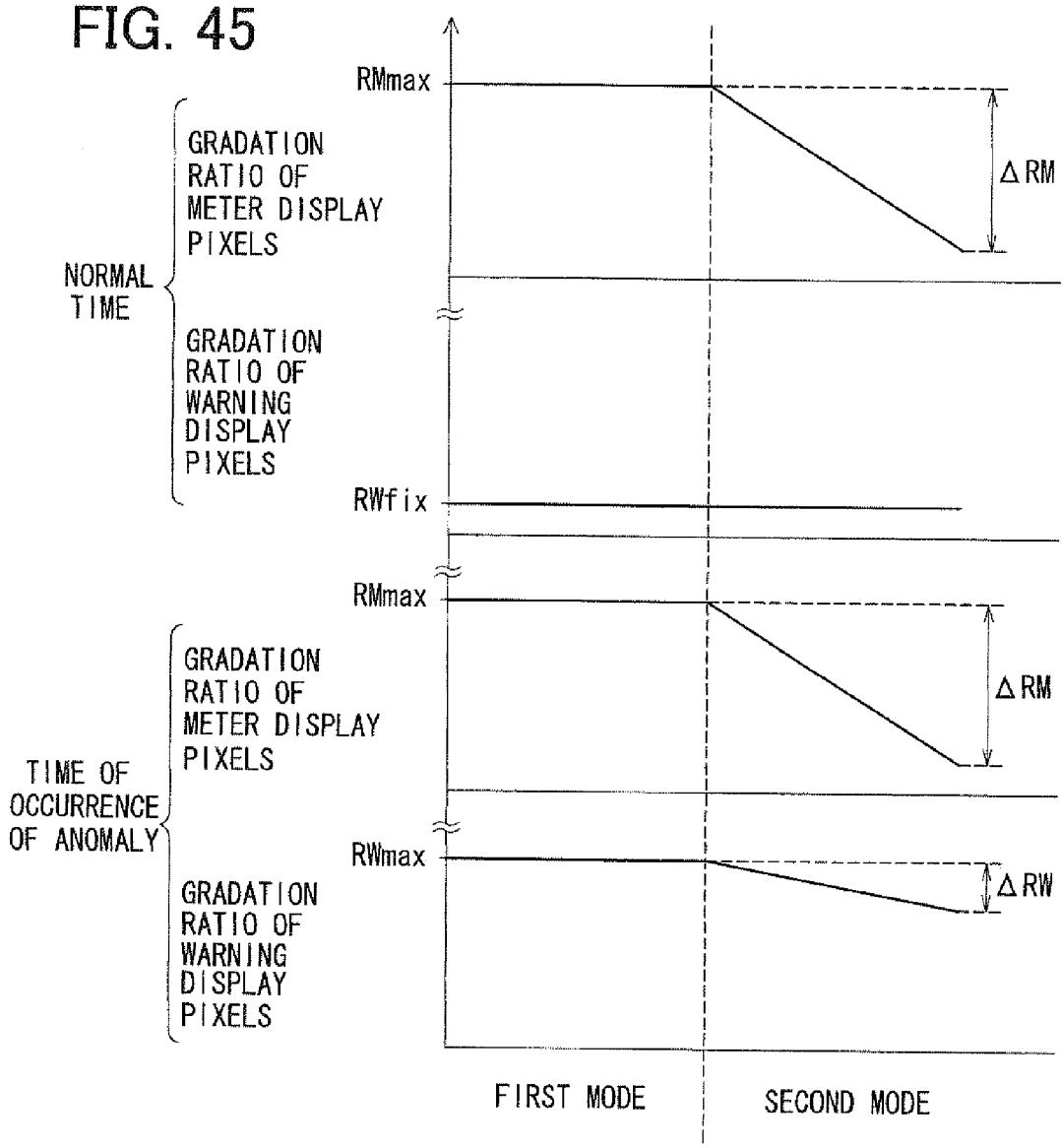
FIG. 45 is a schematic diagram illustrating the gradation ratios of pixels in a 12th example embodiment.

As illustrated in FIG. 45, a 12th example embodiment is a modification to the first example embodiment in the displaying operation of the display device 1 for a vehicle. Hereafter, description will be given with a focus on a difference from the first example embodiment, and the description of the portions of the 12th embodiment which is substantially the same as that of the first example embodiment has been omitted.

Figure 46:
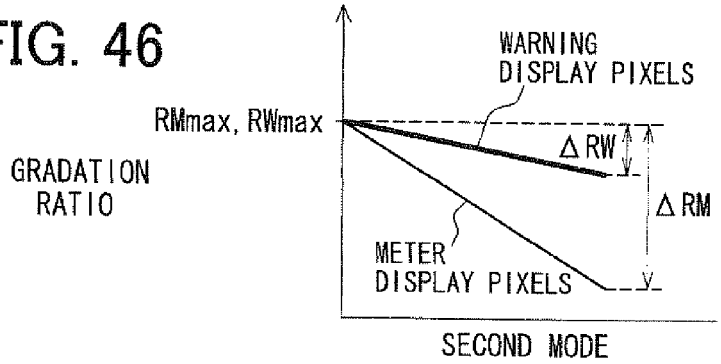
FIG. 46 is a schematic diagram illustrating the correlation characteristic of the gradation ratios of pixels in the 12th example embodiment.

A more specific description will now be given. With respect to the gradation ratio of the warning display pixels 72, the control circuit 50 carries out the variable control as in the above-mentioned fifth example embodiment only at a time of the occurrence of an anomaly in the second mode. That is, it variably controls the gradation ratio of the warning display pixels 72 so that the following is implemented in response to increasing change in inputted adjustment value: the gradation ratio of the warning display pixels is linearly reduced from the following upper-limit ratio within a range ΔRW (FIG. 45) narrower than the variable range ΔRM of the meter display pixels 62: the upper-limit ratio identical with the maximum gradation ratio RWmax of the warning display pixels 72 at a time of the occurrence of an anomaly in the first mode and the maximum gradation ratio RMmax of the meter display pixels 62. Thus, in the second mode, the processing of varying the gradation ratio of the warning display pixels 72 at a time of the occurrence of an anomaly so that the following is implemented according to the inputted adjustment value is achieved: the gradation ratio of the warning display pixels at a time of the occurrence of an anomaly is higher than the gradation ratio of the meter display pixels 62 varied according to the inputted adjustment value, as illustrated in FIG. 46.

The control flow of the second mode routine in the above-mentioned 12th example embodiment is identical with that of the second mode routine (FIG. 28) in the above-mentioned fifth example embodiment.

According to the 12th example embodiment described up to this point, the following can be implemented even in the second mode in which the light emission brightness of the light source 40 is low: the lightness of the warning image 70 relative to that of the meter image 60 can be increased to the occupant's taste to achieve the purpose of a display of the warning image 70.

13th Example Embodiment

Figure 47:
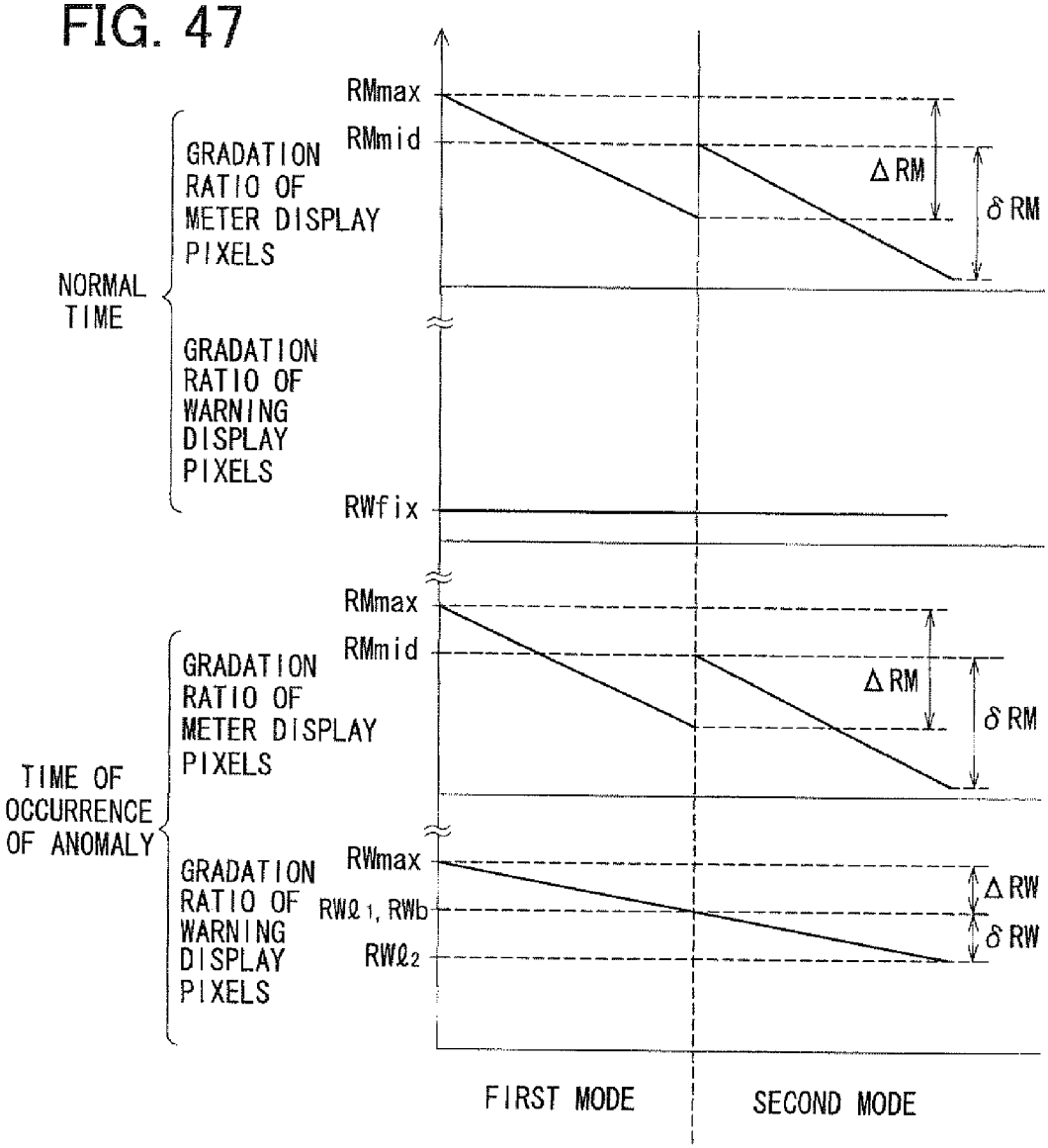
FIG. 47 is a schematic diagram illustrating the gradation ratios of pixels in a 13th example embodiment.

As illustrated in FIG. 47, a 13th example embodiment is a modification to the sixth example embodiment in the displaying operation of the display device 1 for a vehicle. Hereafter, description will be given with a focus on a difference from the sixth example embodiment, and the description of the portions of the 13th embodiment which is substantially the same as that of the sixth embodiment has been omitted.

A more specific description will now be given. At a time of changeover from the first mode to the second mode, the control circuit 50 carries out the following processing: it controls the gradation ratio of the meter display pixels 62 to an intermediate ratio RMmid (FIG. 47) lower than the maximum ratio RMmax as in the above-mentioned fourth example embodiment. In this example embodiment, however, the intermediate ratio RMmid is set to the following value: the value identical with the reference ratio RWb that is the upper-limit ratio in the range δRW within which the gradation ratio of the warning display pixels 72 is variably controlled at a time of the occurrence of an anomaly in the second mode.

Figure 48:
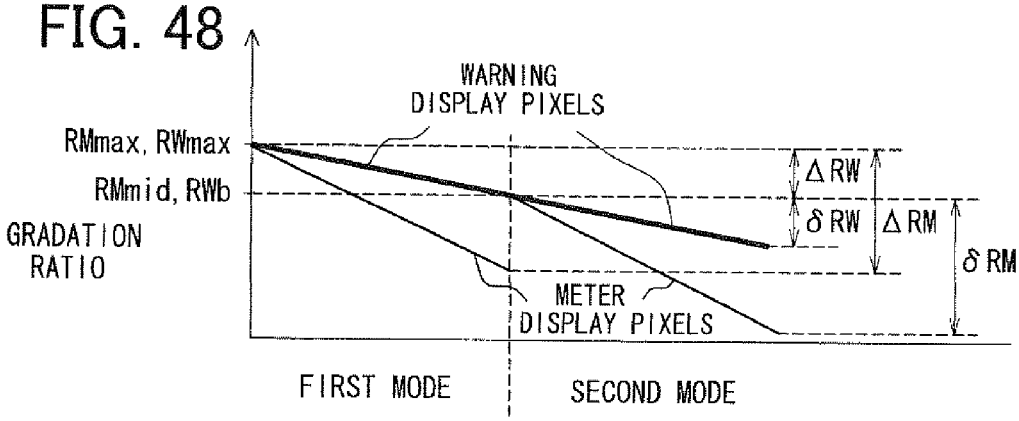
FIG. 48 is a schematic diagram illustrating the correlation characteristic of the gradation ratios of pixels in the 13th example embodiment.

Further, at a normal time and at a time of the occurrence of an anomaly in the second mode, the control circuit 50 carries out the following processing as in the above-mentioned fourth example embodiment: it variably controls the gradation ratio of the meter display pixels 62 within a range δRM (FIG. 47) in which the intermediate ratio RMmid is the upper-limit ratio and which is wider than the variable range ΔRM in the first mode. In this example embodiment in which the width of δRM is larger than that of δRW, therefore, the following is implemented as illustrated in FIG. 48: the processing of varying the gradation ratio of the warning display pixels 72 at a time of the occurrence of an anomaly so that the following is implemented according to the inputted adjustment value is achieved astride the first mode and the second mode: the gradation ratio of the warning display pixels at a time of the occurrence of an anomaly is higher than the gradation ratio of the meter display pixels 62 varied according to the inputted adjustment value.

In the control flow of the second mode routine in the above-mentioned 13th example embodiment, the following processing is carried out at Steps S303 and S804 in the sixth example embodiment illustrated in FIG. 32: the gradation ratio of the meter display pixels 62 is controlled to within the range δRM equal to or lower than the intermediate ratio RMmid in place of the range ΔRM equal to or lower than the maximum ratio RMmax.

According to the 13th example embodiment described up to this point, the following can be implemented regardless of the light emission brightness of the light source 40: the lightness of the warning image 70 relative to that of the meter image 60 can be increased to the occupant's taste to achieve the purpose of a display of the warning image 70.

14th Example Embodiment

Figure 49:
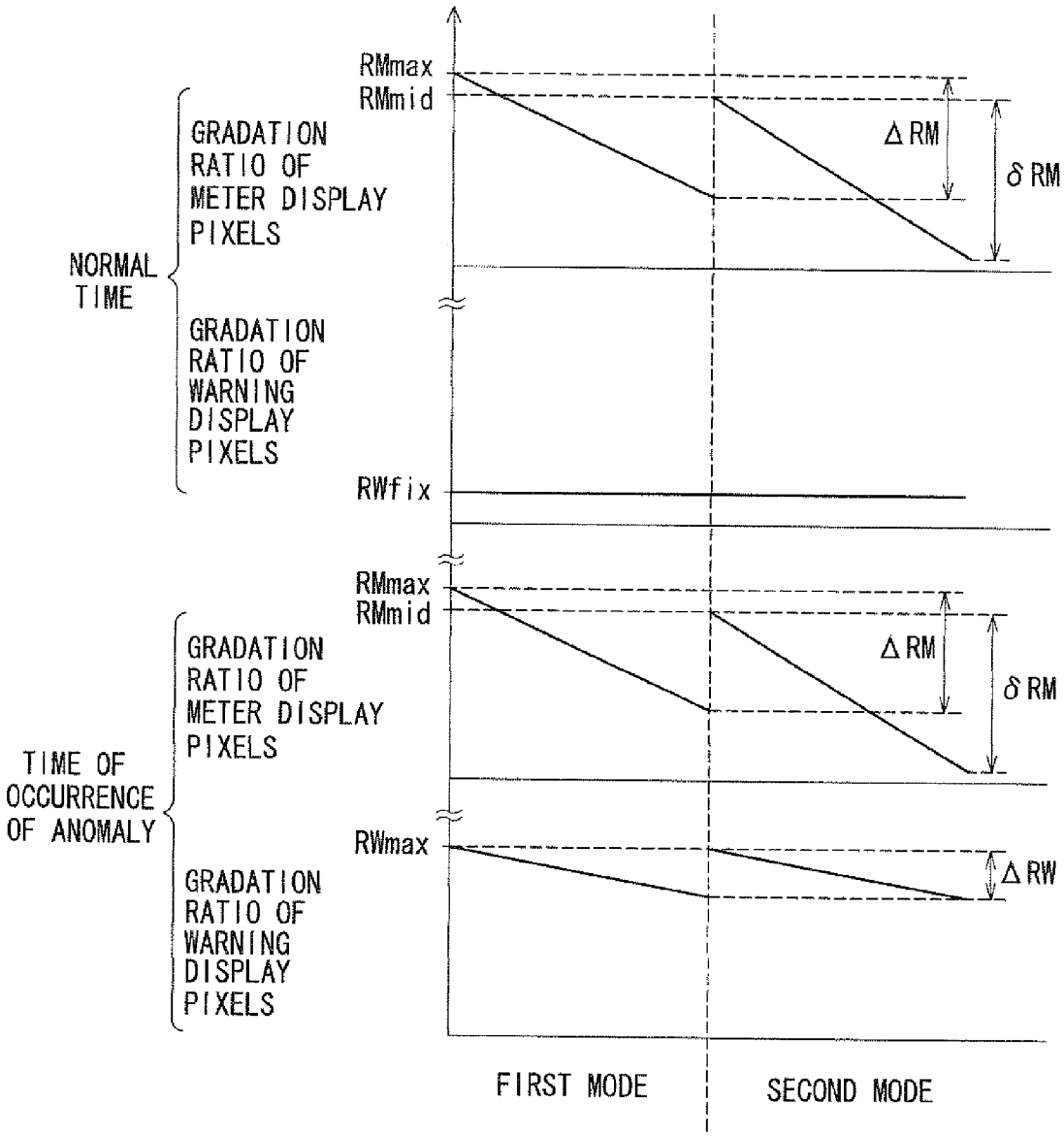
FIG. 49 is a schematic diagram illustrating the gradation ratios of pixels in a 14th example embodiment.

As illustrated in FIG. 49, a 14th example embodiment is a modification to the fifth example embodiment in the displaying operation of the display device 1 for a vehicle. Hereafter, description will be given with a focus on a difference from the fifth example embodiment, and the description of the portions of the 14th embodiment which is substantially the same as that of the fifth example embodiment has been omitted.

A more specific description will now be given. At a time of changeover from the first mode to the second mode, the control circuit 50 carries out the following processing as in the above-mentioned fourth example embodiment: it controls the gradation ratio of the meter display pixels 62 to an intermediate ratio RMmid (FIG. 49) lower than the maximum ratio RMmax. In this example embodiment, however, the intermediate ratio RMmid is set to the following value: a value lower than the maximum gradation ratio RWmax of the warning display pixels 72 that is the upper-limit ratio in the range ΔRW within which the gradation ratio of the warning display pixels 72 is variably controlled at a time of the occurrence of an anomaly in the second mode.

Figure 50:
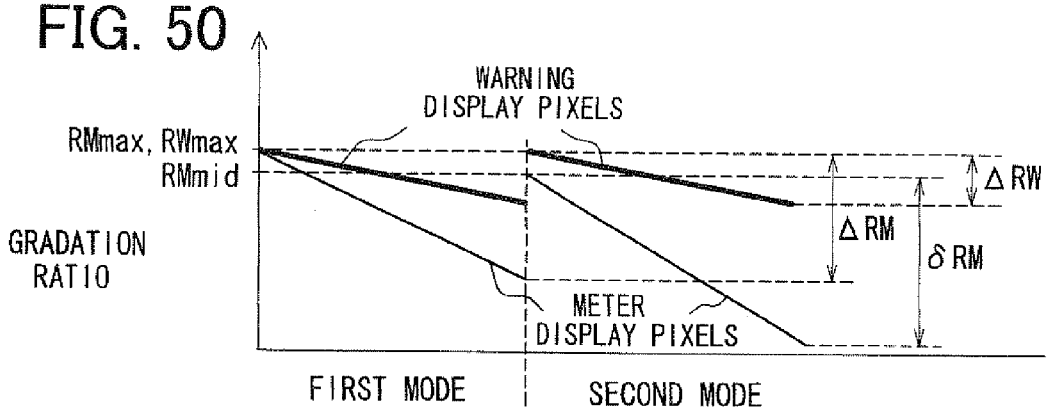
FIG. 50 is a schematic diagram illustrating the correlation characteristic of the gradation ratios of pixels in the 14th example embodiment.

Further, at a normal time and at a time of the occurrence of an anomaly in the second mode, the control circuit 50 carries out the following processing as in the above-mentioned fourth example embodiment: it variably controls the gradation ratio of the meter display pixels 62 within a range δRM (FIG. 49) in which the intermediate ratio RMmid is the upper-limit ratio and which is wider than the variable range ΔRM in the first mode. In this example embodiment in which the width of δRM is larger than that of ΔRW, therefore, the following is implemented as illustrated in FIG. 50: the processing of varying the gradation ratio of the warning display pixels 72 at a time of the occurrence of an anomaly so that the following is implemented according to the inputted adjustment value is achieved astride the first mode and the second mode: the gradation ratio of the warning display pixels at a time of the occurrence of an anomaly is higher than the gradation ratio of the meter display pixels 62 varied according to the inputted adjustment value.

In the control flow of the second mode routine in the above-mentioned 14th example embodiment, the following processing is carried out at Steps S303 and S704 in the fifth example embodiment illustrated in FIG. 28: the gradation ratio of the meter display pixels 62 is controlled to within the range δRM equal to or lower than the intermediate ratio RMmid in place of the range ΔRM equal to or lower than the maximum ratio RMmax.

According to the 14th example embodiment described up to this point, the following can be implemented regardless of the light emission brightness of the light source 40: the lightness of the warning image 70 relative to that of the meter image 60 can be increased to the occupant's taste to achieve the purpose of a display of the warning image 70.

15th Example Embodiment

Figure 51:
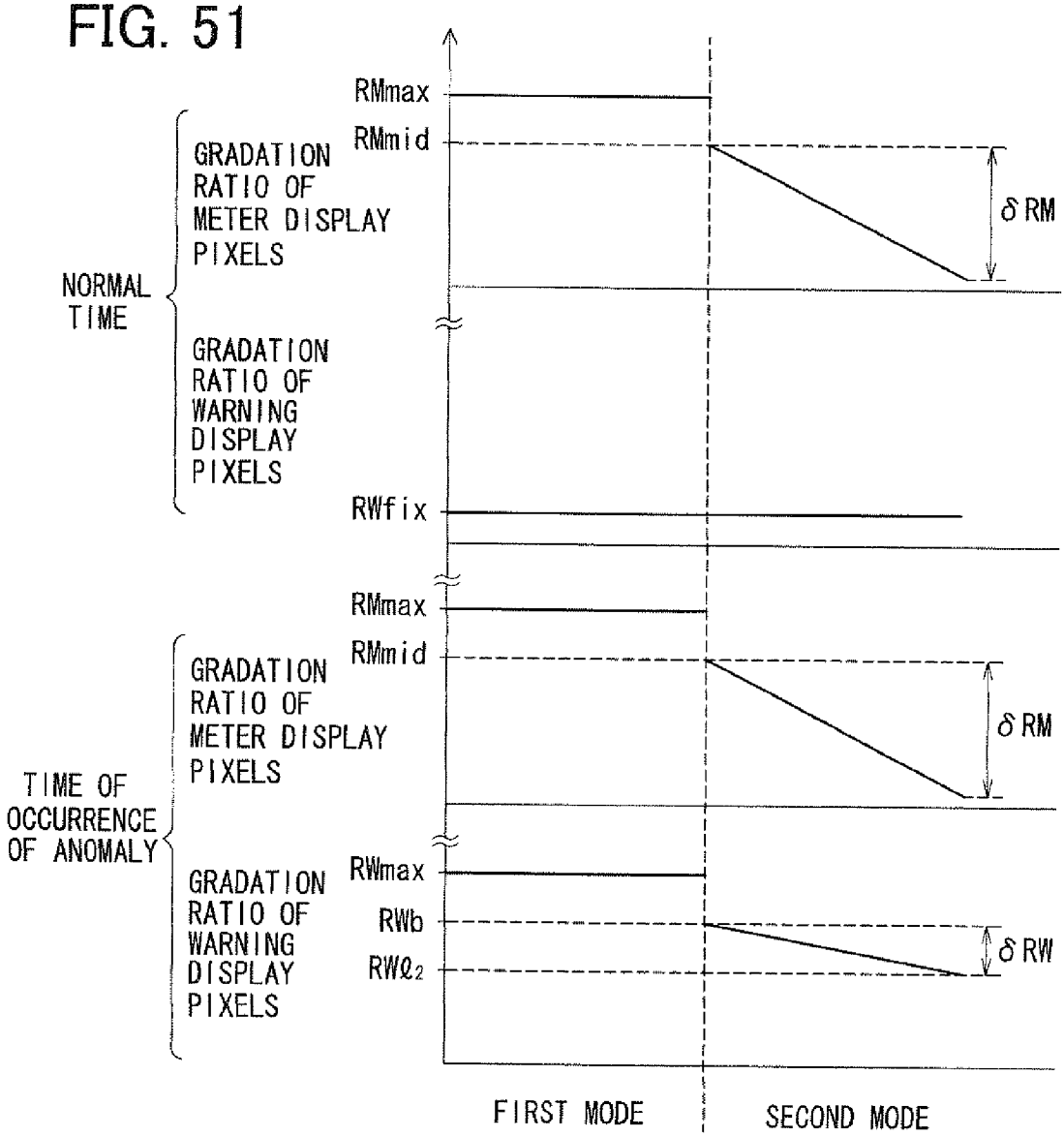
FIG. 51 is a schematic diagram illustrating the gradation ratios of pixels in a 15th example embodiment.

As illustrated in FIG. 51, a 15th example embodiment is a modification to the second example embodiment in the displaying operation of the display device 1 for a vehicle. Hereafter, description will be given with a focus on a difference from the second example embodiment, and the description of the portions of the 15th embodiment which is substantially the same as that of the second example embodiment has been omitted.

A more specific description will now be given. At a time of the occurrence of an anomaly in the second mode, the control circuit 50 variably controls the gradation ratio of the warning display pixels 72 within a range δRW (FIG. 51) as in the above-mentioned 13th example embodiment. That is, the upper-limit ratio in the variable range δRW is set to a ratio RWb lower than the gradation ratio RWmax of the warning display pixels 72 at a time of the occurrence of an anomaly in the first mode. Further, the variable range δRW is made narrower than the variable range δRM of the meter display pixels 62 in the second mode. In the second mode, in addition, the gradation ratio of the meter display pixels 62 and the gradation ratio of the warning display pixels 72 are reduced from the identical ratios RMmid and RWb in response to change in inputted adjustment value.

Figure 52:
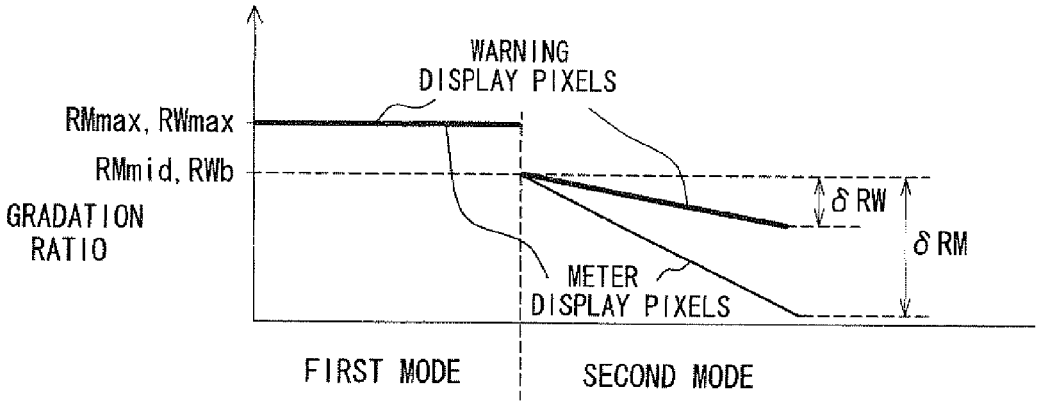
FIG. 52 is a schematic diagram illustrating the correlation characteristic of the gradation ratios of pixels in the 15th example embodiment.

Thus, in the second mode in the 15th example embodiment in which the values of RMmid and RWb are equal to each other, the following is implemented as illustrated in FIG. 52: the processing of varying the gradation ratio of the warning display pixels 72 at a time of the occurrence of an anomaly so that the following is implemented according to the inputted adjustment value: the gradation ratio of the warning display pixels at a time of the occurrence of an anomaly is higher than the gradation ratio of the meter display pixels 62 varied according to the inputted adjustment value. In the control flow of the second mode routine in the above-mentioned 15th example embodiment, the following processing is carried out at Step S404 in the second example embodiment illustrated in FIG. 18: the gradation ratio of the warning display pixels 72 at a time of the occurrence of an anomaly is controlled to within the range δRW equal to or lower than the ratio RWb in place of the maximum ratio RWmax.

According to the 15th example embodiment described up to this point, the following can be implemented even in the second mode in which the light emission brightness of the light source 40 is low: the lightness of the warning image 70 relative to that of the meter image 60 can be increased to the occupant's taste to achieve the purpose of a display of the warning image 70.

16th Example Embodiment

Figure 53:
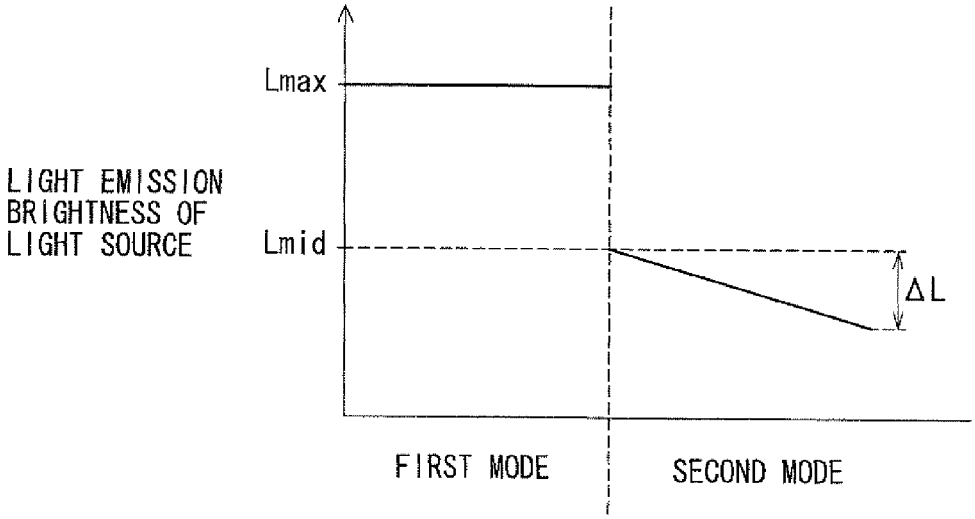
FIG. 53 is a schematic diagram illustrating the light emission brightness of a light source in a 16th example embodiment.
Figure 54:
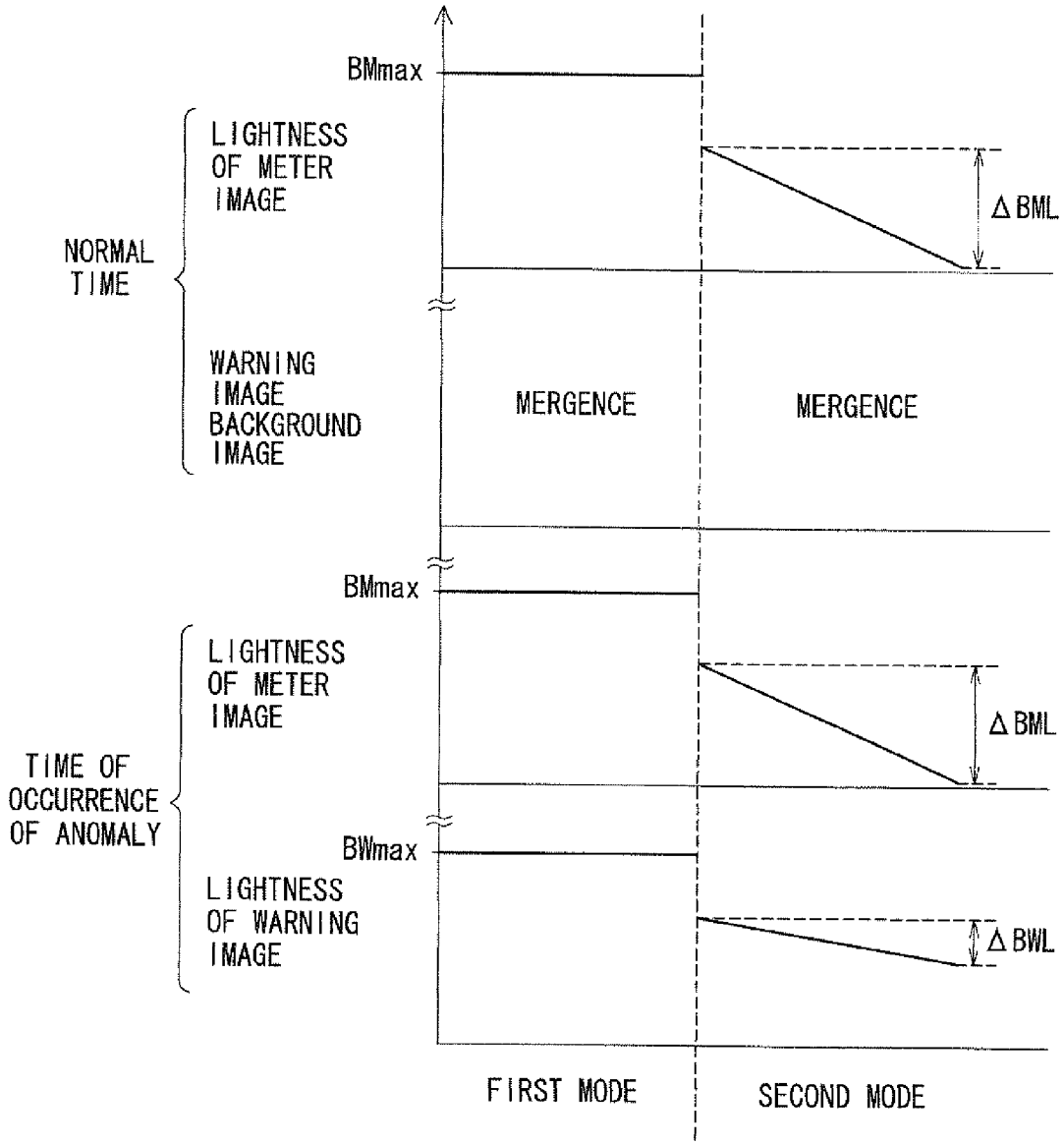
FIG. 54 is a schematic diagram illustrating the state of an image display in the 16th example embodiment.

As illustrated in FIGS. 53 and 54, a 16th example embodiment is a modification to the first example embodiment in the displaying operation of the display device 1 for a vehicle. Hereafter, description will be given with a focus on a difference from the first example embodiment, and the description of the portions of the 16th embodiment which is substantially the same as that of the first example embodiment has been omitted.

More specific description will be given. Both at normal time and at a time of the occurrence of an anomaly in the second mode, the control circuit 50 variably controls the light emission brightness of the light source 40 so that the following is implemented: it linearly reduces the light emission brightness within a range ΔL (FIG. 53) equal to or lower than an intermediate level of brightness Lmid in response to increasing change in the inputted adjustment value from the occupant. This intermediate level of brightness is lower than the brightness Lmax held in the first mode. Thus, at normal time and at a time of the occurrence of an anomaly in the second mode, the lightness of the meter image 60 is reduced to the lightness ΔBML (FIG. 54) determined by the following: the light emission brightness of the light source 40 within the variable range ΔL and the gradation ratio of the meter display pixels 62 within the variable range ΔRM. Further, at a time of the occurrence of an anomaly in the second mode, the lightness ΔBWL (FIG. 54) determined by the following is ensured as the lightness of the warning image 70: the light emission brightness of the light source 40 within the variable range ΔL and the gradation ratio RWmax of the warning display pixels 72.

Figure 55:
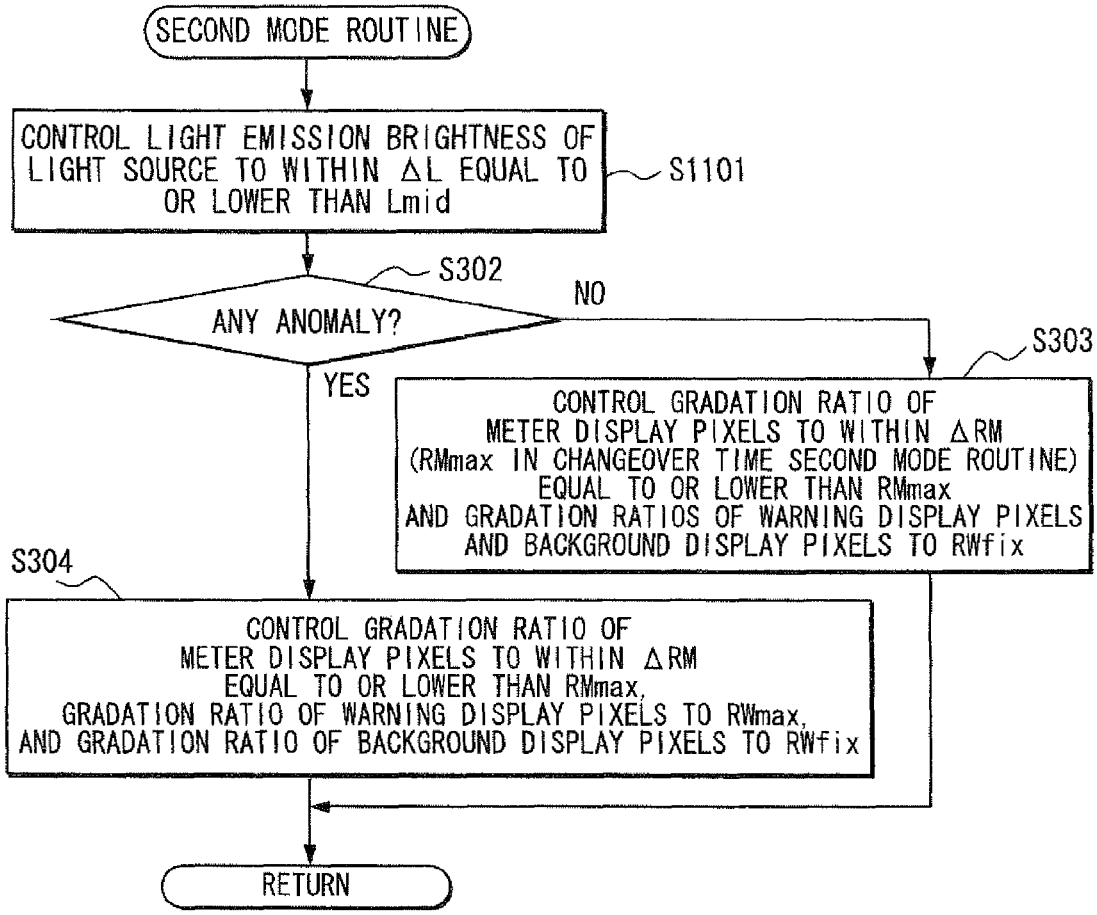
FIG. 55 is a flowchart illustrating a second mode routine in the 16th example embodiment.

In the control flow of the second mode routine in the above-mentioned 16th example embodiment, the following is implemented by the processing of Step S1101 substituted for Step S301 in the first example embodiment as illustrated in FIG. 55: the light emission brightness of the light source 40 is controlled to within the range ΔL equal to or lower than the intermediate level of brightness Lmid.

According to the 16th example embodiment described up to this point, the levels of lightness of the images 70, 60 can be tailored to the occupant's taste and further the following conflicting requests can be simultaneously met: a request to prevent failure to achieve the purpose of a display of the warning image 70 and a request to enhance the visibility of the meter image 60.

17th Example Embodiment

As illustrated in FIGS. 56 to 60, a 17th example embodiment is a modification to the fourth example embodiment in the configuration and the displaying operation of a display device 100 for a vehicle. Hereafter, description will be given with a focus on a difference from the fourth example embodiment, and the description of the portions of the 17th embodiment which is substantially the same as that of the fourth example embodiment has been omitted.

Figure 56:
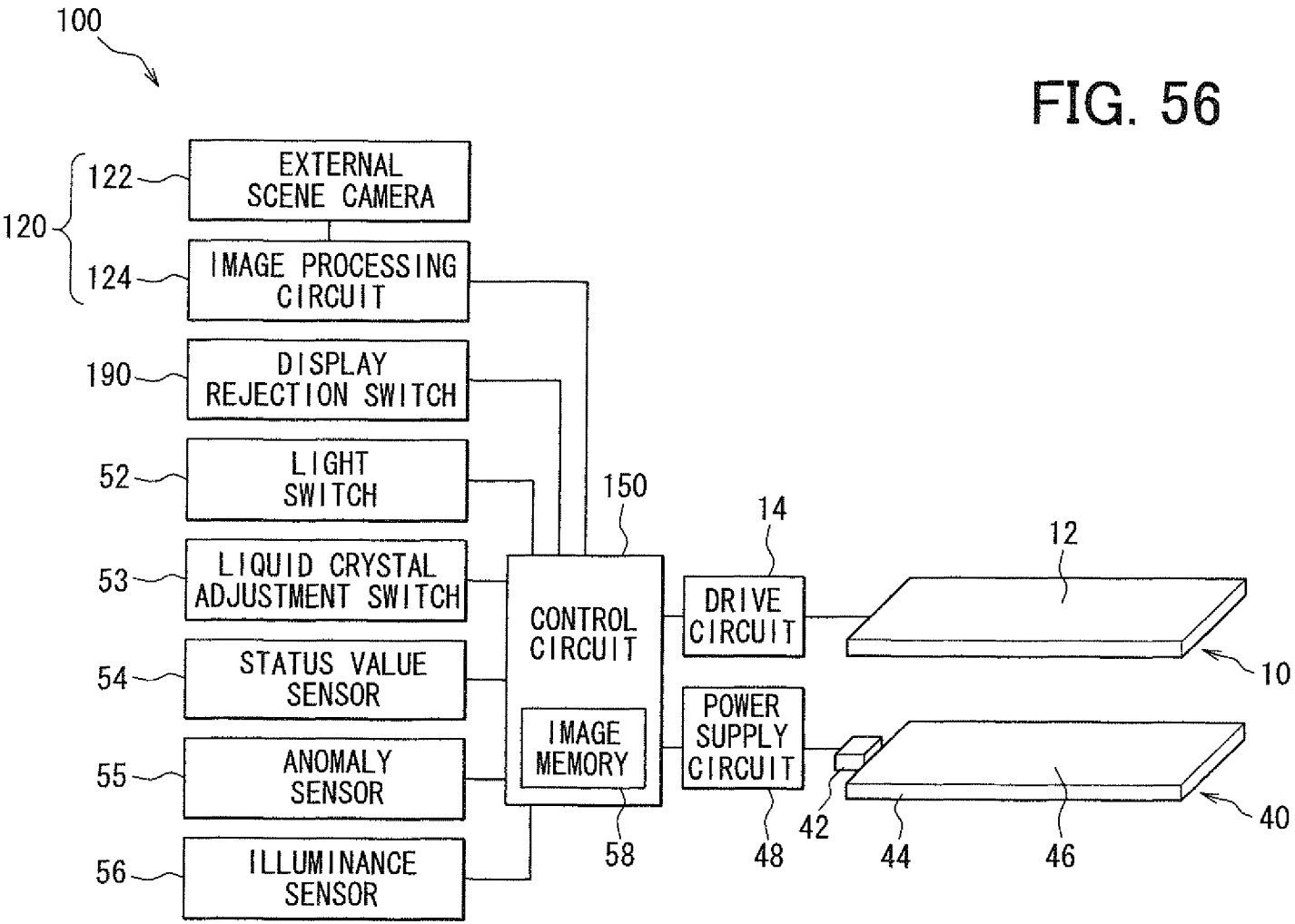
FIG. 56 is a block diagram illustrating the electric circuitry of a display device for a vehicle in a 17th example embodiment.
Figure 57:
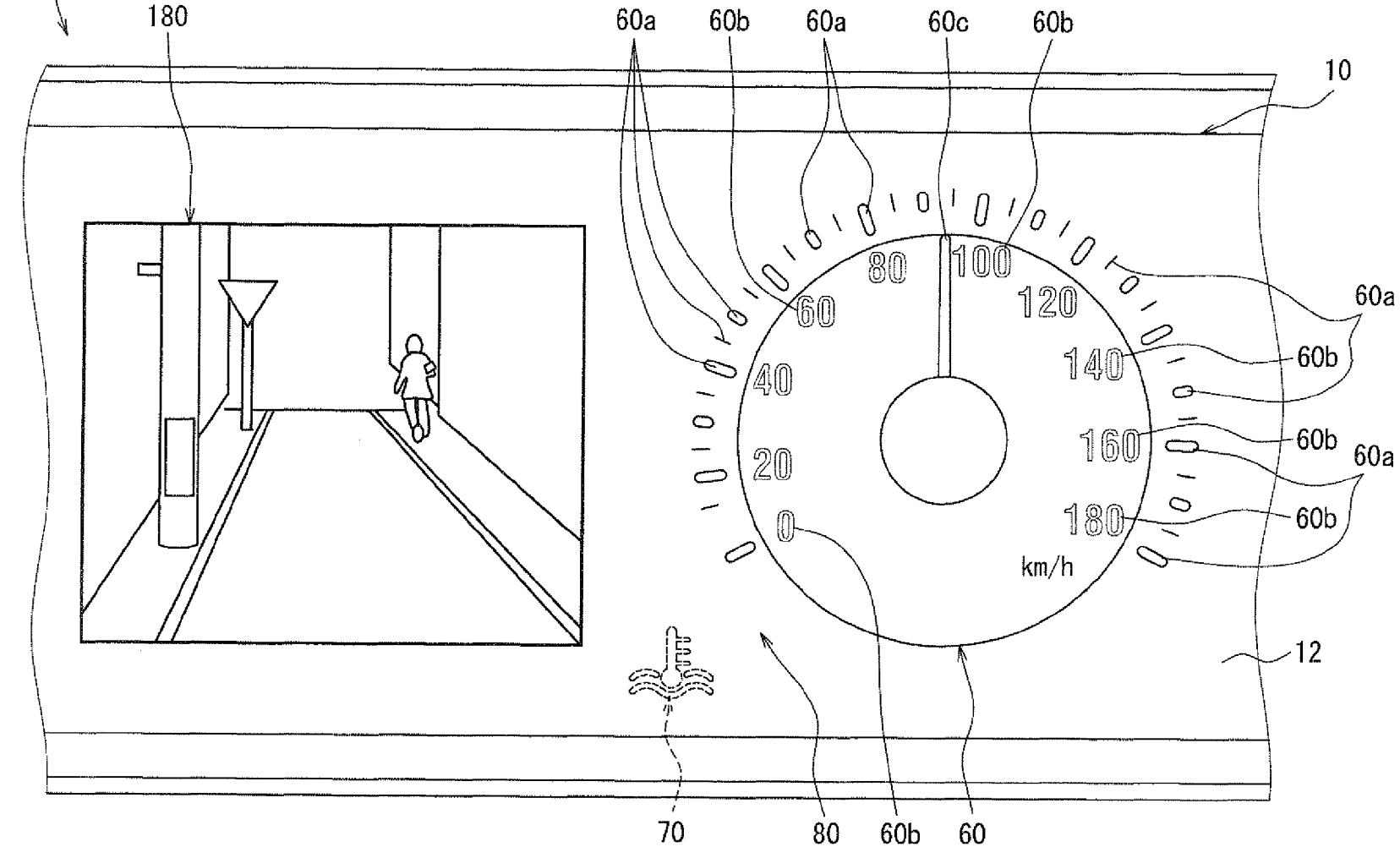
FIG. 57 is a front view illustrating a screen display of a liquid crystal panel at a normal time with a display of an external scene image permitted in the 17th example embodiment.

First, description will be provided for the configuration of the display device 100 for a vehicle. As illustrated in FIG. 56, the display device 100 for a vehicle additionally includes an image pickup unit 120. This image pickup unit 120 includes an external scene camera 122 and an image processing circuit 124.

The external scene camera 122 is installed at, for example, the front bumper or front grille of the vehicle and is so constructed that the following is implemented: infrared light is projected forward of the vehicle from a dedicated projector or a headlamp of the vehicle; and the reflected light of the projected light is received by an image pickup device, such as CCD, and converted into an image signal. The image processing circuit 124 is constructed of a microcomputer and is installed in the vehicle. It is electrically connected to the external scene camera 122 and a control circuit 150 as "controlling means." The image processing circuit 124 processes an image signal from the external scene camera 122 to generate image data and transmits this image data to the control circuit 150.

Figure 61:
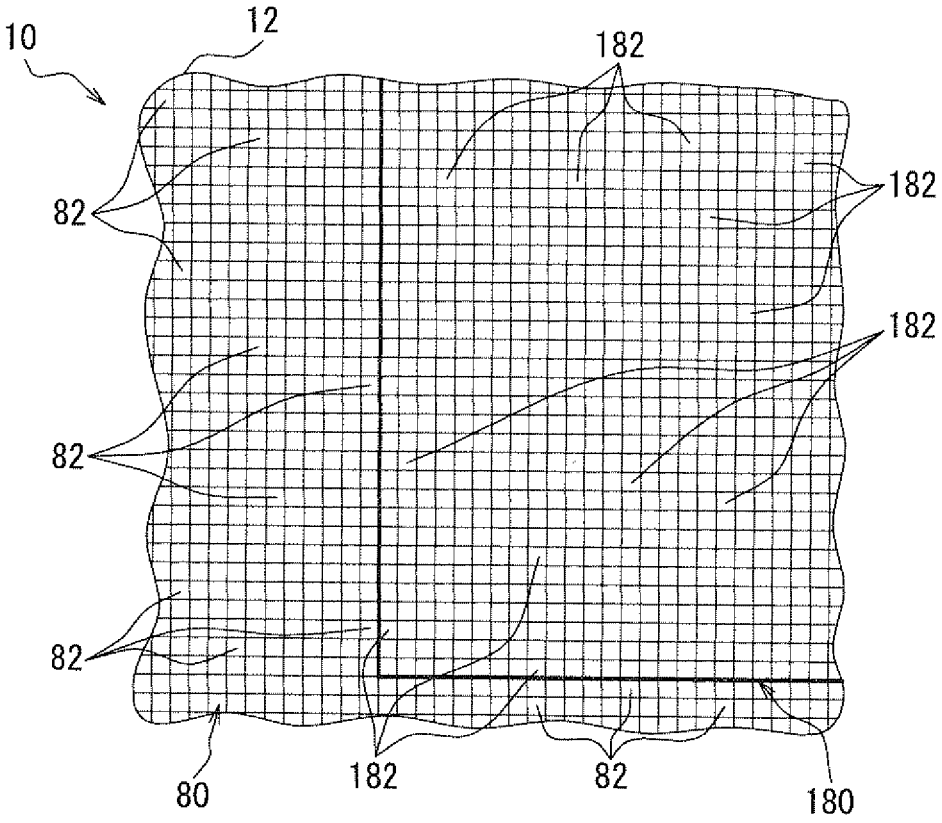
FIG. 61 is a schematic diagram illustrating the screen of a liquid crystal panel at a normal time with a display of an external scene image permitted in the 17th example embodiment in an enlarged manner.

Based on the image data transmitted from the image pickup unit 120 as mentioned above, the control circuit 150 generates an image signal to be supplied to the drive circuit 14. It thereby displays the external scene image 180 illustrated in the FIG. 57 on the screen 12 of the liquid crystal panel 10. As illustrated in FIG. 61 in an enlarged manner, the external scene image 180 is displayed by the gradation value of external scene display pixels 182 inside a heavy line representing its border line being controlled according to an image signal from the control circuit 150.

Figure 62:
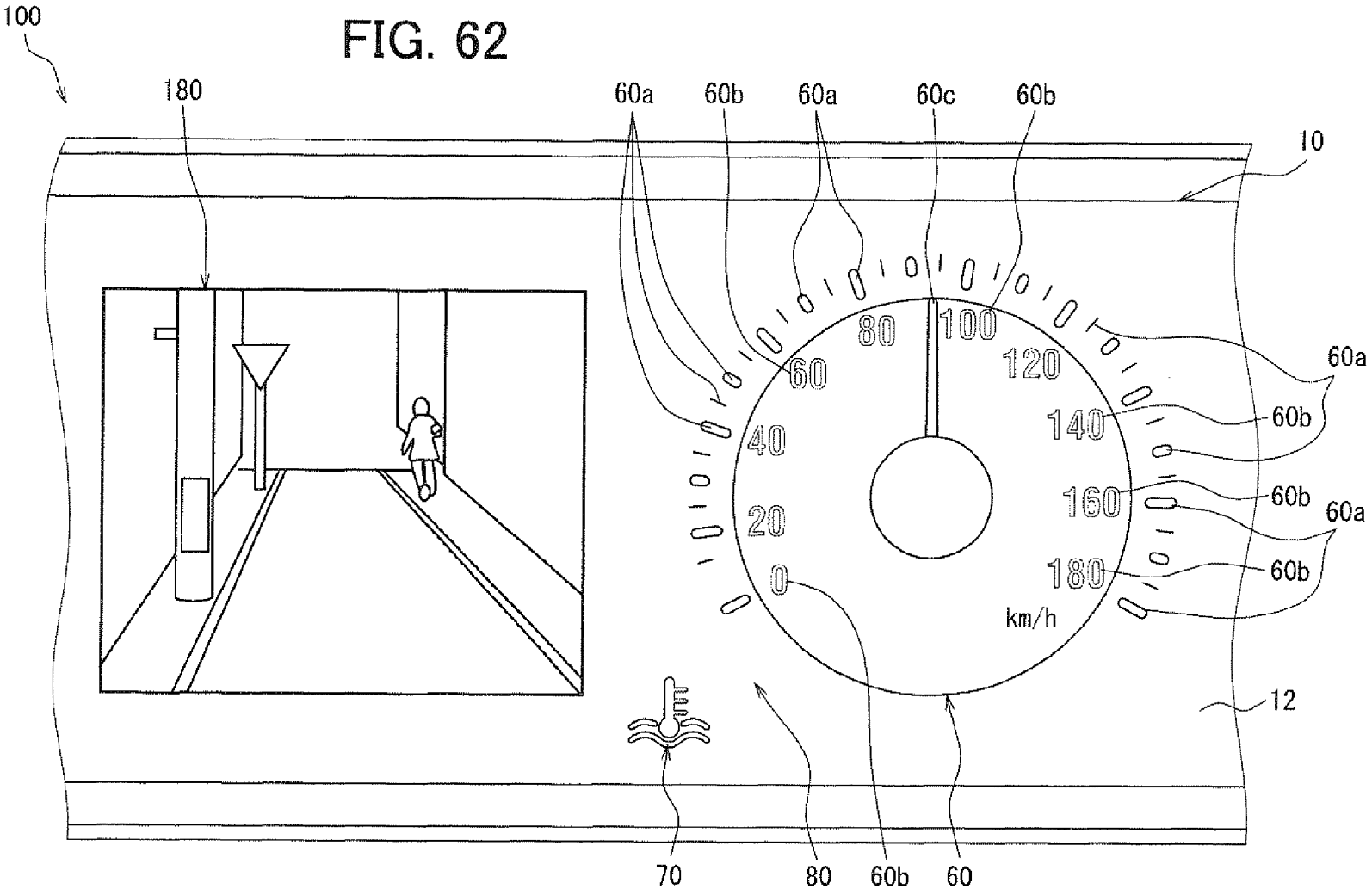
FIG. 62 is a front view illustrating a screen display of a liquid crystal panel at a time of the occurrence of an anomaly with a display of an external scene image permitted in the 17th example embodiment.
Figure 63:
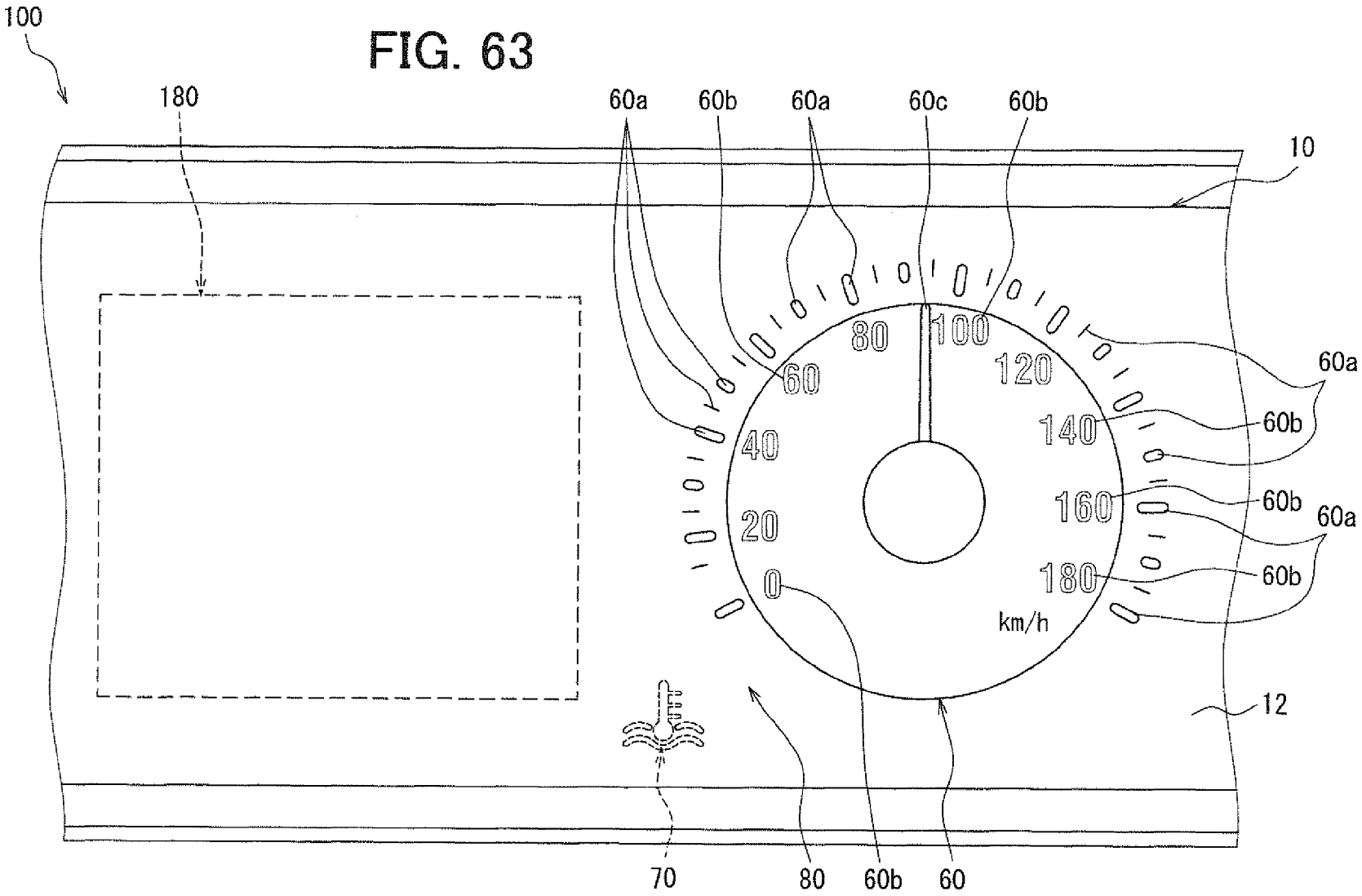
FIG. 63 is a front view illustrating a screen display of a liquid crystal panel at a normal time with a display of an external scene image prohibited in the 17th example embodiment.
Figure 64:
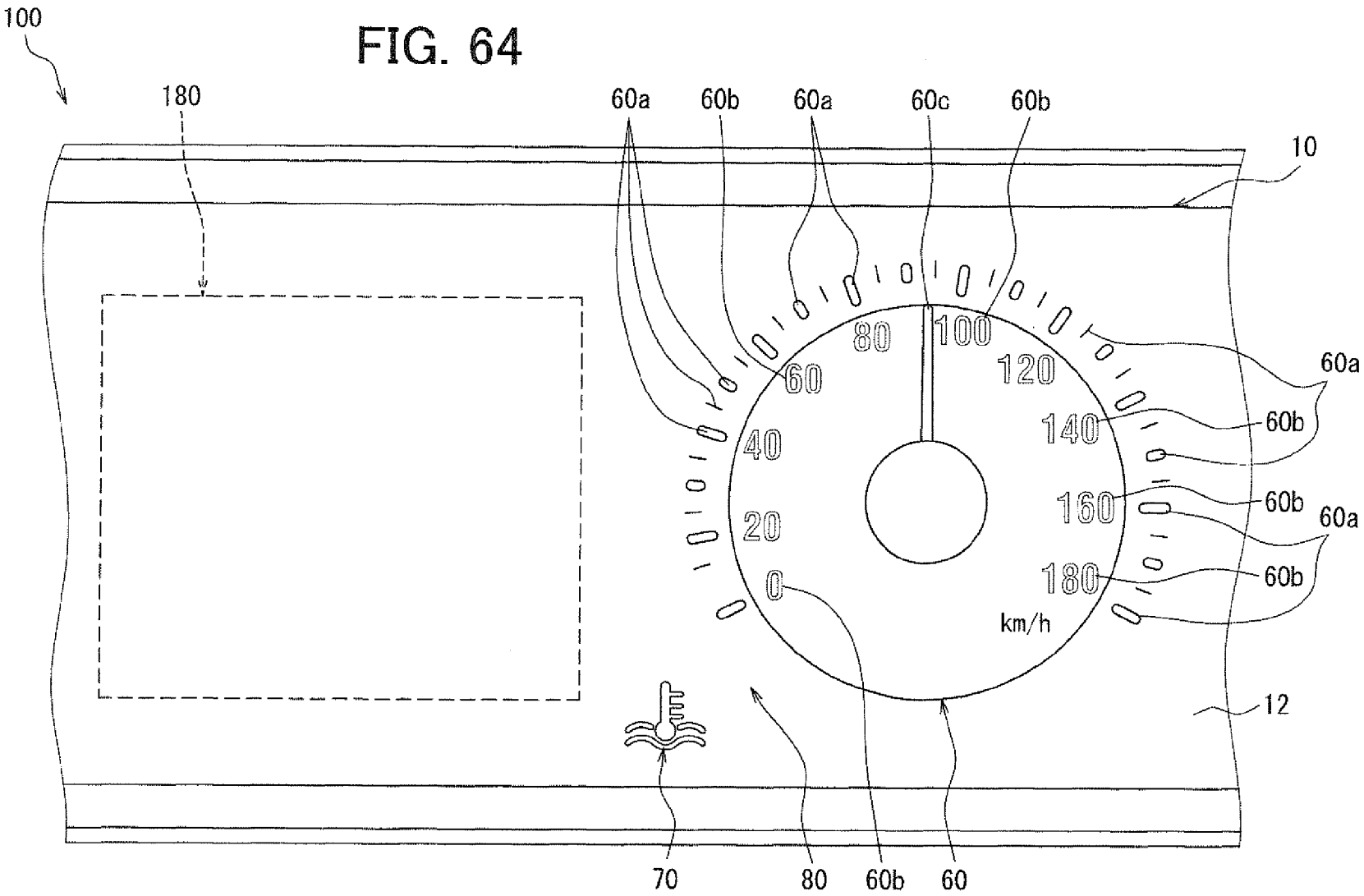
FIG. 64 is a front view illustrating a screen display of a liquid crystal panel at a time of the occurrence of an anomaly with a display of an external scene image prohibited in the 17th example embodiment.

In this example embodiment, the external scene image 180 is used to alert an occupant about the situation external to the vehicle. It is an image of the area ahead of the vehicle at which the visible light from the headlamps does not arrive especially at nighttime, when the vehicle is running through a dark area, or on any other like occasion. That is, the external scene image is a night view image. Therefore, when a display of the external scene image 180 is permitted at nighttime, during the passage of the vehicle through a dark area, or on any other like occasion, the following takes place: the external scene image 180 is displayed both at a normal time when the warning image 70 is apparently not displayed, illustrated in FIG. 57, and at a time of the occurrence of an anomaly when the warning image 70 is displayed, illustrated in FIG. 62. Meanwhile, when a display of the external scene image 180 is prohibited, the following takes place: the external scene image 180 is merged into the background image 80 and is apparently not displayed both at normal time illustrated in FIG. 63 and at a time of the occurrence of an anomaly illustrated in FIG. 64.

As illustrated in FIG. 56, the display device 100 for a vehicle is additionally provided with a display rejection switch 190. This display rejection switch 190 is turned on/off by the occupant to reject a display of the external scene image 180 on the liquid crystal panel 10. The occupant can input a command to reject a display of the external scene image 180 by turning the display rejection switch 190 to the on position or the off position. The display rejection switch 190 transmits a signal indicating this entry to the control circuit 150. That is, in this embodiment, the display rejection switch 190, in addition to the light switch 52 and the liquid crystal adjustment switch 53, functions as "inputting element" for accepting input from the occupant.

Figure 58:
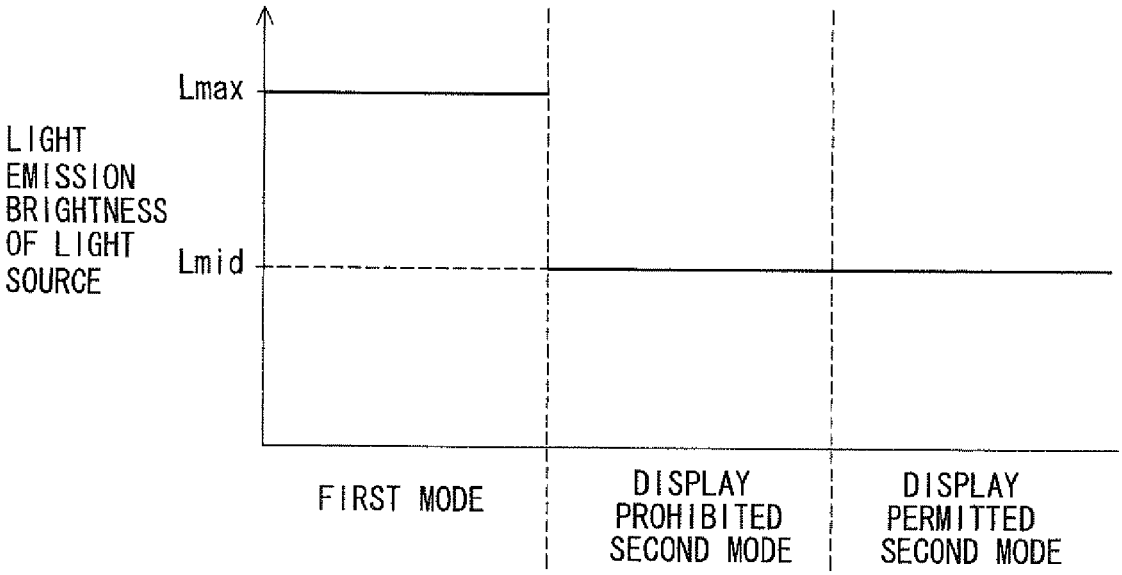
FIG. 58 is a schematic diagram illustrating the light emission brightness of a light source in the 17th example embodiment.
Figure 59:
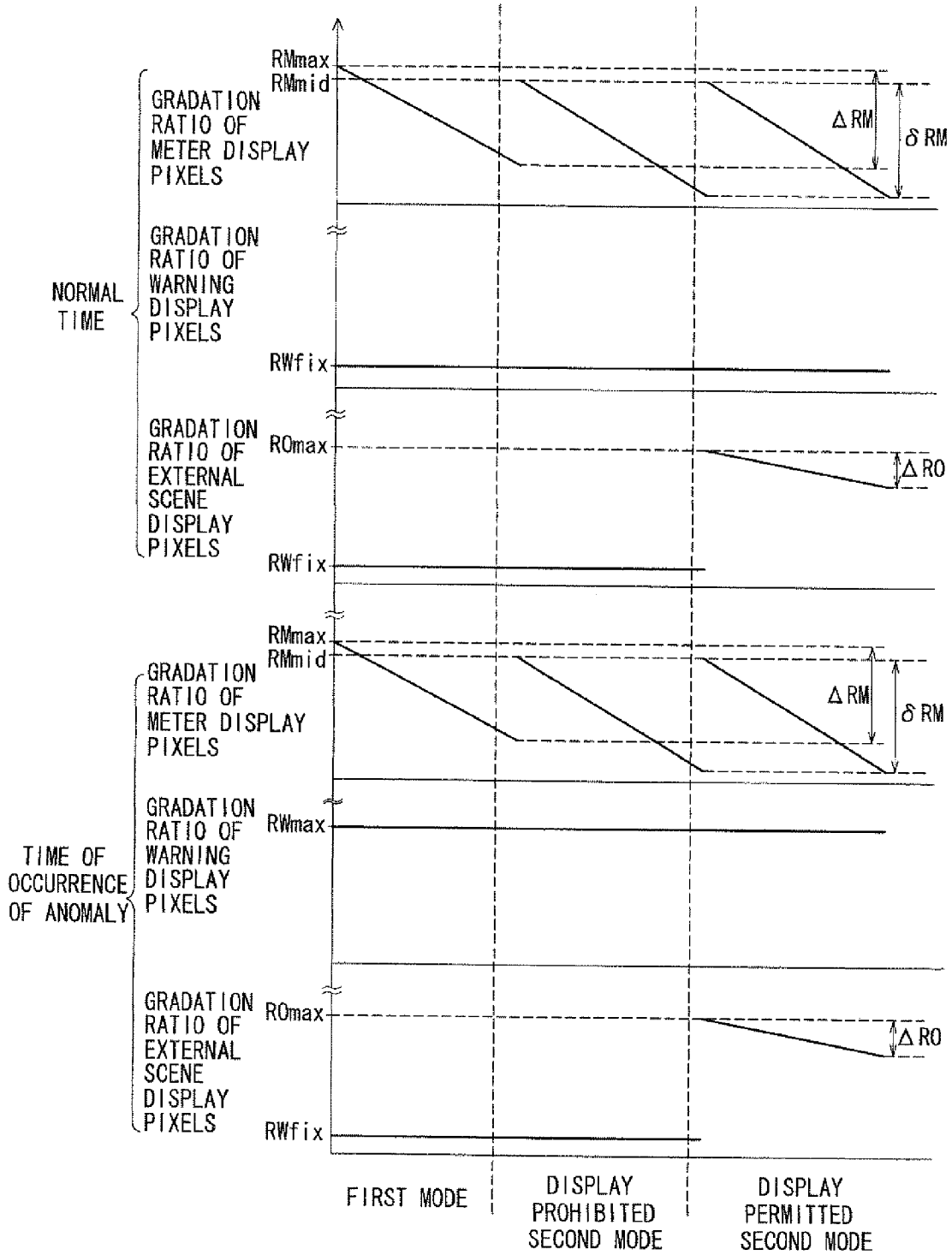
FIG. 59 is a schematic diagram illustrating the gradation ratios of pixels in the 17th example embodiment.
Figure 60:
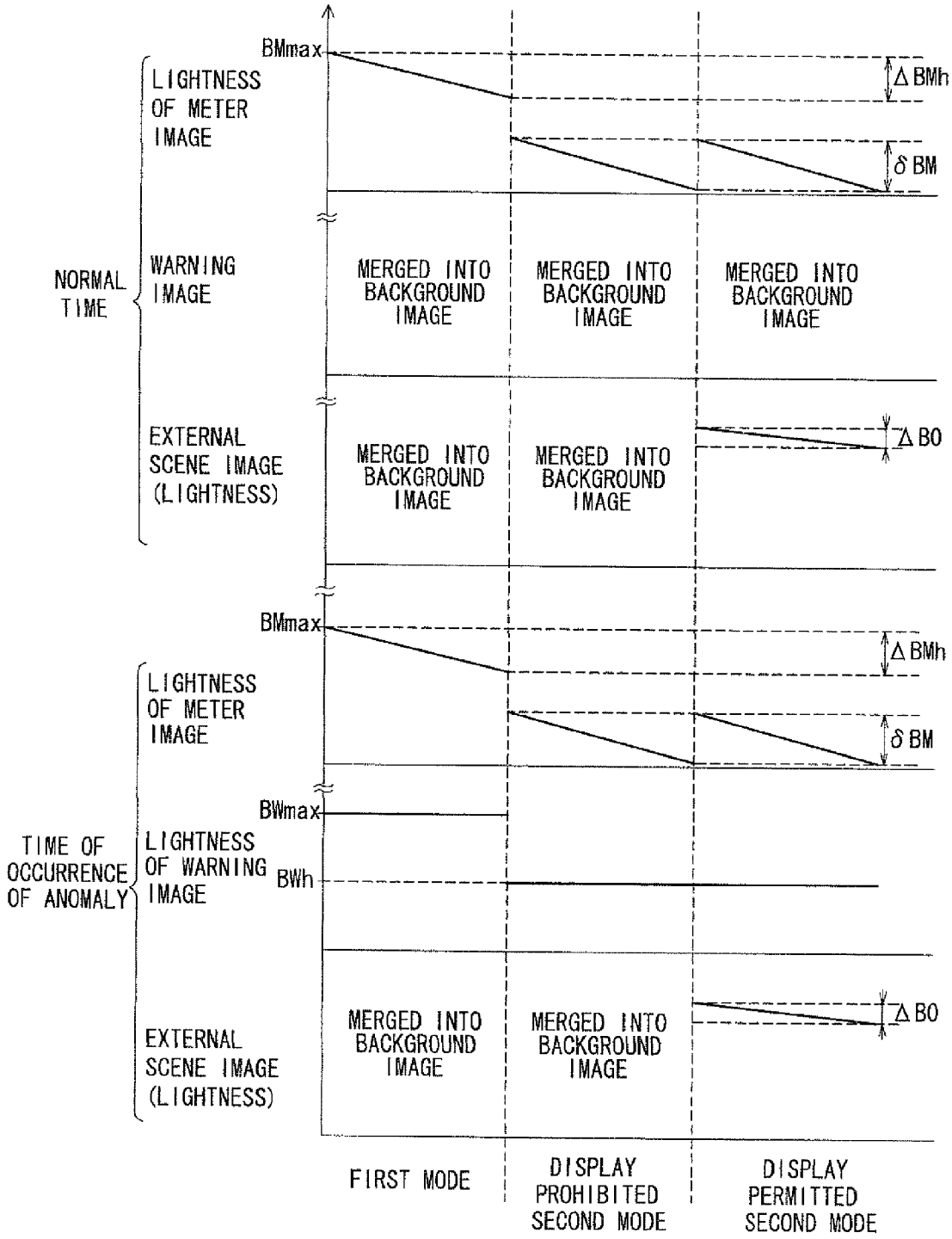
FIG. 60 is a schematic diagram illustrating the state of an image display in the 17th example embodiment.
Figure 65:
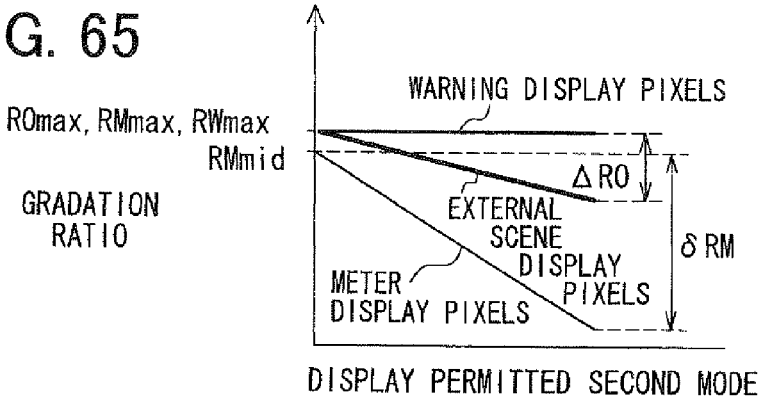
FIG. 65 is a schematic diagram illustrating the correlation characteristic of the gradation ratios of pixels in the 17th example embodiment.

Description will be provided for the displaying operation of the display device 100 for a vehicle with reference to FIGS. 58 to 60 and 65. For the displaying operation of the display device 100 for a vehicle, one type of first mode and two different types of second mode are prepared as control mode. FIG. 58 illustrates the light emission brightness of the light source; FIGS. 59 and 65 illustrate the gradation ratio of pixels; and FIG. 60 illustrates the state of an image display (lightness, etc.).

(1) First Mode

The control circuit 150 prohibits a display of the external scene image 180 and sets the control mode to the first mode regardless of a signal from the display rejection switch 190 when it receives at least either of the following: a signal indicating the all lamps off position from the light switch 52; and a signal indicating an outside light intensity exceeding a threshold value I from the illuminance sensor 56.

In the first mode established as mentioned above, the light emission brightness of the light source 40 and the gradation ratios of the pixels 62, 72, 82 are controlled as follows: they are controlled as in the first mode in the fourth example embodiment (FIGS. 58 and 59) both at a normal time and at a time of the occurrence of an anomaly.

In the first mode, meanwhile, the gradation ratio of the external scene display pixels 182 is controlled as follows even at a normal time or at a time of the occurrence of an anomaly: it is kept at the same fixed ratio RWfix (FIG. 59) as that of the background display pixels 82 is. In the first mode, therefore, the external scene image 180 is merged into the background image 80 (FIG. 60).

(2) Second Mode (2-1) Display Prohibited Second Mode

The control circuit 150 sets the control mode to a display prohibited second mode to prohibit a display of the external scene image 180 when it receives all of the following: a signal indicating the position lamp on position or the headlamp on position from the light switch 52; a signal indicating an outside light intensity equal to or lower than the threshold value I from the illuminance sensor 56; and a signal indicating a command to prohibit a display of the external scene image 180 from the display rejection switch 190.

In this display prohibited second mode, the light emission brightness of the light source 40 and the gradation ratios of the pixels 62, 72, 82 are controlled as follows: they are controlled as in the second mode in the fourth example embodiment (FIGS. 58 and 59) both at normal time and at a time of the occurrence of an anomaly.

In the display prohibited second mode, meanwhile, the gradation ratio of the external scene display pixels 182 is controlled as follows even at normal time or at a time of the occurrence of an anomaly: it is kept at the same fixed ratio RWfix (FIG. 59) as that of the background display pixels 82 is. In the display prohibited second mode, therefore, the external scene image 180 is merged into the background image 80 (FIG. 60).

(2-2) Display Permitted Second Mode

The control circuit 150 sets the control mode to a display permitted second mode to permit a display of the external scene image 180 when it receives all of the following: a signal indicating the position lamp on position or the headlamp on position from the light switch 52; a signal indicating an outside light intensity equal to or lower than the threshold value I from the illuminance sensor 56; and a signal indicating a command to permit a display of the external scene image 180 from the display rejection switch 190.

In this display permitted second mode, the light emission brightness of the light source 40 and the gradation ratios of the pixels 62, 72, 82 are controlled as follow: they are controlled as in the second mode in the fourth example embodiment (FIGS. 58 and 59) both at normal time and at a time of the occurrence of an anomaly.

In the display permitted second mode, meanwhile, the gradation ratio of the external scene display pixels 182 is variably controlled so that the following is implemented even at a normal time or at a time of the occurrence of an anomaly: it is varied and reduced from a maximum ratio ROmax within a range ΔRO (FIG. 59) in response to increasing change in the inputted adjustment value from the occupant. The maximum ratio ROmax is set to a value identical with the gradation ratio RWmax of the warning display pixels 72 at a time of the occurrence of an anomaly in the display permitted second mode. It is higher than the upper-limit ratio RMmid in the variable range δRM of the gradation ratio of the meter display pixels 62 in the display permitted second mode. The width of the variable range ΔRO is narrower than that of the variable range δRM of the gradation ratio of the meter display pixels 62 in the display permitted second mode.

According to the foregoing, the following is implemented while in the display permitted second mode in this example embodiment, as illustrated in FIG. 65: the processing of varying the gradation ratio of the external scene display pixels 182 so that the following is implemented according to the inputted adjustment value is achieved: the gradation ratio of the external scene display pixels is higher than the gradation ratio of the meter display pixels 62 varied according to the inputted adjustment value. As a result, the lightness of the external scene image 180 is adjusted to the occupant's desired lightness ΔBO (FIG. 60).

(3) Mode Change (3-1) Changeover from First Mode to Display Prohibited Second Mode At a time of changeover from the first mode to the display prohibited second mode, the light emission brightness of the light source 40 and the gradation ratios of the pixels 62, 72, 82 are controlled as follows: they are controlled as at a time of changeover from the first mode to the second mode in the fourth example embodiment. Meanwhile, the gradation ratio of the external scene display pixels 182 is kept at the fixed ratio RWfix as those of the warning display pixels 72 and the background display pixels 82 are.

(3-2) Changeover from Display Prohibited Second Mode to First Mode

At a time of changeover from the display prohibited second mode to the first mode, the light emission brightness of the light source 40 and the gradation ratios of the pixels 62, 72, 82 are controlled as follows: they are controlled as at a time of changeover from the second mode to the first mode in the fourth example embodiment. Meanwhile, the gradation ratio of the external scene display pixels 182 is kept at the fixed ratio RWfix as those of the pixels 72, 82 are.

(3-3) Changeover from First Mode to Display Permitted Second Mode

At a time of changeover from the first mode to the display permitted second mode, the light emission brightness of the light source 40 and the gradation ratios of the pixels 62, 72, 82 are controlled as follows: they are controlled as at a time of changeover from the first mode to the second mode in the fourth example embodiment. Meanwhile, the gradation ratio of the external scene display pixels 182 is once controlled to its maximum ratio ROmax.

(3-4) Changeover from Display Permitted Second Mode to First Mode

At a time of changeover from the display permitted second mode to the first mode, the light emission brightness of the light source 40 and the gradation ratios of the pixels 62, 72, 82 are controlled as follows: they are controlled as at a time of changeover from the second mode to the first mode in the fourth example embodiment. Meanwhile, the gradation ratio of the external scene display pixels 182 is controlled to the fixed ratio RWfix identical with those of the pixels 72, 82.

(3-4) Changeover from Display Prohibited Second Mode to Display Permitted Second Mode At a time of changeover from the display prohibited second mode to the display permitted second mode, the light emission brightness of the light source 40 and the gradation ratios of the pixels 62, 72, 82 are kept at the values immediately before the mode change. Meanwhile, the gradation ratio of the external scene display pixels 182 is once controlled to its maximum ratio ROmax.

(3-5) Changeover from Display Permitted Second Mode to Display Prohibited Second Mode At a time of changeover from the display permitted second mode to the display prohibited second mode, the light emission brightness of the light source 40 and the gradation ratios of the pixels 62, 72, 82 are kept at the values immediately before the mode change. Meanwhile, the gradation ratio of the external scene display pixels 182 is controlled to the fixed ratio RWfix identical with those of the pixels 72, 82.

Description will now be provided for the flow of control on the display device 100 for a vehicle carried out by the control circuit 150 with reference to FIGS. 66 to 69.

Figure 66:
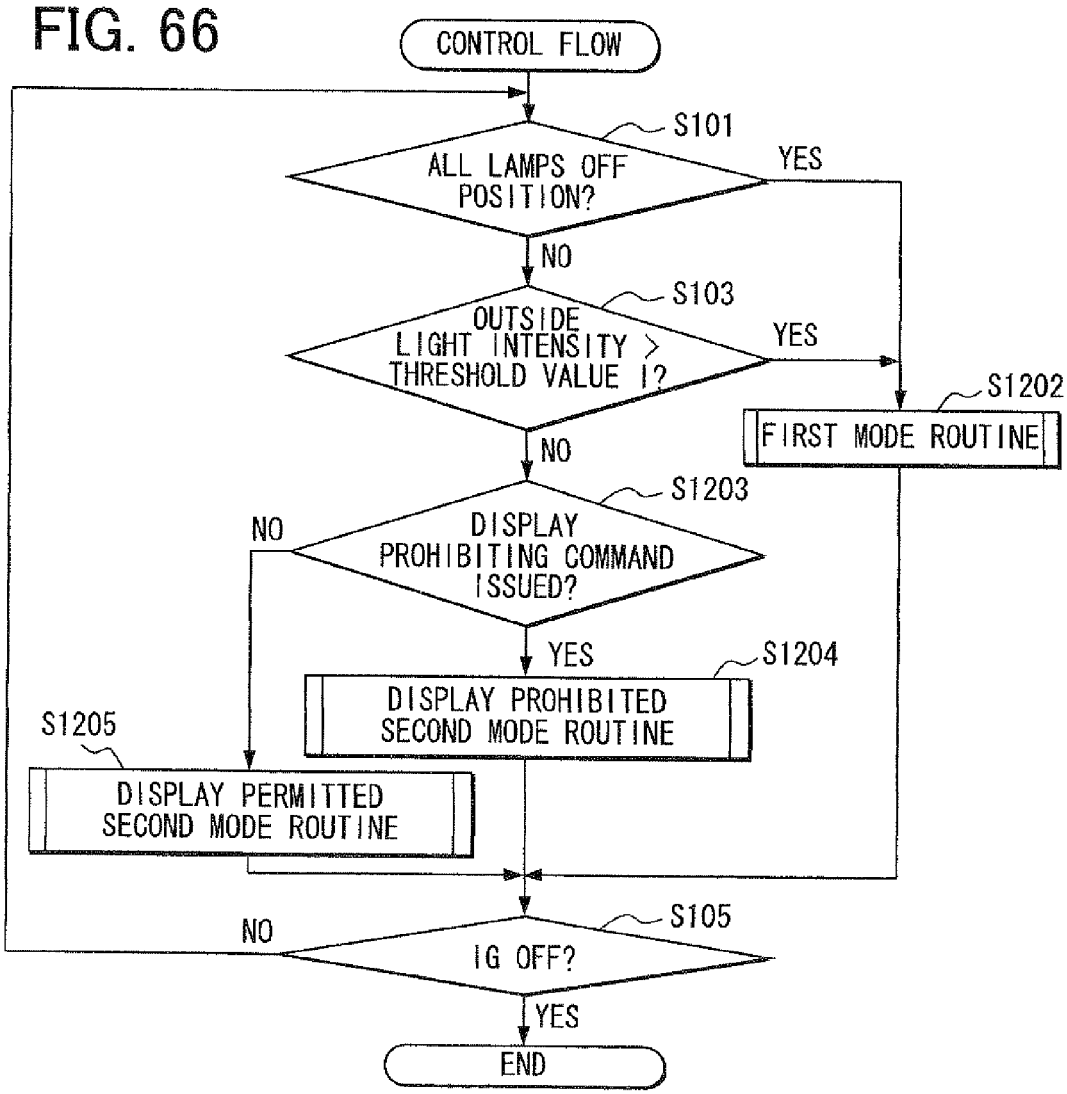
FIG. 66 is a flowchart illustrating a control flow in the 17th example embodiment.

The control flow in this example embodiment is as illustrated in FIG. 66. That is, when an affirmative determination is made at either Step S101 or Step S103, the flow proceeds to Step S1202. Then, the control mode is set to the first mode and the first mode routine is executed.

Figure 67:
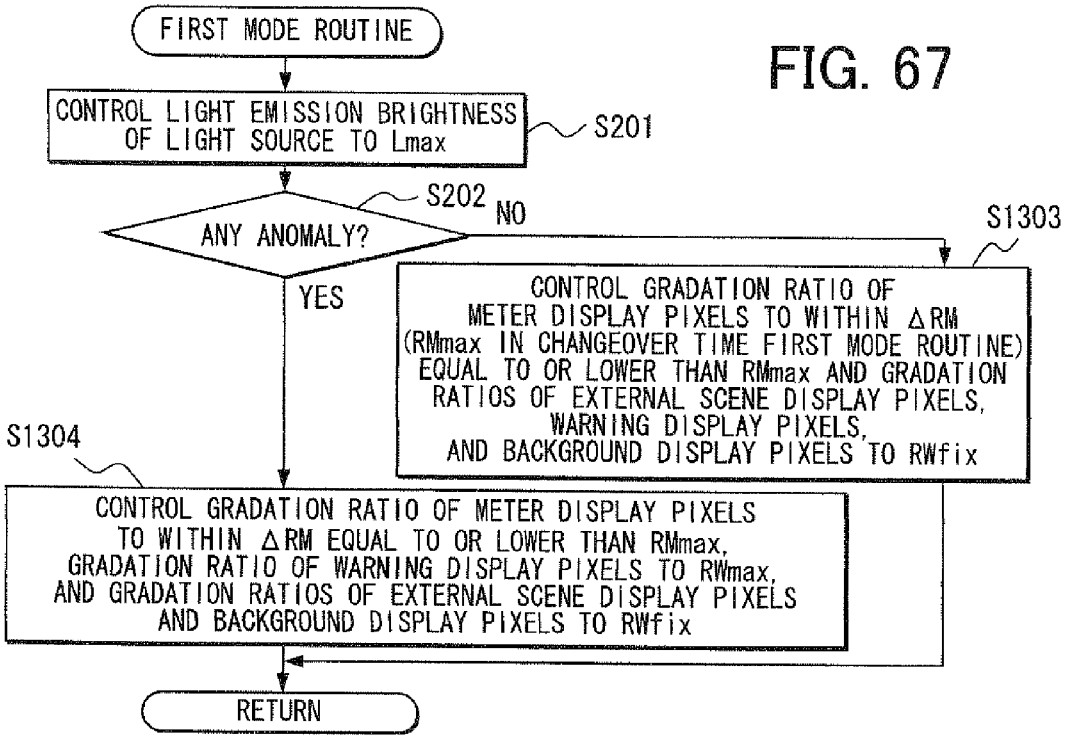
FIG. 67 is a flowchart illustrating a first mode routine in the 17th example embodiment.

As illustrated in detail in FIG. 67, the first mode routine in this example embodiment is a partial modification to the first mode routine in the fourth example embodiment. A more specific description will now be given. At Step S1303 substituted for Step S503 in the fourth example embodiment, the gradation ratio of the external scene display pixels 182 is controlled to the fixed ratio RWfix together with those of the warning display pixels 72 and the background display pixels 82. At Step S1304 substituted for Step S504 in the fourth example embodiment, the gradation ratio of the external scene display pixels 182 is controlled to the fixed ratio RWfix together with that of the background display pixels 82.

The above description has been given on the assumption that an affirmative determination is made at either Step S101 or Step S103. When a negative determination is made both at Step S101 and at Step S103, the flow proceeds to Step S1203 as illustrated in FIG. 66. At Step S1203, it is determined whether a signal from the display rejection switch 190 indicates a command to prohibit a display of the external scene image 180. When an affirmative determination is made as a result, the flow proceeds to Step S1204. Then, the control mode is set to the display prohibited second mode and a display prohibited second mode routine is executed.

Figure 68:
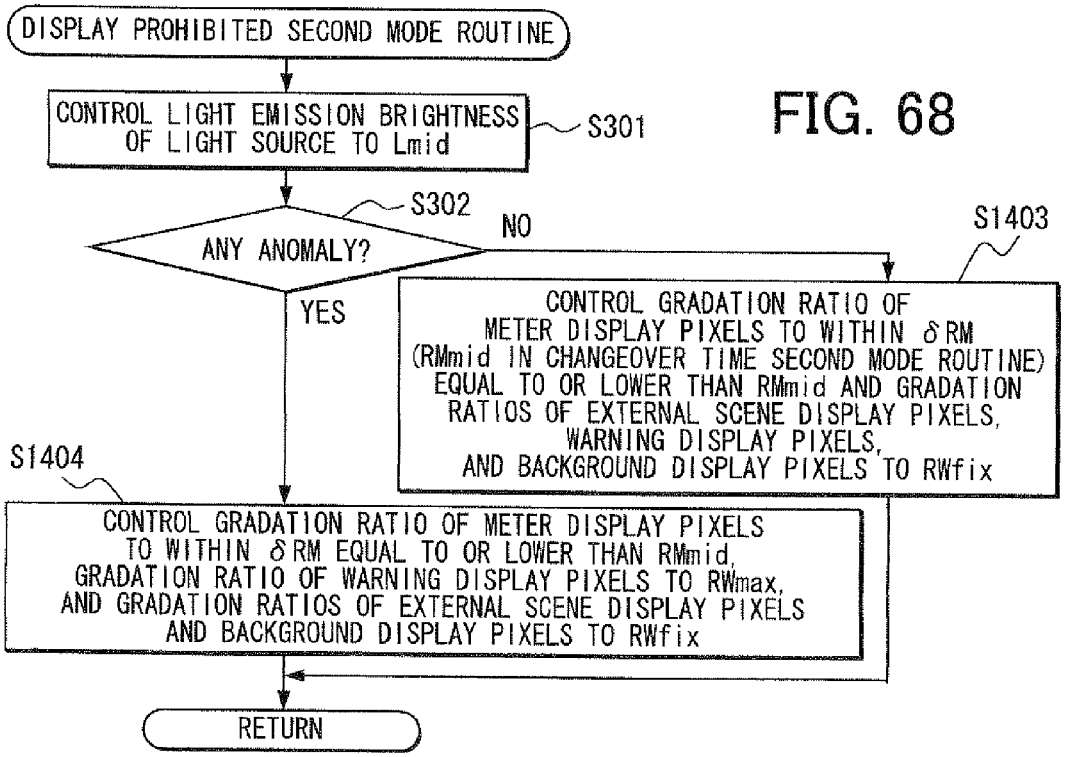
FIG. 68 is a flowchart illustrating a display prohibited second mode routine in the 17th example embodiment.

As described in detail in FIG. 68, the display prohibited second mode routine in this example embodiment is a partial modification to the second mode routine in the fourth example embodiment. A more specific description will now be given. At Step S1403 substituted for Step S403 in the fourth example embodiment, the gradation ratio of the external scene display pixels 182 is controlled to the fixed ratio RWfix together with those of the warning display pixels 72 and the background display pixels 82. At Step S1404 substituted for Step S404 in the fourth example embodiment, the gradation ratio of the external scene display pixels 182 is controlled to the fixed ratio RWfix together with that of the background display pixels 82.

The above description has been given on the assumption that an affirmative determination is made at Step S1203. When a negative determination is made at Step S1203, that is, when the signal from the display rejection switch 190 indicates a command to permit a display of the external scene image 180, the flow proceeds to Step S1205 as illustrated in FIG. 66. At Step S1205, the control mode is set to the display permitted second mode and a display permitted second mode routine is executed.

Figure 69:
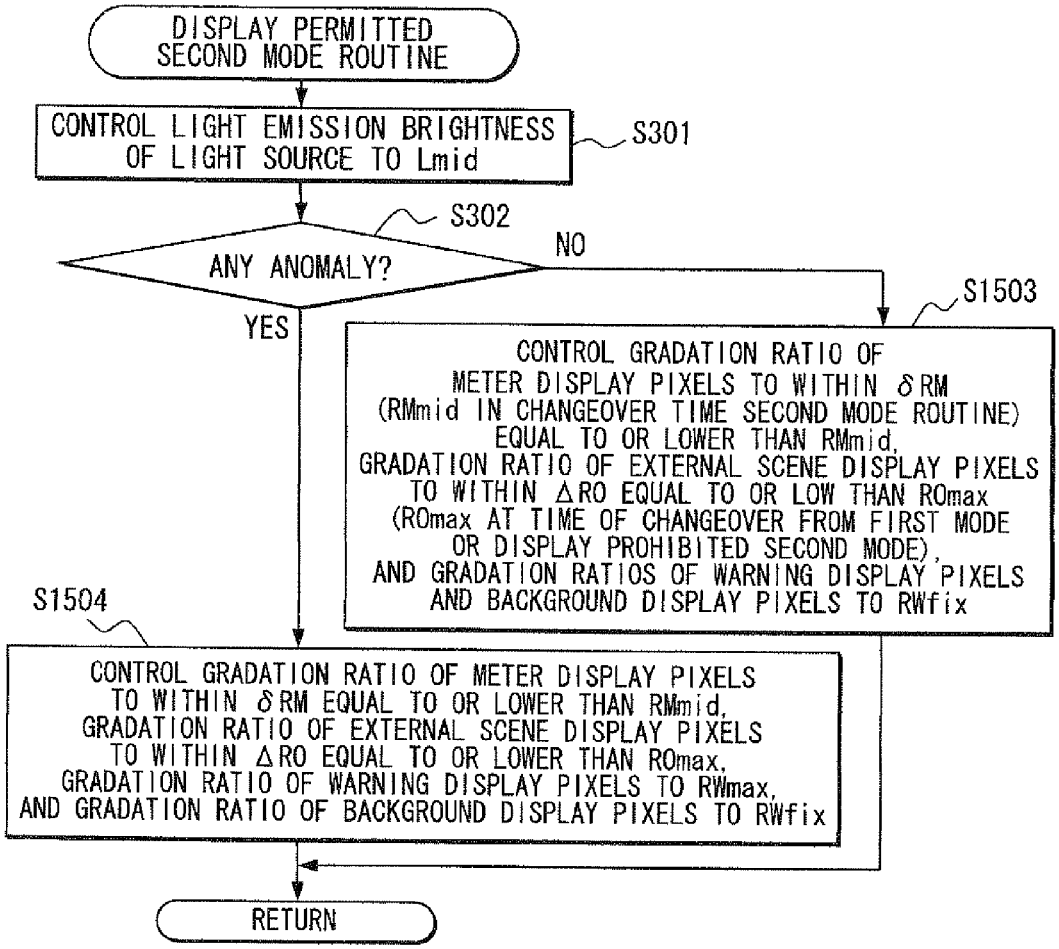
FIG. 69 is a flowchart illustrating a display permitted second mode routine in the 17th example embodiment.
Figure 70:
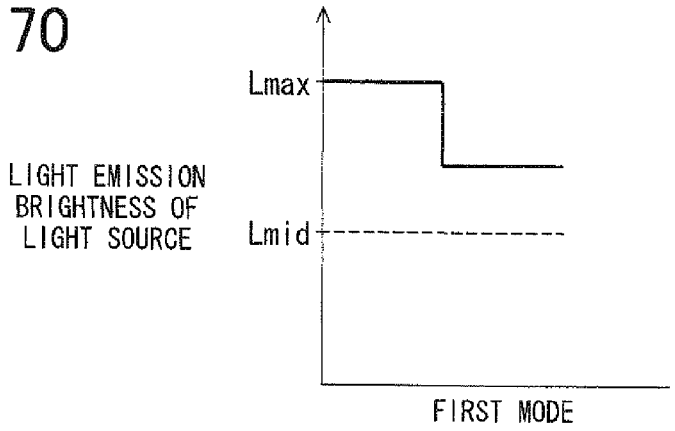
FIG. 70 is a schematic diagram illustrating the light emission brightness of a light source in a modification unique to the first to 17th example embodiment.
Figure 71:
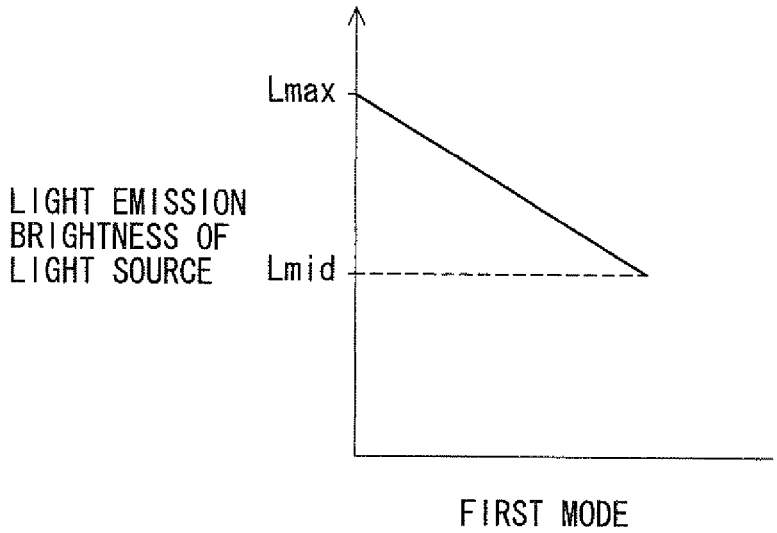
FIG. 71 is a schematic diagram illustrating the light emission brightness of a light source in a modification unique to the first to 17th example embodiment.
Figure 72:
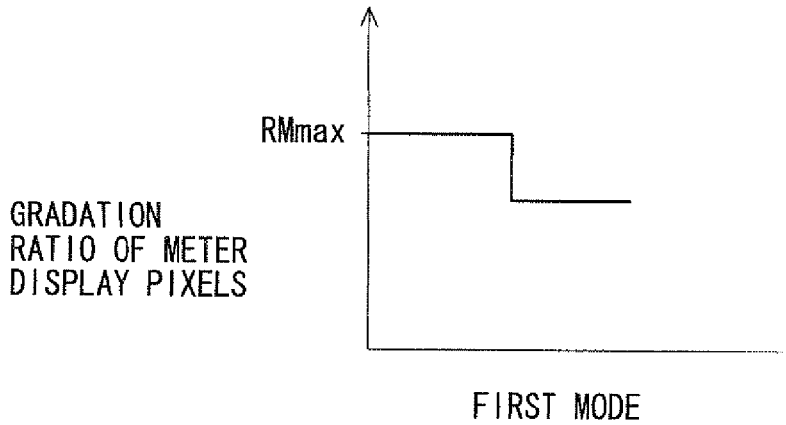
FIG. 72 is a schematic diagram illustrating the gradation ratio of meter display pixels in a modification unique to the first to 17th example embodiment.
Figure 73:
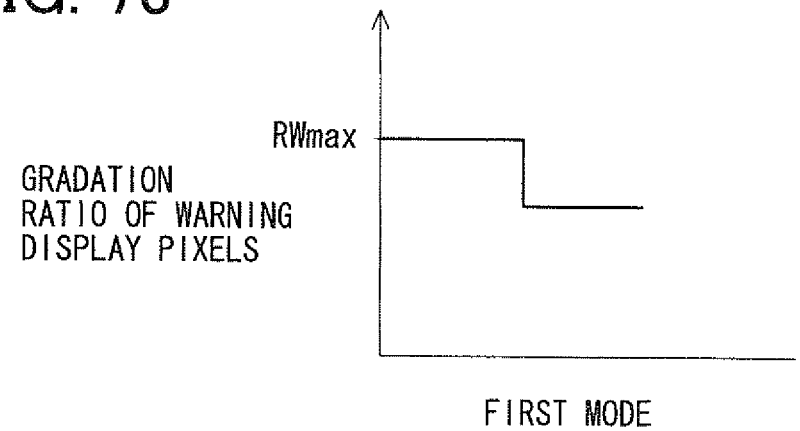
FIG. 73 is a schematic diagram illustrating the gradation ratio of warning display pixels in a modification unique to the first to 17th example embodiment.

As illustrated in detail in FIG. 69, the display permitted second mode routine in this example embodiment is achieved by partly modifying the second mode routine in the fourth example embodiment so that it is different from the above-mentioned display prohibited second mode routine. A more specific description will now be given. At Steps S1503 and S1504 substituted for Steps S403 and S404 in the fourth example embodiment, the following processing is carried out: the gradation ratio of the external scene display pixels 182 is controlled to within a range ΔRO equal to or lower than the maximum ratio ROmax according to the inputted adjustment value. However, the following processing is carried out at Step S1503 of the display permitted second mode routine executed when the flow returns to Step S101 after the execution of the first mode routine or the display prohibited second mode routine and the operation mode is changed: the gradation ratio of the external scene display pixels 182 is controlled to the maximum ratio ROmax regardless of the inputted adjustment value.

Thus, as illustrated in FIG. 66, the processing of Step S105 is carried out after the execution of any routine.

According to the 17th example embodiment described up to this point, the following can be implemented in the display permitted second mode in which the light emission brightness of the light source 40 is low: the lightness of the external scene image 180 relative to that of the meter image 60 can be increased to the occupant's taste. Therefore, it is possible to achieve the intended purpose of the external scene image 180 of alerting the occupant about the external situation ahead of the vehicle.

With respect to the 17th example embodiment, as mentioned above, the following can be thought: the external scene image 180 displayed by the external scene display pixels 182 as "particular display pixels" when the display permitted second mode is established, or at a "particular time," corresponds to "particular image"; and the meter image 60 displayed by the meter display pixels 62 as "normal display pixels" when the display permitted second mode is established and when the display prohibited second mode is established, or at a "normal time," corresponds to "normal image." With respect to the 17th example embodiment, needless to add, the following can also be thought as with respect to the fourth example embodiment: the warning image 70 displayed by the warning display pixels 72 as "particular display pixels" at a time of the occurrence of an anomaly as "particular time" corresponds to "particular image"; and the meter image 60 displayed by the meter display pixels 62 as "normal display pixels" at a time of the occurrence of an anomaly and at a normal time corresponds to "normal image."

(Modifications to First to 17th Example Embodiments)

Hereafter, description will be given to modifications specific to the first to 17th example embodiments described up to this point.

In each mode of the displaying operation, the light emission brightness of the light source 40 may be variably controlled to a level of brightness corresponding to the inputted adjustment value according to the following: a step function (FIG. 70), a linear function (FIG. 71), or any other continuous function using the light emission brightness of the light source 40 and the inputted adjustment value from the occupant as variables. In each mode of the displaying operation, further, the gradation ratio of the meter display pixels 62 at a normal time and at a time of the occurrence of an anomaly may be variably controlled to a ratio corresponding to the inputted adjustment value according to the following: a step function (FIG. 72) or a continuous function other than linear functions using the gradation ratio of the meter display pixels 62 and the inputted adjustment value from the occupant as variables. In each mode of the displaying operation, further, the gradation ratio of the warning display pixels 72 at a time of the occurrence of an anomaly may be variably controlled to a ratio corresponding to the inputted adjustment value according to the following: a step function (FIG. 73) or a continuous function other than linear functions using the gradation ratio of the warning display pixels 72 and the inputted adjustment value from the occupant as variables. FIGS. 70 to 73 illustrate examples in the first mode.

With respect to the gradation ratio of the meter display pixels 62 in the displaying operation, the following control may be carried out: in the first mode, variable control is carried out according to the inputted adjustment value from the occupant; and in the second mode (display prohibited second mode, display permitted second mode), the gradation ratio is kept constant. With respect to the gradation ratio of the warning display pixels 72 in the displaying operation, similarly, the following control may be carried out: in the first mode, variable control is carried out according to the inputted adjustment value from the occupant; and in the second mode (display prohibited second mode, display permitted second mode), the gradation ratio is kept constant. Further, with respect to the displaying operation, the following measure may be taken: in each mode, the gradation ratio of the meter display pixels 62 is kept constant; and in each mode, the gradation ratio of the warning display pixels 72 is variably controlled according to the inputted adjustment value from the occupant. Furthermore, with respect to the displaying operation, the following measure may be taken: in all the modes, the gradation ratio of the meter display pixels 62 and the gradation ratio of the warning display pixels 72 are fixed at respective predetermined ratios.

In the displaying operation in the 17th example embodiment, the following measure may be taken: an image obtained by shooting the area ahead of, behind, or lateral to the vehicle utilizing the reflected light of visible light is displayed as the external scene image 180. In the displaying operation in the 17th example embodiment, the following control may be carried out with respect to the gradation ratio of the external scene display pixels 182 in the display permitted second mode: it is variably controlled or kept constant as the gradation ratio of the warning display pixels 72 at a time of the occurrence of an anomaly in the above-mentioned first to 16th example embodiments and the like. Further, in each mode of the displaying operation in the 17th example embodiment, the following control may be carried out with respect to the gradation ratios of the meter and warning display pixels 62, 72 and the light emission brightness of the light source 40: they are variably controlled or kept constant as in the first to third and fifth to 16th example embodiments and the like mentioned above. Furthermore, in the first mode of the displaying operation in the 17th example embodiment, the following processing may be carried out when a signal from the display rejection switch 190 indicates a display permitting command: an image picked up utilizing the reflected light of visible light, for example, as mentioned above is displayed as the external scene image 180. In this case, the gradation ratio of the external scene display pixels 182 can be variably controlled or kept constant as the gradation ratio of the warning display pixels 72 at a time of the occurrence of an anomaly in the above-mentioned first to 17th example embodiments and modifications thereto.

18th Example Embodiment

As illustrated in FIGS. 74 to 77, an 18th example embodiment of the invention is a modification to the first example embodiment in the operation of the display device 1 for a vehicle. Hereafter, description will be given with a focus on a difference from the first example embodiment, and the description of the portions of the 18th embodiment which is substantially the same as that of the first example embodiment has been omitted.

Figures 74, 75:
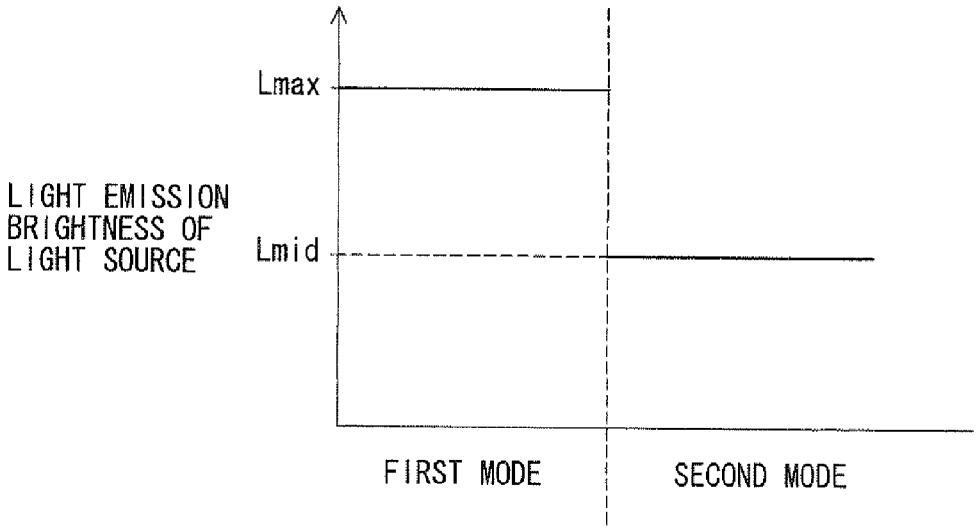
FIG. 74 is a schematic diagram illustrating the gradation values of pixels in an 18th example embodiment as an example.
FIG. 75 is a schematic diagram illustrating the light emission brightness of a light source in the 18th example embodiment.

More specific description will be given. In the 18th example embodiment, as illustrated in FIG. 74 as an example, the following measure is taken with respect to subpixels that construct one and the same pixel and express a specific tint (hue): with respect to those of these subpixels requiring density for tint expression, their gradation value is determined so that it is greater than 0 and within a range equal to or lower than the maximum value.

In the 18th example embodiment, the following image signals are supplied to the drive circuit 14: signals for selecting a gradation value determined as mentioned above with respect to a subpixel required for tint expression and selecting 0 as the gradation value of the remaining subpixels. In the following description, consequently, the gradation value of a subpixel required for tint expression of subpixels constructing pixels will be designated as "gradation value of pixels" in order to make the description easy to understand.

The above-mentioned maximum value with respect to subpixels required for tint expression is, for example, as follows: it is 63 for the subpixel R required for red color expression illustrated in FIG. 74; it is respectively 63 and 31 for the subpixels R and G required for yellow color expression illustrated in FIG. 74; and it is respectively 63, 63, 63 for the subpixels R, G, and B required for white color expression illustrated in FIG. 74.

Figure 76:
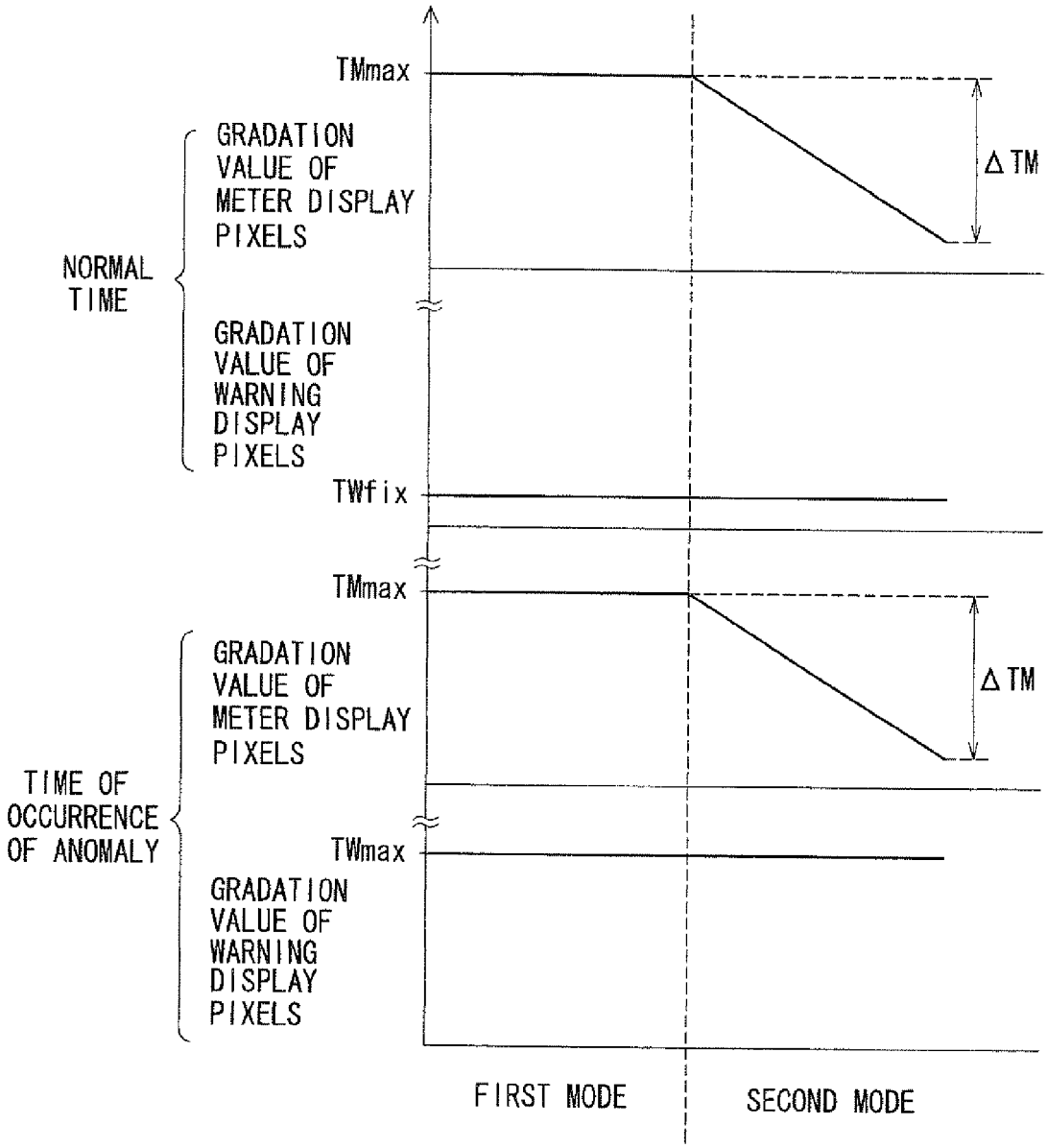
FIG. 76 is a schematic diagram illustrating the gradation values of pixels in the 18th example embodiment.
Figure 77:
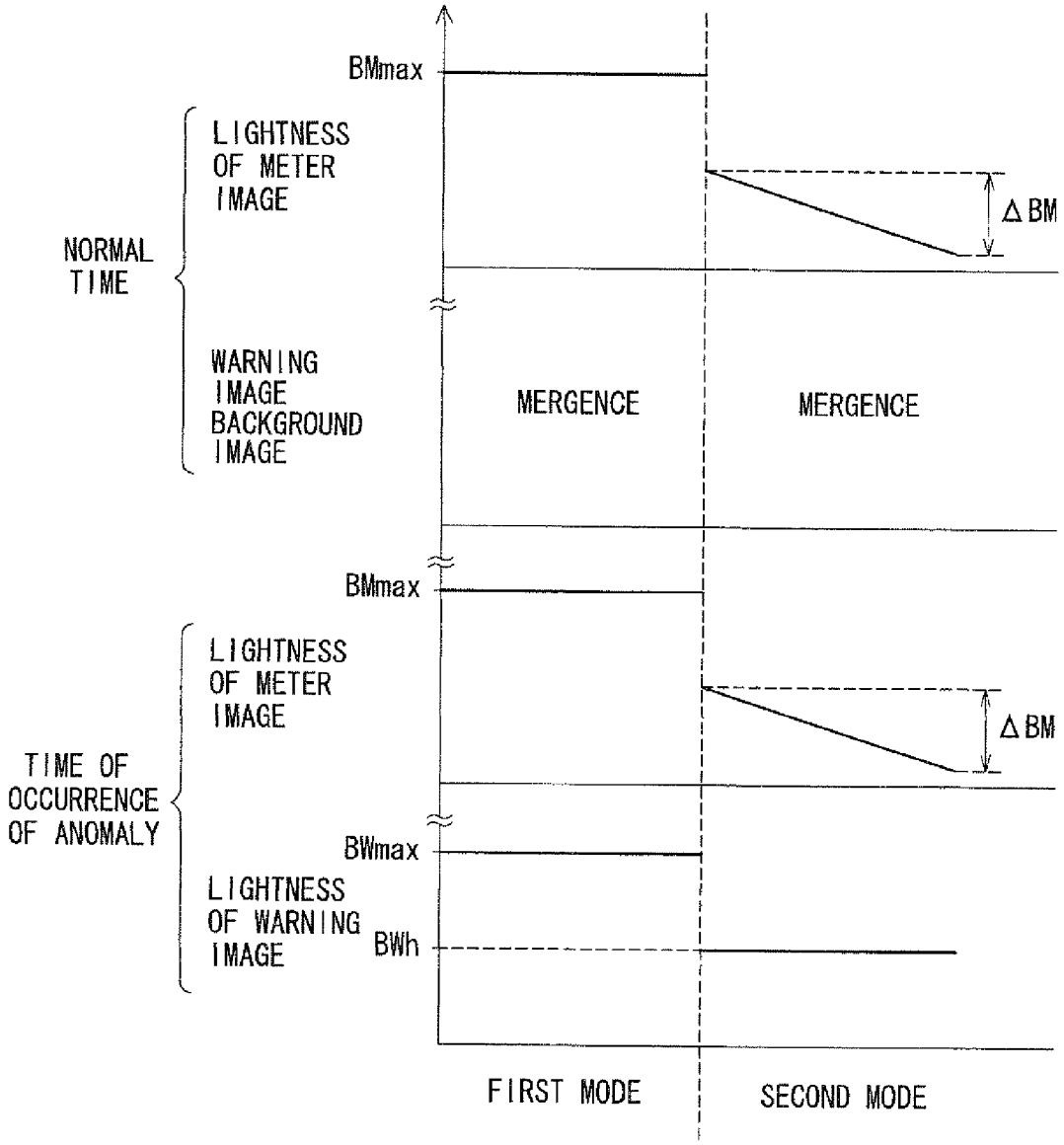
FIG. 77 is a schematic diagram illustrating the state of an image display in the 18th example embodiment.

Description will now be given to the displaying operation in the 18th example embodiment with reference to FIGS. 75 to 77. FIG. 75 illustrates the light emission brightness of the light source; FIG. 76 illustrates the gradation value of pixels; and FIG. 77 illustrates the state of an image display (lightness, etc.).

(1) First Mode

In the first mode, the control circuit 50 controls the light source 40 to carry out the following processing both at a normal time and at a time of the occurrence of an anomaly: the control circuit keeps the light emission brightness of the light source 40 at the highest level of brightness Lmax (FIG. 75); and further it controls the gradation value of the background display pixels 82 at a fixed value TWfix to keep the lightness of the background image 80 constant.

At a normal time in the first mode, the control circuit 50 carries out the following processing regardless of the inputted adjustment value from the occupant: the control circuit keeps the gradation value of the meter display pixels 62 at a maximum value TMmax (FIG. 76); and further it keeps the gradation value of the warning display pixels 72 at the same fixed value TWfix (FIG. 76) as of the background display pixels 82. At a normal time in the first mode, therefore, the meter image 60 is displayed with the maximum allowable level of lightness BMmax (FIG. 77), combined with the action of the light source 40 with the highest level of brightness Lmax. At the same time, the warning image 70 is merged into the background image 80 (FIG. 77).

At a time of the occurrence of an anomaly in the first mode, meanwhile, the control circuit 50 carries out the following processing regardless of the inputted adjustment value from the occupant: it keeps the gradation value of the meter display pixels 62 and the gradation value of the warning display pixels 72 at the respective maximum values TMmax and TWmax (FIG. 76). At a time of the occurrence of an anomaly in the first mode, therefore, the meter image 60 and the warning image 70 are displayed with the respective maximum allowable levels of lightness BMmax and BWmax (FIG. 77), combined with the action of the light source 40 with the highest level of brightness Lmax.

(2) Second Mode

In the second mode, the control circuit 50 controls the light emitting operation of the light source 40 to carry out the following processing both at a normal time and at a time of the occurrence of an anomaly: the control circuit keeps its light emission brightness at an intermediate level of brightness Lmid (FIG. 75) lower than the highest level of brightness Lmax; and further it controls the gradation value of the background display pixels 82 to the same fixed value TWfix as described under Item (1) to keep the lightness of the background image 80 constant.

At a normal time in the second mode, the control circuit 50 carries out the following processing: it variably controls the gradation value of the meter display pixels 62 to a value corresponding to the inputted adjustment value from the occupant within a range ΔTM (FIG. 76) equal to or lower than the maximum value TMmax. At the same time, it keeps the gradation value of the warning display pixels 72 at the same fixed value TWfix (FIG. 76) as of the background display pixels 82 regardless of the inputted adjustment value. At a normal time in the second mode, therefore, the lightness of the meter image 60 is reduced to the occupant's desired lightness ΔBM (FIG. 77), combined with the action of the light source 40 with the intermediate level of brightness Lmid. At the same time, the warning image 70 is merged into the background image 80 (FIG. 77).

At a time of the occurrence of an anomaly in the second mode, meanwhile, the control circuit 50 carries out the following processing: it variably controls the gradation value of the meter display pixels 62 to a value corresponding to the inputted adjustment value from the occupant within the range ΔTM (FIG. 76) equal to or lower than the maximum value TMmax. Further, it keeps the gradation value of the warning display pixels 72 at the maximum value TWmax (FIG. 76) regardless of the inputted adjustment value. At a time of the occurrence of an anomaly in the second mode, therefore, the lightness of the meter image 60 is reduced to the occupant's desired lightness ΔBM (FIG. 77), combined with the action of the light source 40 with the intermediate level of brightness Lmid. But the lightness of the warning image 70 is kept at a level of lightness BWh (FIG. 77) that is the maximum level under the intermediate level of brightness Lmid. The lightness BWh is set to the highest possible value so that the warning image 70 can be easily viewed under the intermediate level of brightness Lmid.

(3) Mode Change (3-1) Changeover from First Mode to Second Mode

When the control circuit 50 changes the control mode from the first mode to the second mode, it carries out the following processing: the control circuit controls the light emitting operation of the light source 40 to cause its light emission brightness to transition from the highest level of brightness Lmax to the intermediate level of brightness Lmid described under Item (2). At the same time, the control circuit 50 holds the following values as follows: it keeps the gradation value of the meter display pixels 62 at the maximum value TMmax and the gradation values of the warning display pixels 72 and the background display pixels 82 at the fixed value TWfix described under Item (1). At a time of changeover from the first mode to the second mode, therefore, the lightness of the entire screen 12 displaying the meter image 60 is reduced by an amount equivalent to the reduction in the light emission brightness of the light source 40.

(3-2) Changeover from Second Mode to First Mode

When the control circuit 50 changes the control mode from the second mode to the first mode, it carries out the following processing: the control circuit controls the light emitting operation of the light source 40 to cause its light emission brightness from the intermediate level of brightness Lmid described under Item (2) to the highest level of brightness Lmax. At the same time, the control circuit 50 controls the gradation value of the meter display pixels 62 to the maximum value TMmax. Further, it keeps the gradation value of the warning display pixels 72 and the gradation value of the background display pixels 82 at the fixed value TWfix described under Item (2). At a time of changeover from the second mode to the first mode, therefore, the lightness of the entire screen 12 displaying the meter image 60 is increased by an amount equivalent to the increase in the light emission brightness of the light source 40.

Figure 78:
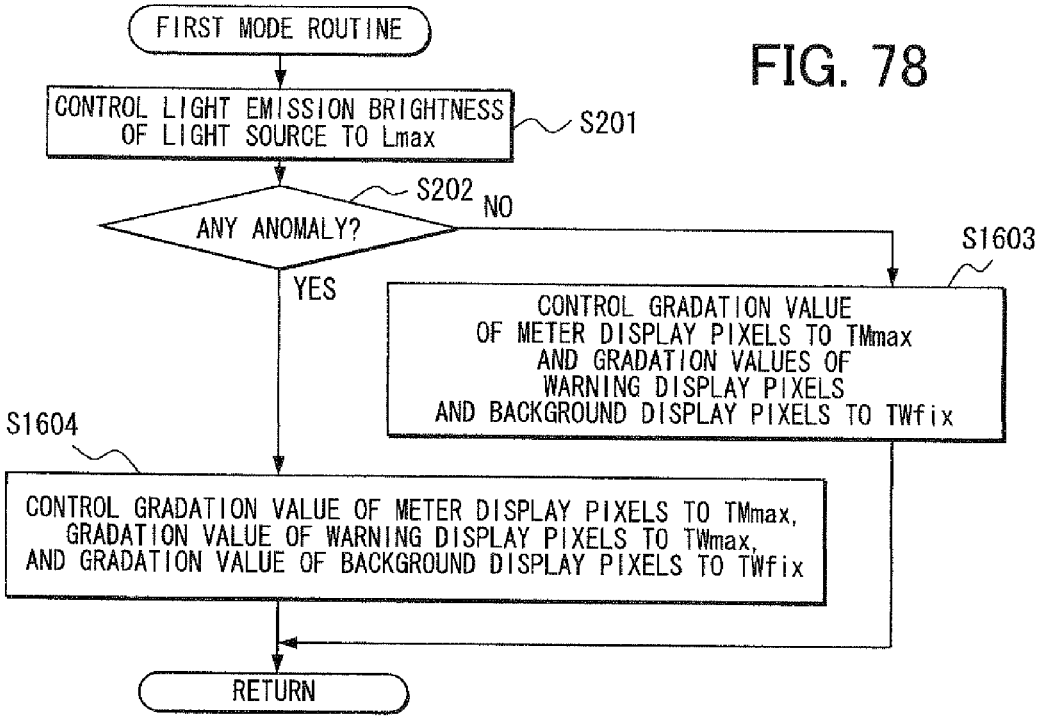
FIG. 78 is a flowchart illustrating a first mode routine in the 18th example embodiment.
Figure 79:
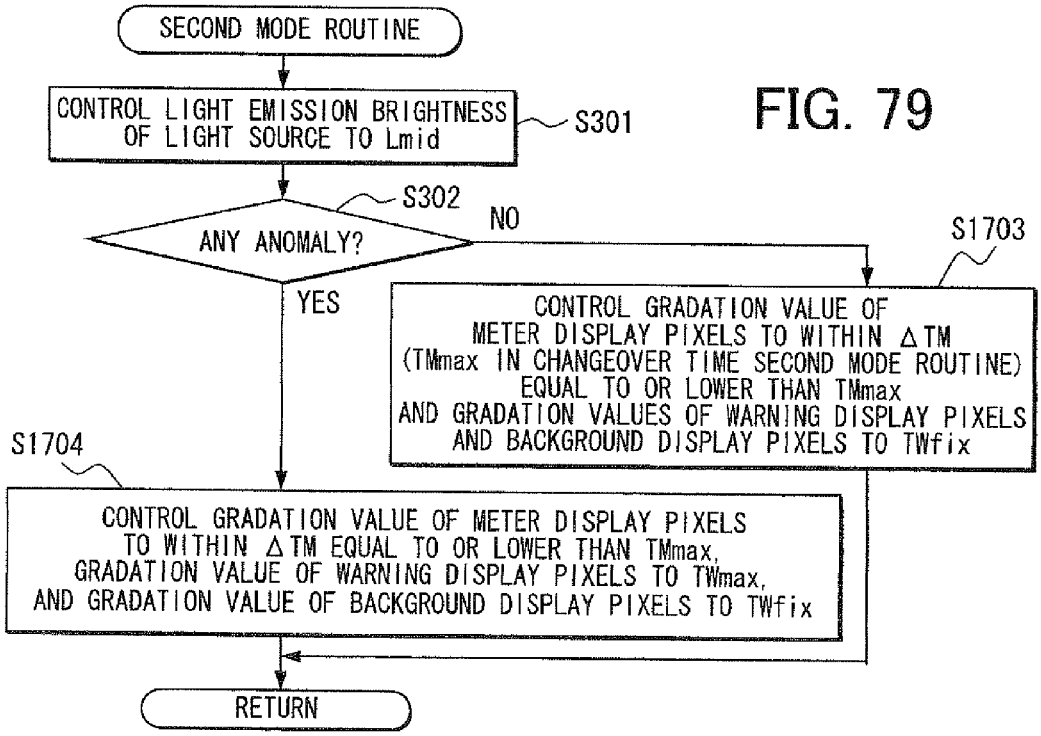
FIG. 79 is a flowchart illustrating a second mode routine in the 18th example embodiment.

Description will now be provided for the flow of control in the 18th example embodiment with reference to FIGS. 78 and 79.

In the control flow in this example embodiment, the processing of Steps S101 to S105 is carried out as in that in the first example embodiment. The details of the first mode routine at Step S102 are as illustrated in FIG. 78. A more specific description will now be given. At a normal time, or when a negative determination is made at Step S202, the following processing is carried out at Step S1603: the gradation value of the meter display pixels 62 is controlled to the maximum value TMmax; and further the gradation value of the warning display pixels 72 and the gradation value of the background display pixels 82 are controlled to the fixed value TWfix. As a result, the meter image 60 with the maximum allowable level of lightness BMmax is encircled with the background image 80 and is thereby prominently displayed. At the same time, the warning image 70 is merged into the background image 80 and cannot be viewed.

Meanwhile, at a time of the occurrence of an anomaly, or when an affirmative determination is made at Step S202, the flow proceeds to Step S1604. Then, the gradation values of the meter display pixels 62 and the warning display pixels 72 are respectively controlled to the maximum values TMmax and TWmax, and further the gradation value of the background display pixels 82 is controlled to the fixed value TWfix. As a result, the meter image 60 and the warning image 70 with the respective maximum allowable levels of lightness BMmax and BWmax are encircled with the background image 80, and are thereby prominently displayed.

The details of the second mode routine at Step S104 in this example embodiment are as illustrated in FIG. 79. A more specific description will now be given. At a normal time, or when a negative determination is made at Step S302, the following processing is carried out at Step S1703: the gradation value of the meter display pixels 62 is controlled to within a range ΔTM equal to or lower than the maximum value TMmax according to the inputted adjustment value indicated by a signal from the liquid crystal adjustment switch 53. At Step S1703, at the same time, the gradation value of the warning display pixels 72 and the gradation value of the background display pixels 82 are controlled to the fixed value TWfix. As a result, the meter image 60 with its lightness reduced according to the inputted adjustment value is displayed amid the background image 80 and further the warning image 70 is merged into the background image 80 and cannot be viewed.

At Step S1703 of the changeover time second mode routine, however, the following processing is carried out regardless of the inputted adjustment value: the gradation value of the meter display pixels 62 is controlled to the maximum value TMmax. Thus, the following takes place at a time of changeover from the first mode to the second mode: the lightness of the entire screen 12 displaying the meter image 60 is reduced by an amount equivalent to the reduction in the light emission brightness of the light source 40 at Step S301.

At a time of the occurrence of an anomaly, or when an affirmative determination is made, conversely to such a normal time, at Step S302, the flow proceeds to Step S1704. Then, the gradation value of the meter display pixels 62 and the gradation value of the background display pixels 82 are controlled as at Step S1703 above. Meanwhile, the gradation value of the warning display pixels 72 is controlled to the maximum value TWmax. As a result, the meter image 60 with its lightness reduced according to the inputted adjustment value is displayed amid the background image 80. At the same time, the warning image 70 with a level of lightness BWh that the maximum level under the intermediate level of brightness Lmid regardless of the inputted adjustment value is encircled with the background image 80 and is thereby prominently displayed.

According to the 18th example embodiment described up to this point, the following can be implemented in the second mode in which the light emission brightness of the light source 40 is low: the gradation value of the meter display pixels 62 for displaying the meter image 60 can be varied within as wide a range as the maximum value or below. Therefore, it is possible to reduce the lightness of the meter image 60 and yet enhance the degree of freedom in its adjustment as much as possible.

19th Example Embodiment

Figure 80:
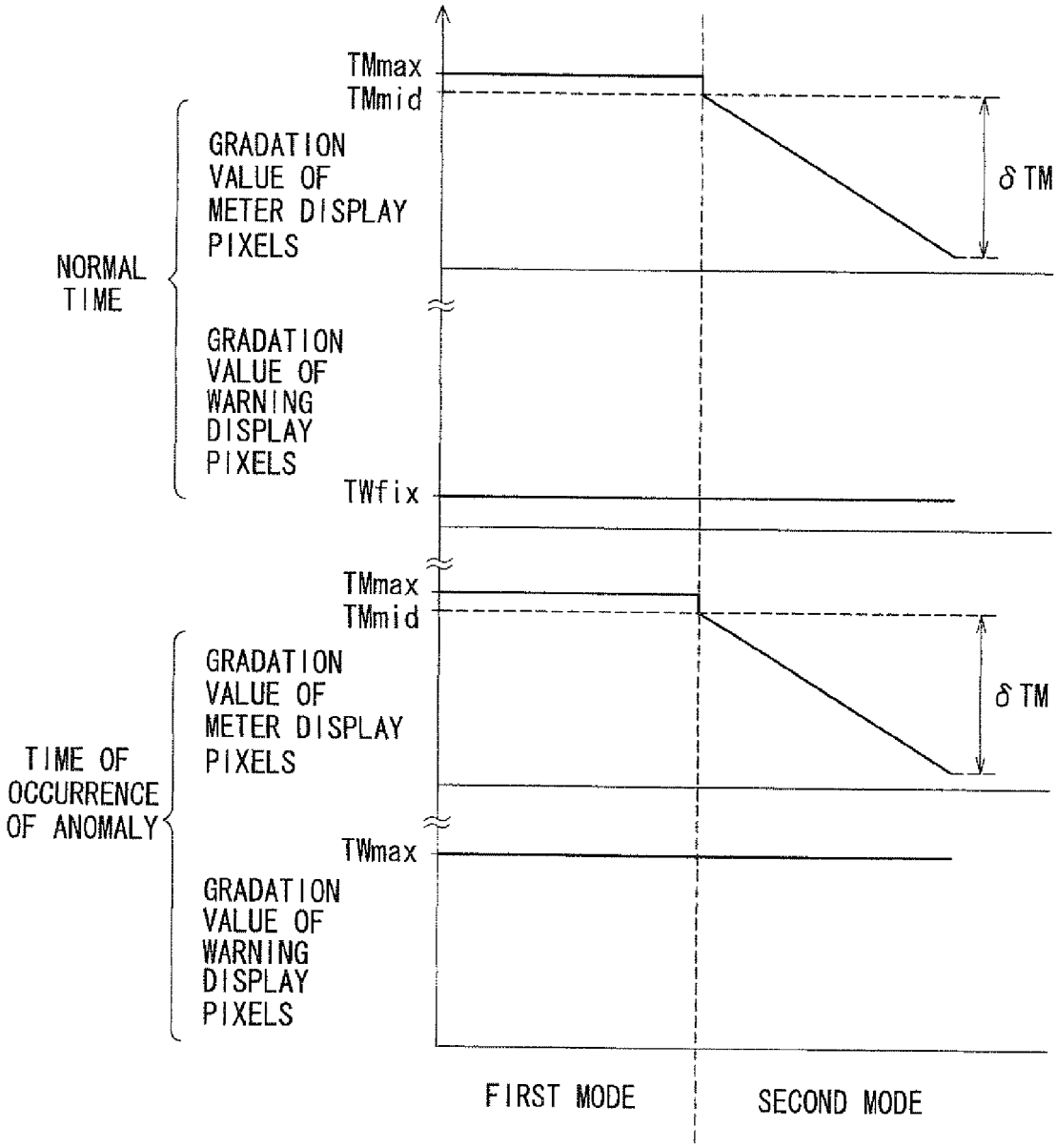
FIG. 80 is a schematic diagram illustrating the gradation values of pixels in a 19th example embodiment.
Figure 81:
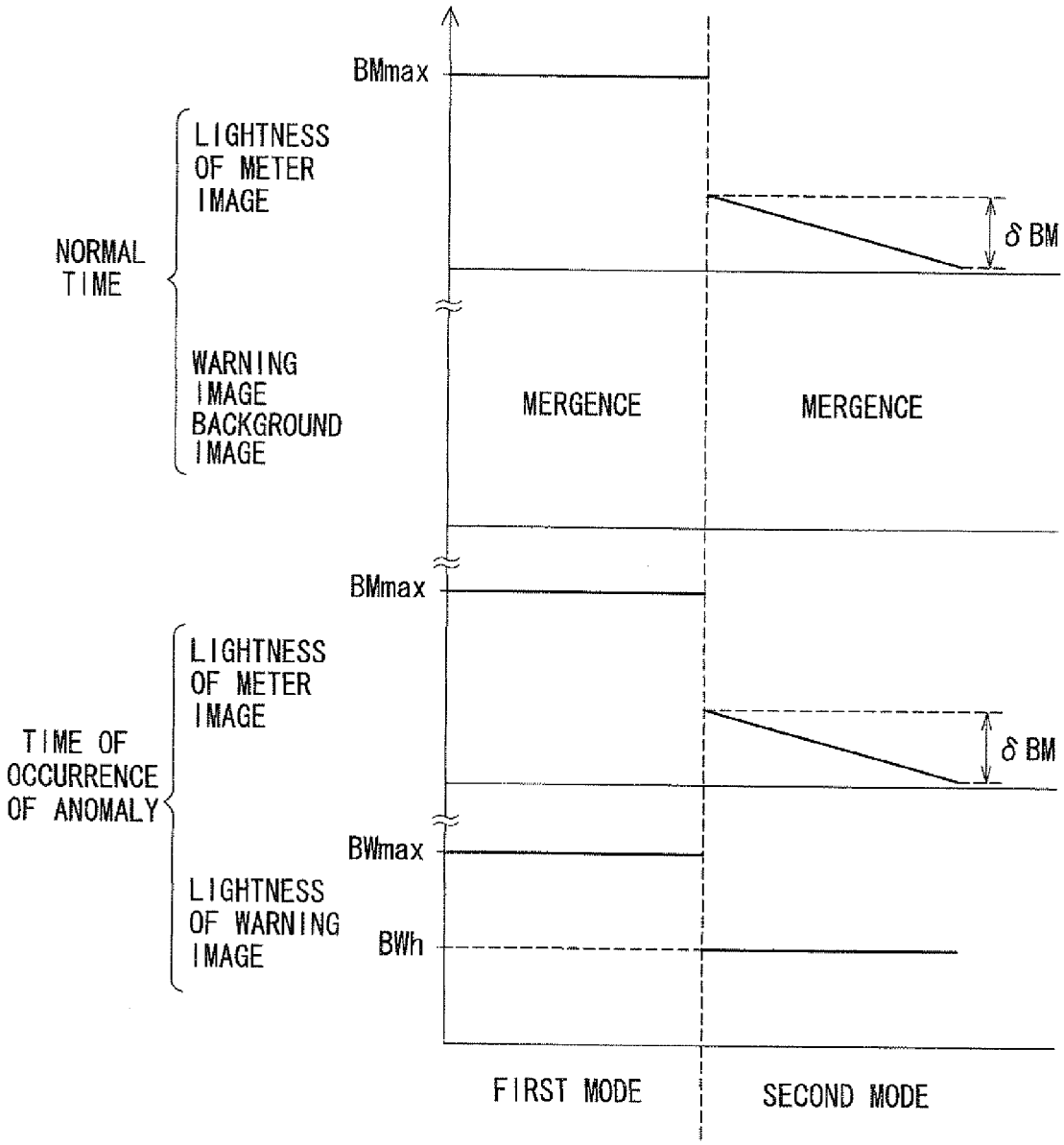
FIG. 81 is a schematic diagram illustrating the state of an image display in the 19th example embodiment.

As illustrated in FIGS. 80 and 81, a 19th example embodiment of the invention is a modification to the 18th example embodiment in the displaying operation of the display device 1 for a vehicle. Hereafter, description will be given with a focus on a difference from the 18th example embodiment, and the description of the portions of the 19th embodiment which is substantially the same as that of the 18th example embodiment has been omitted.

A more specific description will now be given. At a time of changeover from the first mode to the second mode, the control circuit 50 carries out the following processing: it controls the light emission brightness of the light source 40 and the gradation values of the pixels 72, 82 as in the 18th example embodiment; however, it reduces the gradation value of the meter display pixels 62 from the maximum value TMmax to an intermediate value TMmid (FIG. 80). This intermediate value TMmid is set to a gradation value lower than the maximum value TMmax by an amount equivalent to, for example, one grade of the adjustment value for the lightness of the meter image 60.

At this changeover time, therefore, the lightness of the entire screen 12 displaying the meter image 60 is additionally reduced by an amount equivalent to the reduction in the gradation value of the meter display pixels 62 added to an amount equivalent to the reduction in the light emission brightness of the light source 40. At a normal time and at a time of the occurrence of an anomaly in the second mode after mode change, the control circuit 50 carries out the following processing: it variably controls the gradation value of the meter display pixels 62 within a range δTM (FIG. 80) equal to or lower than the intermediate value TMmid according to the inputted adjustment value from the occupant; and it thereby reduces the lightness of the meter image 60 to the occupant's desired lightness δBM (FIG. 81).

Figure 82:
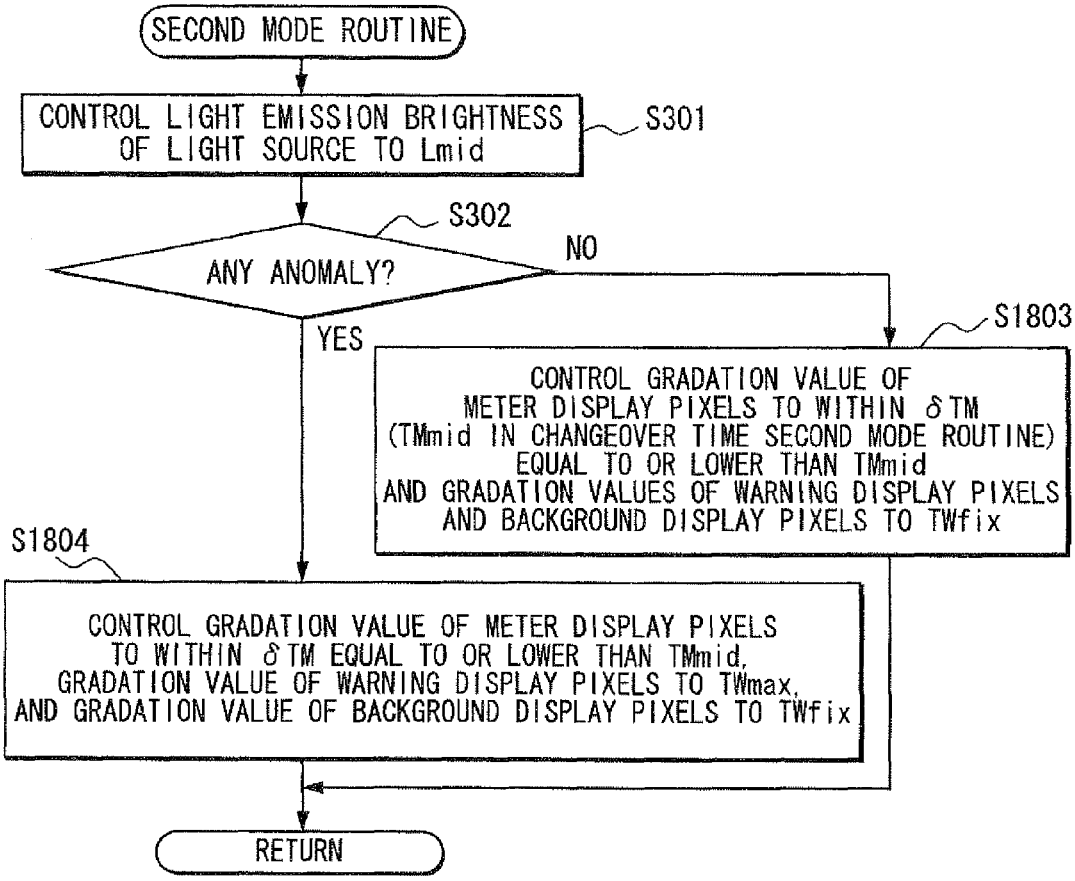
FIG. 82 is a flowchart illustrating a second mode routine in the 19th example embodiment.

In the control flow of the second mode routine in the above-mentioned 19th example embodiment, the following processing is carried out by the processing of Steps S1803 and S1804 substituted for Steps S1703 and S1704 in the 18th example embodiment as illustrated in FIG. 82: the gradation value of the meter display pixels 62 at a normal time and at a time of the occurrence of an anomaly is controlled to within the range δTM equal to or lower than the intermediate value TMmid according to the inputted adjustment value. At Step S1803 of the changeover time second mode routine, however, the gradation value of the meter display pixels 62 is controlled to the intermediate value TMmid regardless of the inputted adjustment value.

According to the 19th example embodiment described up to this point, the following can be implemented at a time of changeover from the first mode to the second mode: the lightness of the meter image 60 can be varied by an amount equivalent to the reduction in the gradation value of the meter display pixels 62 added to an amount equivalent to the reduction in the light emission brightness of the light source 40. Therefore, a display can be provided with a noticeable sharp contrast before and after mode change.

20th Example Embodiment

Figure 83:
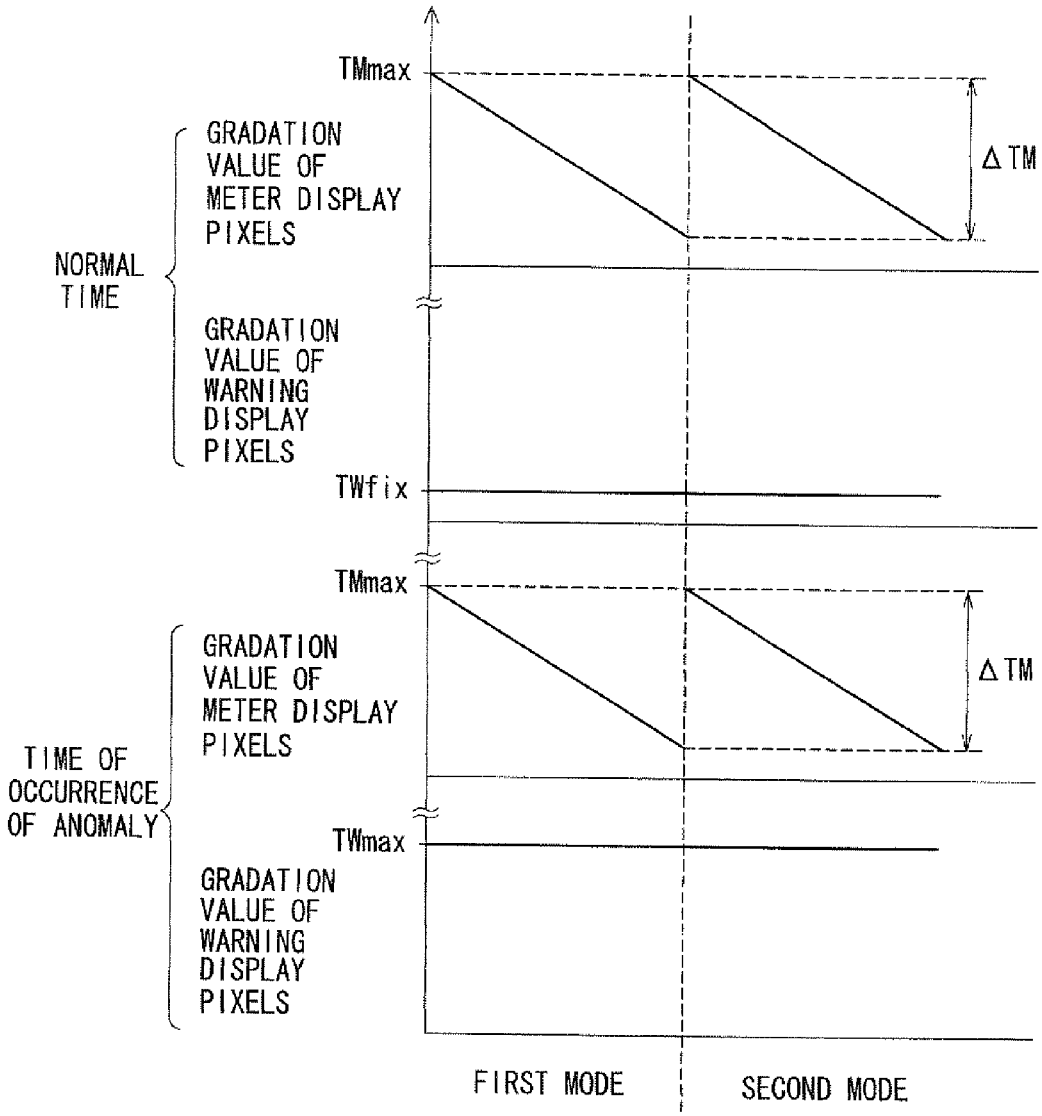
FIG. 83 is a schematic diagram illustrating the gradation values of pixels in a 20th example embodiment.
Figure 84:
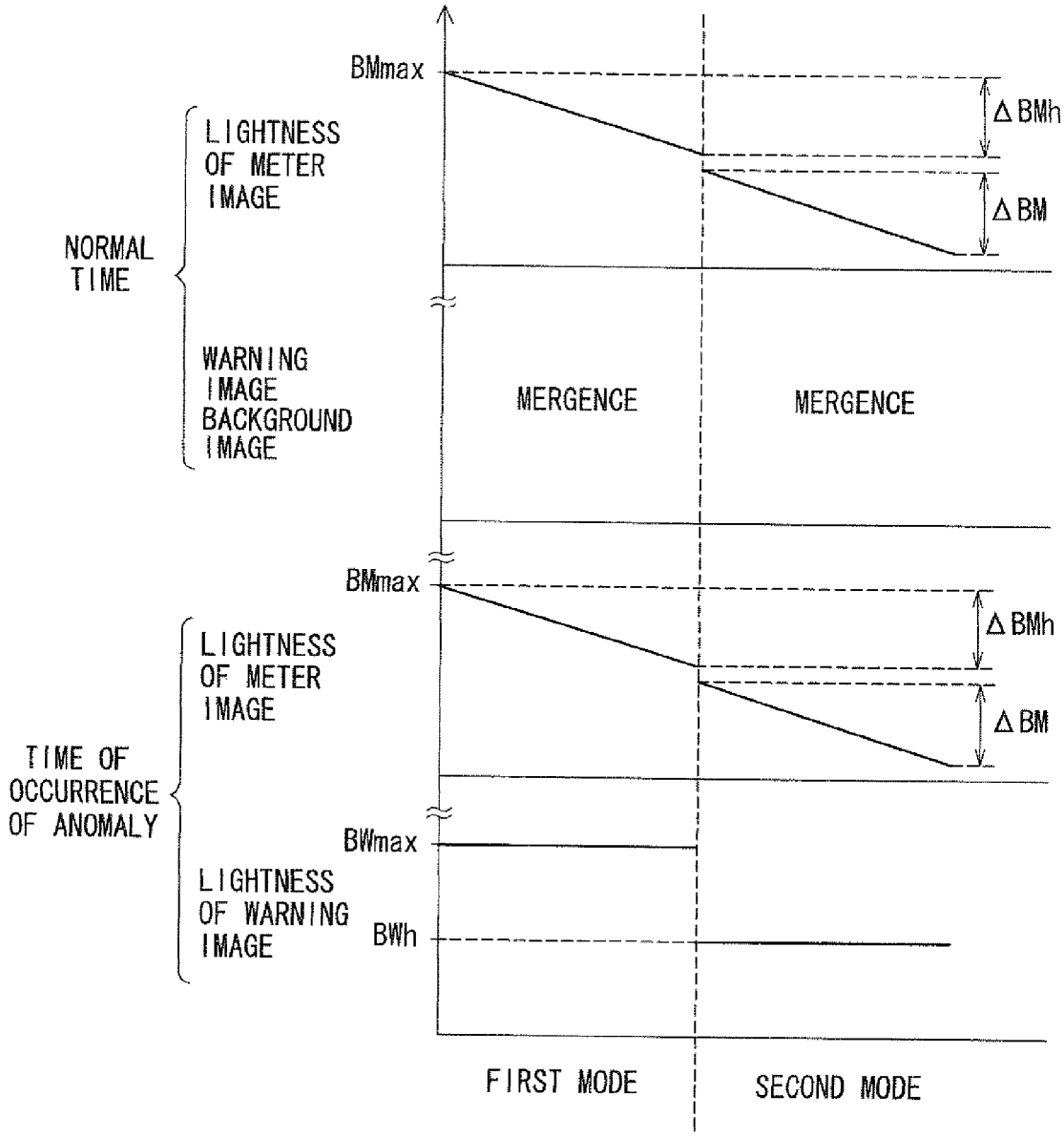
FIG. 84 is a schematic diagram illustrating the state of an image display in the 20th example embodiment.

As illustrated in FIGS. 83 and 84, a 20th example embodiment of the invention is a modification to the 18th example embodiment in the displaying operation of the display device 1 for a vehicle. Hereafter, description will be given with a focus on a difference from the 18th example embodiment, and the description of the portions of the 20th embodiment which is substantially the same as that of the 18th example embodiment has been omitted.

More specific description will be given. In the first mode, the control circuit 50 controls the light emission brightness of the light source 40 and the gradation values of the pixels 72, 82 as in the 18th example embodiment. However, it controls the gradation value of the meter display pixels 62 as in the second mode. In the first mode, specifically, the control circuit 50 carries out the following processing both at a normal time and at a time of the occurrence of an anomaly: it variably controls the gradation value of the meter display pixels 62 within a range ΔTM (FIG. 83) equal to or lower than the maximum value TMmax according to the inputted adjustment value from the occupant. Therefore, the occupant's desired lightness ΔBMh (FIG. 84) is achieved as the lightness of the meter image 60.

In the 20th example embodiment, the gradation value of the meter display pixels 62 is controlled to the maximum value TMmax in at a time of changeover from the first mode to the second mode and at a time of changeover in the opposite direction. Instead, any other control method may be adopted. For example, the gradation value of the meter display pixels 62 may be controlled and kept at a value immediately before mode change. Alternatively, the gradation value of the meter display pixels 62 may be controlled to a value set beforehand by the occupant using the liquid crystal adjustment switch 53 or the like or a value preset before product shipment.

Figure 85:
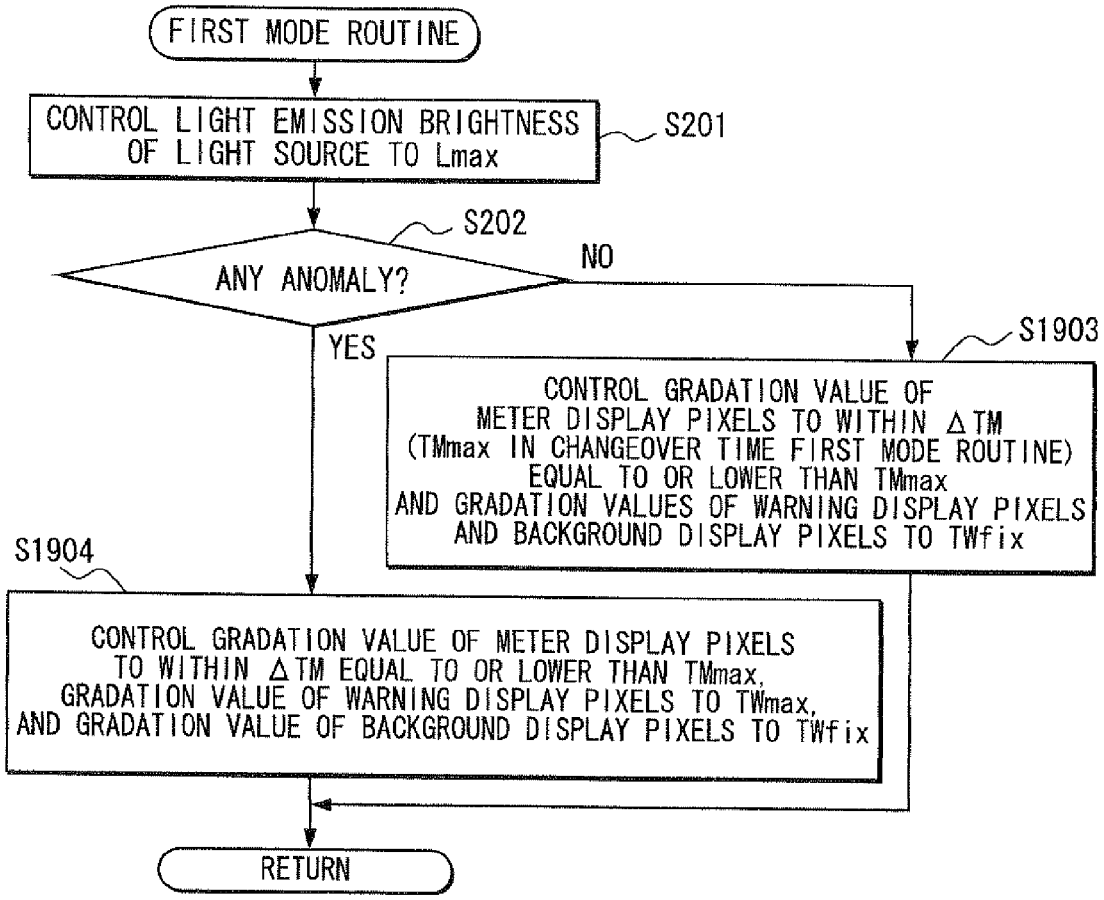
FIG. 85 is a flowchart illustrating a first mode routine in the 20th example embodiment.

In the control flow of the first mode routine in the above-mentioned 20th example embodiment, the following is implemented by the processing of Steps S1903 and S1904 substituted for Steps S1603 and S1604 in the 18th example embodiment as illustrated in FIG. 85: the gradation value of the meter display pixels 62 at a normal time and at a time of the occurrence of an anomaly is controlled to within the range ΔTM equal to or lower than the maximum value TMmax according to the inputted adjustment value. However, the following processing is carried out at Step S1903 of the changeover time first mode routine regardless of the inputted adjustment value: the gradation value of the meter display pixels 62 is controlled to the maximum value TMmax.

According to the 20th example embodiment described up to this point, the following can be implemented not only in the second mode but also in the first mode: the gradation value of the meter display pixels 62 can be varied within as wide a range as the maximum value or below, and the lightness of the meter image 60 displayed by the meter display pixels 62 can be adjusted with a high degree of freedom. Therefore, a display of the meter image 60 tailored to the occupant's taste can be achieved anytime.

(Modifications to 18th to 20th Example Embodiments)

Hereafter, description will be provided for modifications specific to the 18th to 20th example embodiments described up to this point.

The gradation values of the warning display pixels 72 and the background display pixels 82 may be controlled as follows: they may be reduced at a time of changeover from the first mode to the second mode as the gradation value of the meter display pixels 62 in the 19th example embodiment. With respect to the gradation values of the warning display pixels 72 and the background display pixels 82, the following may be implemented: in the first mode, variable control according to the inputted adjustment value from the occupant may be carried out as the gradation value of the meter display pixels 62 in the 20th example embodiment.

Other Example Embodiments

Up to this point, description has been given to multiple example embodiments and modifications thereto. However, the invention should not be construed with its subject matter limited to these example embodiments, and can be applied to various example embodiments without departing from the subject matter.

More specific description will now be given. The invention may be so modified that the following is implemented: a vehicle status value, for example, a number of engine revolutions, a remaining quantity of fuel, or the water temperature of engine cooling water, other than vehicle speed is detected by the status value sensor 54; and this vehicle status value other than vehicle speed is indicated by the meter image 60. Further, the invention may be so modified that the following is implemented: an anomaly other than water temperature anomaly is detected by the anomaly sensor 55 and a warning is given by the warning image 70 about this anomaly other than water temperature anomaly. Examples of such anomalies include empty anomaly related to a remaining quantity of fuel and wheel lock anomaly triggering an ABS system. The image 70 may be a "particular image" displayed, for example, when the ignition switch is turned on or on any other occasion as a "particular time" than a time of the occurrence of an anomaly.

With respect to the displaying operation, the invention may be so modified that the following is implemented regardless of a signal from the illuminance sensor 56: when a signal indicating the all lamps off position is received from the light switch 52, the first mode is established; and when a signal indicating the position lamp on position or the headlamp on position is received, the second mode (display prohibited second mode, display permitted second mode) is established. Conversely, the invention may be so modified that the following is implemented regardless of a signal from the light switch 52: when a signal indicating an outside light intensity exceeding the threshold value I is received from the illuminance sensor 56, the first mode is established; and when a signal indicating an outside light intensity equal to or lower than the threshold value I is received, the second mode (display prohibited second mode, display permitted second mode) is established.

When gradation control is carried out so that the warning image 70 or the external scene image 180 is merged into the background image 80 in the displaying operation, the following processing is usually performed in the liquid crystal panel 10: the thin film transistor corresponding to an electrode of each subpixel of the warning display pixels 72 or the external scene display pixels 182 is constantly energized to keep the liquid crystal corresponding to a relevant portion in on state. Instead, the following processing may be carried out to merge the warning image 70 or the external scene image 180 into the background image 80: energization of the thin film transistor corresponding to an electrode of each subpixel of the warning display pixels 72 or the external scene display pixels 182 is interrupted to bring the liquid crystal corresponding to the relevant portion into off state.

Aside from a combination of the light emission diode 42 and the diffuser panel 44, other various light sources whose light emission brightness is adjustable can be used as the light source 40. Aside from a transmissive liquid crystal panel, a reflective liquid crystal panel may be used as the liquid crystal panel 20. In this case, for example, a light source 40 so constructed as to illuminate the liquid crystal panel 20 from front by reflection can be used. The liquid crystal adjustment switch 53 need not have a construction such that the adjustment value of lightness can be inputted stepwise, and it may have a construction such that the adjustment value of lightness can be continuously inputted.

The invention is also applicable to devices other than display devices for a vehicle that function as a combination meter. For example, it can be applied to devices that function as a headup display so constructed as to display a display image of a liquid crystal panel on a combiner as a virtual image.

The above disclosure includes the following aspects.

The first aspect is a display device for a vehicle including: a liquid crystal panel for displaying an image in a vehicle; a light source for illuminating the liquid crystal panel by light emission; and a controller for controlling the liquid crystal panel and the light source. The liquid crystal panel includes: particular display pixels used to display a particular image at a particular time; and normal display pixels used to display a normal image at a normal time when a particular image is not displayed by the particular display pixels and at a particular time. The controller controls the ratio of the gradation value of the normal display pixels to a set gradation value of the normal display pixels as the gradation ratio of the normal display pixels. Further, it controls the ratio of the gradation value of the particular display pixels to a set gradation value of the particular display pixels as the gradation ratio of the particular display pixels. The controller sets as control mode a first mode in which the light source is caused to emit light and a second mode in which the light source is caused to emit light with a lower level of brightness than in the first mode. In the first mode, the controller sets the gradation ratio of the normal display pixels and the gradation ratio of the particular display pixels at a particular time to a maximum ratio. In the second mode, the controller carries out the gradation processing of making the gradation ratio of the particular display pixels at a particular time higher than the gradation ratio of the normal display pixels.

Thus, in the first mode, the respective gradation ratios of the normal display pixels and the particular display pixels at a particular time are set to a maximum ratio. In the gradation processing in the second mode, the gradation ratio of the particular display pixels at a particular time becomes higher than the gradation ratio of the normal display pixels. Therefore, in the gradation processing in the second mode in which the light emission brightness of the light source is lower than in the first mode, the following can be implemented: with respect to a normal image displayed by the normal display pixels both at a normal time and at a particular time, its lightness can be reduced to enhance its visibility. In the second mode, meanwhile, the following can be implemented in the gradation processing: with respect to a particular image displayed by the particular display pixels at a particular time, a certain level of lightness can be ensured to achieve the purpose of its display. According to the foregoing, it is possible to appropriately display both a normal image with higher priority given to visibility and a particular image with higher priority given to the attaining of the purpose of its display.

A set gradation value on which the gradation ratio of the normal display pixels is based and a set gradation value on which the gradation ratio of the particular display pixels is based may be different from each other or may be identical with each other.

As an alternative, the controlling means performs the following in the gradation processing in the second mode: it makes variable the gradation ratio of the normal display pixels and further keeps constant the gradation ratio of the particular display pixels at a particular time. Therefore, in the gradation processing in the second mode in which the light emission brightness of the light source is low, the following can be implemented: the gradation ratio of the normal display pixels can be varied to appropriately reduce the lightness of a normal image; and further the gradation ratio of the particular display pixels can be kept constant to ensure a certain level of lightness of the particular image regardless of the lightness of the normal image. Therefore, it is possible to increase the lightness of a particular image relative to that of a normal image to achieve the intended purpose of a display of the particular image.

As an alternative, the display device for a vehicle includes an inputting element for accepting input from an occupant of the vehicle. The inputting element accepts an adjustment value for adjusting the lightness of images including a particular image and a normal image as input. In the gradation processing in the second mode, the controller reduces the gradation ratio of the normal display pixels from a set ratio in response to change in the inputted adjustment value. Further, it keeps the gradation ratio of the particular display pixels at a particular time at the set ratio. According to the foregoing, the gradation ratio of the normal display pixels can be reduced to a value lower than the gradation ratio of the particular display pixels without fail according to the inputted adjustment value from the occupant. Therefore, it is possible to tailor the lightness of a normal image to the occupant's taste without failure to achieve the purpose of a display of the particular image.

As an alternative, the controlling means carries out main gradation processing as the gradation processing and sub gradation processing in the second mode according to the inputted adjustment value. In the sub gradation processing, the gradation ratio of the normal display pixels is increased from the same set ratio as in the main gradation processing in response to change in the inputted adjustment value from the occupant. In addition, the gradation ratio of the particular display pixels at a particular time is kept at the set ratio, and the gradation ratio of the particular display pixels at a particular time is thereby made lower than the gradation ratio of the normal display pixels. According to the foregoing, it is possible for the occupant to select which to carry out: to reduce the gradation ratio of the normal display pixels to a value lower than the gradation ratio of the particular display pixels according to the inputted adjustment value from the occupant; or to increase the gradation ratio of the normal display pixels to a value higher than the gradation ratio of the particular display pixels according to the inputted adjustment value. Therefore, it is possible to cope with not only cases where the lightness of a normal image is reduced to ensure its visibility but also cases where a normal image is lightly displayed to the occupant's taste.

As an alternative, the controller carries out the following in the gradation processing in the second mode: it keeps constant both the gradation ratio of the normal display pixels and the gradation ratio of the particular display pixels at a particular time. Therefore, in the gradation processing in the second mode in which the light emission brightness of the light source is low, the gradation ratio of the particular display pixels can be kept higher than the gradation ratio of the normal display pixels. As a result, it is possible to constantly increase the lightness of a particular image relative to that of a normal image and achieve the intended purpose of a display of the particular image.

As an alternative, the controller keeps the gradation ratio of the normal display pixels constant in the first mode. Thus, in the first mode in which the light emission brightness of the light source is high, it is possible to fix the gradation ratio of the normal display pixels to simplify the processing of controlling the liquid crystal panel.

As an alternative, the controller carries out the following at a changeover time when the control mode is changed from the first mode to the second mode: it keeps the gradation ratio of the normal display pixels constant. In the second mode, the controller controls the gradation ratio of the normal display pixels to within a range equal to or lower than the ratio kept constant at the changeover time. Thus, at a time of changeover from the first mode to the second mode, it is possible to produce a change in the lightness of a normal image in accordance with a difference in the light emission brightness of the light source from mode to mode. At a time of changeover from the first mode to the second mode, therefore, it is possible to relatively largely vary the lightness of a normal image to bring out a sharp contrast.

As an alternative, the following can be implemented when the gradation ratio of the normal display pixels is made variable in the gradation processing in the second mode: variable control on the gradation ratio of the normal display pixels can be carried out only in the second mode. In this case, therefore, it is possible to ensure as wide a variable range of the gradation ratio of the normal display pixels as possible and enhance the degree of freedom in adjusting the lightness of a normal image.

As an alternative, the controller carries out the following at a changeover time when the control mode is changed from the first mode to the second mode: it reduces the gradation ratio of the normal display pixels to a value lower than before the changeover time. In the second mode, the controller controls the gradation ratio of the normal display pixels to within a range equal to or lower than the value to which the ratio was reduced at the changeover time. Thus, at a time of changeover from the first mode to the second mode, it is possible to produce the following in the lightness of a normal image: a change corresponding to the reduction in the gradation ratio of the normal display pixels in addition to a change corresponding to a difference in the light emission brightness of the light source from mode to mode. At a time of changeover from the first mode to the second mode, therefore, it is possible to dramatically vary the lightness of a normal image to bring out a sharp contrast.

As an alternative, the controller makes the gradation ratio of the normal display pixels variable in the first mode. Thus, it is possible to vary the gradation ratio of the normal display pixels not only in the gradation processing in the second mode but also in the first mode. The lightness of a normal image can be thereby adjusted to a level of lightness tailored to the taste of the occupant of the vehicle.

As an alternative, the controller carries out the following with respect to the gradation ratio of the normal display pixels: it makes its variable range in the gradation processing in the second mode wider than its variable range in the first mode. Thus, in the gradation processing in the second mode in which the light emission brightness of the light source is low, the following can be implemented: as wide a variable range of the gradation ratio of the normal display pixels as possible can be ensured and the degree of freedom in adjusting the lightness of a normal image can be enhanced.

As an alternative, the controller carries out the following with respect to the gradation ratio of the normal display pixels: it makes its upper-limit ratio in the gradation processing in the second mode lower than its maximum ratio in the first mode. Thus, in the gradation processing in the second mode in which the light emission brightness of the light source is low, it is possible to reduce the maximum level of lightness of a normal image to enhance its visibility without fail. With respect to the gradation ratio of the normal display pixels, the following measure may be taken instead of making the upper-limit ratio in the gradation processing in the second mode lower than the maximum ratio in the first mode: the upper-limit ratio in the gradation processing in the second mode may be made identical with the maximum ratio in the first mode.

As an alternative, in the first mode, the controller keeps the gradation ratio of the particular display pixels at a particular time identical with the ratio in the gradation processing in the second mode. Thus, the following can be implemented not only in the first mode in which the light emission brightness of the light source is high but also in the gradation processing in the second mode in which the light emission brightness of the light source is low: it is possible to display a particular image at a particular time as lightly as possible to sufficiently achieve the intended purpose of a display of the particular image. With respect to the gradation ratio of the particular display pixels at a particular time in the first mode, the following measure may be taken instead of keeping it identical with the ratio in the gradation processing in the second mode: it may be kept at a ratio higher than in the gradation processing.

As an alternative, the controller carries out the following in the gradation processing in the second mode: it keeps constant the gradation ratio of the normal display pixels and further makes variable the gradation ratio of the particular display pixels at a particular time. Therefore, in the gradation processing in the second mode in which the light emission brightness of the light source is low, the following can be implemented: the gradation ratio of the particular display pixels can be varied to ensure such a level of the lightness of a particular image that the purpose of its display can be achieved. Further, in the gradation processing in the second mode, the gradation ratio of the normal display pixels can be kept lower than the gradation ratio of the particular display pixels to reduce the lightness of a normal image without fail.

As an alternative, the display device is provided with an inputting element for accepting input from the occupant of the vehicle. The inputting element accepts an adjustment value for adjusting the lightness of images including a particular image and a normal image as input. In the gradation processing in the second mode, the controller keeps the gradation ratio of the normal display pixels at a set ratio. Further, it increases the gradation ratio of the particular display pixels at a particular time from the set ratio in response to change in the inputted adjustment value. Thus, it is possible to increase the gradation ratio of the particular display pixels to a value higher than the gradation ratio of the normal display pixels without fail according to the inputted adjustment value from the occupant. Therefore, it is possible to increase the lightness of a particular image relative to that of a normal image and further tailor the lightness of the particular image to the occupant's taste.

As an alternative, the controller carries out main gradation processing as the gradation processing and sub gradation processing in the second mode according to the inputted adjustment value. In the sub gradation processing, the gradation ratio of the normal display pixels is kept at the same set ratio as in the main gradation processing. In addition, the gradation ratio of the particular display pixels at a particular time is reduced from the set ratio in response to change in the inputted adjustment value from the occupant. The gradation ratio of the particular display pixels at a particular time is thereby made lower than the gradation ratio of the normal display pixels. Thus, it is possible for the occupant to select which to carry out: to increase the gradation ratio of the particular display pixels to a value higher than the gradation ratio of the normal display pixels according to the inputted adjustment value from the occupant; or to reduce the gradation ratio of the particular display pixels to a value lower than the gradation ratio of the normal display pixels according to the inputted adjustment value. Therefore, it is possible to cope with not only cases where the lightness of a particular image is ensured to achieve the purpose of its display but also cases where the lightness of a particular image is reduced to the occupant's taste.

As an alternative, the controller carries out the following in the gradation processing in the second mode: it makes variable both the gradation ratio of the normal display pixels and the gradation ratio of the particular display pixels at a particular time. Therefore, in the gradation processing in the second mode in which the light emission brightness of the light source is low, the following can be implemented: the gradation ratio of the normal display pixels can be varied to appropriately reduce the lightness of a normal image; and further the gradation ratio of the particular display pixels can also be varied to ensure such a level of the lightness of a particular image that the purpose of its display can be achieved.

As an alternative, the display device is provided with an inputting element for accepting input from the occupant of the vehicle. The inputting element accepts an adjustment value for adjusting the lightness of images including a particular image and a normal image as input. In the gradation processing in the second mode, the controller carries out the following: it reduces the gradation ratio of the normal display pixels and the gradation ratio of the particular display pixels at a particular time from an identical set ratio in response to change in the inputted adjustment value. Thus, the following gradation processing can be carried out without fail: the gradation ratio of the particular display pixels is made higher than the gradation ratio of the normal display pixels and these gradation ratios are varied according to the inputted adjustment value from the occupant. Therefore, it is possible to ensure both the visibility of a normal image and the lightness of a particular image and further tailor the lightness of these images to the occupant's taste.

As an alternative, the controller carries out main gradation processing as the gradation processing and sub gradation processing in the second mode according to the inputted adjustment value. In the sub gradation processing, the gradation ratio of the normal display pixels and the gradation ratio of the particular display pixels at a particular time are increased from the same set ratio as in the main gradation processing in response to change in the inputted adjustment value from the occupant. The gradation ratio of the particular display pixels at a particular time is thereby made lower than the gradation ratio of the normal display pixels. Thus, it is possible for the occupant to select which to carry out: to maintain the relation in which the gradation ratio of the particular display pixels is higher than the gradation ratio of the normal display pixels and vary these gradation ratios; or to maintain the relation in which the gradation ratio of the particular display pixels is lower than the gradation ratio of the normal display pixels and vary these gradation ratios. Therefore, it is possible to cope with not only cases where the lightness of a particular image is ensured and the relative lightness of a normal image is reduced but also cases where the lightness of a normal image is ensured and the relative lightness of a particular image is reduced.

As an alternative, the controller keeps the gradation ratio of the normal display pixels constant in the first mode. Thus, in the first mode in which the light emission brightness of the light source is high, it is possible to fix the gradation ratio of the normal display pixels to simplify the processing of controlling the liquid crystal panel.

As an alternative, the controller keeps constant the gradation ratio of the normal display pixels at a changeover time when the control mode is changed from the first mode to the second mode. In the second mode, the controller controls the gradation ratio of the normal display pixels to within a range equal to or lower than the ratio kept at the changeover time. Thus, at a time of changeover from the first mode to the second mode, it is possible to produce a change in the lightness of a normal image in accordance with a difference in the light emission brightness of the light source from mode to mode. At a time of changeover from the first mode to the second mode, therefore, it is possible to relatively largely vary the lightness of a normal image to bring out a sharp contrast.

As an alternative, the following can be implemented when the gradation ratio of the normal display pixels is made variable in the gradation processing in the second mode: variable control on the gradation ratio of the normal display pixels can be carried out only in the second mode. In this case, therefore, it is possible to ensure as wide a variable range of the gradation ratio of the normal display pixels as possible and enhance the degree of freedom in adjusting the lightness of a normal image.

As an alternative, the controller carries out the following at a changeover time when the control mode is changed from the first mode to the second mode: it reduces the gradation ratio of the normal display pixels to a value lower than before the changeover time. In the second mode, the controller controls the gradation ratio of the normal display pixels to within a range equal to or lower than the value to which the ratio was reduced at the changeover time. Thus, at a time of changeover from the first mode to the second mode, it is possible to produce the following in the lightness of a normal image: a change corresponding to the reduction in the gradation ratio of the normal display pixels in addition to a change corresponding to a difference in the light emission brightness of the light source from mode to mode. At a time of changeover from the first mode to the second mode, therefore, it is possible to dramatically vary the lightness of a normal image to bring out a sharp contrast.

As an alternative, the controller makes the gradation ratio of the normal display pixels variable in the first mode. Thus, it is possible to vary the gradation ratio of the normal display pixels not only in the gradation processing in the second mode but also in the first mode. The lightness of a normal image can be thereby adjusted to a level of lightness tailored to the taste of the occupant of the vehicle.

As an alternative, the controller carries out the following with respect to the gradation ratio of the normal display pixels: its variable range in the gradation processing in the second mode is made wider than its variable range in the first mode. Thus, in the gradation processing in the second mode in which the light emission brightness of the light source is low, the following can be implemented: as wide a variable range of the gradation ratio of the normal display pixels as possible can be ensured and the degree of freedom in adjusting the lightness of a normal image can be enhanced.

As an alternative, the controller carries out the following with respect to the gradation ratio of the normal display pixels: its upper-limit ratio in the gradation processing in the second mode is made lower than its maximum ratio in the first mode. Thus, in the gradation processing in the second mode in which the light emission brightness of the light source is low, it is possible to reduce the maximum level of lightness of a normal image to enhance its visibility without fail. With respect to the gradation ratio of the normal display pixels, the following measure may be taken instead of making the upper-limit ratio in the gradation processing in the second mode lower than the maximum ratio in the first mode: the upper-limit ratio in the gradation processing in the second mode may be made identical with the maximum ratio in the first mode.

As an alternative, in the first mode, the controller makes variable the gradation ratio of the particular display pixels at a particular time. Thus, the following can be implemented not only in the gradation processing in the second mode but also in the first mode: the gradation ratio of the particular display pixels can be varied to ensure such a level of the lightness of a particular image that the purpose of its display can be achieved.

As an alternative, the controller carries out the following with respect to the gradation ratio of the particular display pixels at a particular time: its upper-limit ratio in the gradation processing in the second mode is made identical with its maximum ratio in the first mode. Thus, the following can be implemented not only in the first mode in which the light emission brightness of the light source is high but also in the gradation processing in the second mode in which the light emission brightness of the light source is low: the maximum level of lightness of a particular image can be increased as much as possible. Therefore, failure to achieve the intended purpose of a display of the particular image is less prone to occur. With respect to the gradation ratio of the particular display pixels at a particular time, the following measure may be taken instead of making the upper-limit ratio in the gradation processing in the second mode identical with the maximum ratio in the first mode: the upper-limit ratio in the gradation processing in the second mode may be made lower than the maximum ratio in the first mode.

As an alternative, in the first mode, the controller keeps constant the gradation ratio of the particular display pixels at a particular time. Thus, in the first mode in which the light emission brightness of the light source is high, it is possible to fix the gradation ratio of the particular display pixels to simplify the processing of controlling the liquid crystal panel.

As an alternative, the controller carries out the following with respect to the gradation ratio of the particular display pixels at a particular time: its upper-limit ratio in the gradation processing in the second mode is made identical with its ratio kept constant in the first mode. Thus, the following can be implemented not only in the first mode in which the light emission brightness of the light source is high but also in the gradation processing in the second mode in which the light emission brightness of the light source is low: the maximum level of lightness of a particular image can be increased as much as possible. Therefore, failure to achieve the intended purpose of a display of the particular image is less prone to occur. With respect to the gradation ratio of the particular display pixels at a particular time, the following measure may be taken instead of making the upper-limit ratio in the gradation processing in the second mode identical with the ratio kept constant in the first mode: the upper-limit ratio in the gradation processing in the second mode may be made lower than the ratio kept constant in the first mode.

As an alternative, the controller carries out the gradation processing both in the first mode and in the second mode. Thus, with respect to the gradation ratio of the normal display pixels and the gradation ratio of the particular display pixels at a particular time, the following is implemented: the gradation processing of varying them so that the latter is higher than the former is carried out both in the first mode and in the second mode. Therefore, the following can be implemented regardless of the level of the light emission brightness of the light source: the lightness of a particular image relative to that of a normal image can be increased to the occupant's taste to achieve the purpose of a display of the particular image.

As an alternative, the controller carries out the gradation processing during the second mode. Thus, even in the second mode in which the light emission brightness of the light source is low, the following can be implemented during this mode: the gradation processing of making the gradation ratio of the particular display pixels at a particular time higher than the gradation ratio of the normal display pixels can be carried out to continuously achieve the purpose of a display of the particular image.

As an alternative, the display device is provided with an inputting element for accepting input from the occupant of the vehicle. In the second mode, the controller carries out the gradation processing according to input accepted by the inputting element. Thus, the following can be implemented for specifically resolving an occasion when the occupant desires such a display that the lightness of a particular image is ensured and the relative lightness of a normal image is reduced: the gradation ratio of the particular display pixels at a particular time can be made higher than the gradation ratio of the normal display pixels. Therefore, the occupant can be assisted in a timely manner.

As an alternative, the controller keeps constant the light emission brightness of the light source in the gradation processing in the second mode. Thus, in the second mode, the light emission brightness of the light source can be fixed within a range lower than in the first mode. Therefore, the respective levels of lightness of a particular image and a normal image can be respectively accurately set by the gradation ratio of the particular display pixels and that of the normal display pixels.

As an alternative, the controller carries out the following in the gradation processing in the second mode: it makes variable the light emission brightness of the light source within a range lower than in the first mode. Thus, the following can be implemented in the gradation processing in the second mode: the light emission brightness of the light source can be varied within a range lower than in the first mode, and the lightness of a normal image and the lightness of a particular image can be simultaneously reduced to the taste of the occupant of the vehicle. In the gradation processing, further, the gradation ratio of the particular display pixels at a particular time is made higher than the gradation ratio of the normal display pixels. Therefore, the visibility of the normal image can be enhanced without failure to achieve the intended purpose of a display of the particular image.

In general, the light switch of a vehicle is turned on when the outside light intensity is reduced. Consequently, the controller changes the control mode from the first mode to the second mode on condition that the light switch of the vehicle is turned on. Therefore, in the gradation processing in the second mode to which the control mode has been changed from the first mode by the light switch being turned on, the following can be implemented: the lightness of a normal image can be reduced according to the reduced outside light intensity, and such a level of the lightness of a particular image that the purpose of its display can be achieved can be ensured.

As an alternative, the controller changes the control mode from the first mode to the second mode on condition that the outside light intensity becomes equal to or lower than a threshold value. Therefore, in the gradation processing in the second mode to which the control mode has been changed from the first mode due to reduction in outside light intensity, the following can be implemented: the lightness of a normal image can be reduced according to the reduced outside light intensity, and further such a level of the lightness of a particular image that the purpose of its display can be achieved can be ensured.

As an alternative, the particular image includes a warning image for giving a warning about any anomaly in the vehicle to alert the occupant of the vehicle; and the normal image includes a meter image for indicating a status value pertaining to the vehicle. Thus, in the gradation processing in the second mode in which the light emission brightness of the light source is low, the following can be implemented: the lightness of a meter image can be reduced to make it easy to view; and the lightness of a warning image can be ensured to enhance its property of giving a warning about an anomaly in the vehicle to which the occupant of the vehicle is to be alerted.

As an alternative, the particular image includes an external scene image obtained by picking up an image of the scene external to the vehicle to alert the occupant of the vehicle; and the normal image includes a meter image for indicating a status value pertaining to the vehicle. Thus, in the gradation processing in the second mode in which the light emission brightness of the light source is low, the following can be implemented: the lightness of a meter image can be reduced to make it easy to view; and the lightness of an external scene image can be ensured to alert the occupant of the vehicle to the scene external to the vehicle.

The first embodiment is a display device for a vehicle including: a liquid crystal panel for displaying an image in a vehicle; a light source for illuminating the liquid crystal panel by light emission; and a controller for controlling the liquid crystal panel and the light source. The liquid crystal panel includes: particular display pixels used to display a particular image at a particular time; and normal display pixels used to display a normal image at a normal time when a particular image is not displayed by the particular display pixels and at a particular time. The controller establishes as control mode a first mode in which the light source is caused to emit light and a second mode in which the light source is caused to emit light with a lower level of brightness than in the first mode. In the second mode, the controller makes variable the gradation value of the normal display pixels at a normal time and at a particular time, and further keeps constant the gradation value of the particular display pixels at a particular time.

As an alternative, the following takes place in the second mode in which the light emission brightness of the light source is lower than in the first mode: the gradation value of the normal display pixels at a normal time and at a particular time is variable. Therefore, it is possible to appropriately reduce the lightness of a normal image displayed by the normal display pixels both at a normal time and at a particular time to enhance the visibility of the normal image. In the second mode, the gradation value of the particular display pixels at a particular time is kept constant. At a particular time, therefore, the lightness of a particular image displayed by the particular display pixels can be ensured regardless of the lightness of a normal image, and the intended purpose of a display of the particular image can be achieved. Thus, it is possible to appropriately display both a normal image with higher priority given to visibility and a particular image with higher priority given to the attaining the purpose of display.

As an alternative, the controller keeps constant the gradation value of the particular display pixels at a particular time both in the first mode and in the second mode. Thus, the gradation value of the particular display pixels at a particular time in the second mode is kept identical with the gradation value of the particular display pixels at a particular time in the first mode. Therefore, it is possible to lightly display a particular image as much as possible at a particular time in the second mode to sufficiently achieve the intended purpose of a display of the particular image.

As an alternative, in the first mode, the controller keeps constant the gradation value of the normal display pixels at a normal time and at a particular time. Thus, in the first mode in which the light emission brightness of the light source is high, the following can be implemented: the lightness of a normal image displayed by the normal display pixels is fixed to simplify the processing of controlling the liquid crystal panel.

As an alternative, the controller carries out the following at a changeover time when the control mode is changed from the first mode to the second mode: it keeps the gradation value of the normal display pixels constant. In the second mode, the controller controls the variable range of the gradation value of the normal display pixels to within a range equal to or lower than the value kept constant at the changeover time. Thus, with respect to the lightness of a normal image displayed by the normal display pixels, the following can be implemented at a time of changeover from the first mode to the second mode: a change can be produced in accordance with a difference in the light emission brightness of the light source from mode to mode. In addition, variable control on the gradation value of the normal display pixels can be carried out only in the second mode. Therefore, at a time of changeover from the first mode to the second mode, the lightness of a normal image can be relatively largely varied to bring out a sharp contrast. Further, in the second mode after the mode change, the variable range of the gradation value of the normal display pixels can be widened to enhance the degree of freedom in adjusting the lightness of display images.

As an alternative, the controller carries out the following at a changeover time when the control mode is changed from the first mode to the second mode: it reduces the gradation value of the normal display pixels to a value lower than before the changeover time. In the second mode, the controller controls the variable range of the gradation value of the normal display pixels to a range equal to or lower than the value to which the value was reduced at the changeover time. Thus, with respect to the lightness of a normal image displayed by the normal display pixels, the following can be produced at a time of changeover from the first mode to the second mode: a change corresponding to the reduction in the gradation value of the normal display pixels in addition to a change corresponding to a difference in the light emission brightness of the light source from mode to mode. At a time of changeover from the first mode to the second mode, therefore, the lightness of a normal image can be dramatically varied to bring out a sharp contrast.

As an alternative, in the first mode, the controller makes variable the gradation value of the normal display pixels at a normal time and at a particular time. Thus, the gradation value of the normal display pixels at a normal time and at a particular time is variable not only in the second mode but also in the first mode. Therefore, the lightness of a normal image displayed by the normal display pixels can be adjusted to a level of lightness tailored to the taste of the occupant of the vehicle.

As mentioned above, the light switch of a vehicle is turned on when the outside light intensity is reduced. The controller changes the control mode from the first mode to the second mode on condition that the light switch of the vehicle is turned on. Therefore, in the second mode to which the control mode has been changed from the first mode by the light switch being turned on, the following can be implemented: the lightness of a normal image can be reduced according to the reduced outside light intensity, and such a level of the lightness of a particular image that the purpose of its display can be achieved can be ensured.

As an alternative, the controller changes the control mode from the first mode to the second mode on condition that the outside light intensity becomes equal to or lower than a threshold value. Therefore, in the second mode to which the control mode has been changed from the first mode due to reduction in outside light intensity, the following can be implemented: the lightness of a normal image can be reduced according to the reduced outside light intensity, and further such a level of the lightness of a particular image that the purpose of its display can be achieved can be ensured.

As an alternative, the particular image includes a warning image for giving a warning about any anomaly in the vehicle, and the normal image includes a meter image for indicating a status value pertaining to the vehicle. Thus, in the second mode in which the light emission brightness of the light source is low, the following can be implemented: the lightness of a meter image can be reduced to make it easy to view; and the lightness of a warning image can be ensured to enhance its property of giving a warning about an anomaly in the vehicle.

While example embodiments have been described above, it is to be understood that the invention is not limited to the example embodiments and constructions. The invention is intended to cover various modification and equivalent arrangements. In addition, while the various combinations and configurations, which are exemplary, other combinations and configurations, including more, less or only a single element, are also within the spirit and scope of the invention.

The invention claimed is:

1. A display device for a vehicle comprising:

a liquid crystal panel displaying an image;

a light source illuminating the liquid crystal panel by light emission; and a controller controlling the liquid crystal panel and the light source, wherein the liquid crystal panel includes: a particular display pixel for displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets first and second modes as control modes, the first mode in which the light source emits light, and the second mode in which the light source emits light with brightness lower than in the first mode, wherein, in the first mode, the controller sets the gradation ratio of the normal display pixel to maximum, and further sets the gradation ratio of the particular display pixel at the particular time to maximum, wherein, in the first mode, the liquid crystal panel displays both of the normal image and the particular image at the particular time, and the liquid crystal panel displays only the normal image at the normal time, wherein, in the second mode, the controller executes a gradation processing to make the gradation ratio of the particular display pixel at the particular time larger than the gradation ratio of the normal display pixel, and wherein, in the second mode, the liquid crystal panel displays both of the normal image and the particular image at the particular time, and the liquid crystal panel displays only the normal image at the normal time.

2. The display device for a vehicle of claim 1 wherein, in the gradation processing, the controller makes the gradation ratio of the normal display pixel variable, and further keeps the gradation ratio of the particular display pixel at the particular time constant.

3. The display device for a vehicle of claim 2, further comprising:

an inputting element accepting input from a passenger of the vehicle, wherein the inputting element accepts an adjustment value for adjusting lightness of the image including the particular image and the normal image as the input, wherein, in the gradation processing, the controller reduces the gradation ratio of the normal display pixel from a set ratio in response to change in the adjustment value, and further keeps the gradation ratio of the particular display pixel at the particular time at the set ratio.

4. The display device for a vehicle of claim 2 wherein, in the first mode, the controller keeps the gradation ratio of the normal display pixel constant.

5. The display device for a vehicle of claim 4 wherein at a changeover time when the control mode is changed from the first mode to the second mode, the controller keeps the gradation ratio of the normal display pixel constant, and wherein, in the second mode, the controller controls the gradation ratio of the normal display pixel to within a range equal to or lower than the ratio kept constant at the changeover time.

6. The display device for a vehicle of claim 4 wherein at a changeover time when the control mode is changed from the first mode to the second mode, the controller reduces the gradation ratio of the normal display pixel to a value lower than before the changeover time, and wherein, in the second mode, the controller controls the gradation ratio of the normal display pixel to within a range equal to or lower than the value to which the ratio is reduced at the changeover time.

7. The display device for a vehicle of claim 2 wherein, in the first mode, the controller keeps the gradation ratio of the particular display pixel at the particular time identical with the ratio in the gradation processing.

8. The display device for a vehicle of claim 2 wherein wherein, in the first mode, the controller keeps the gradation ratio of the particular display pixel at the particular time higher than the ratio in the gradation processing.

9. The display device for a vehicle of claim 1 wherein, in the gradation processing, the controller keeps both the gradation ratio of the normal display pixel and the gradation ratio of the particular display pixel at the particular time constant.

10. The display device for a vehicle of claim 1 wherein wherein, in the gradation processing, the controller keeps the gradation ratio of the normal display pixel constant, and further makes the gradation ratio of the particular display pixel at the particular time variable.

11. The display device for a vehicle of claim 10, further comprising:

an inputting element accepting input from a passenger of the vehicle, wherein the inputting element accepts an adjustment value for adjusting lightness of the image including the particular image and the normal image as the input, wherein, in the gradation processing, the controller keeps the gradation ratio of the normal display pixel at a set ratio, and further increases the gradation ratio of the particular display pixel at the particular time from the set ratio in response to change in the adjustment value.

12. The display device for a vehicle of claim 10 wherein, in the first mode, the controller keeps the gradation ratio of the normal display pixel constant.

13. The display device for a vehicle of claim 12 wherein at a changeover time when the control mode is changed from the first mode to the second mode, the controller keeps the gradation ratio of the normal display pixel constant, and wherein, in the second mode, the controller controls the gradation ratio of the normal display pixel to within a range equal to or lower than the ratio kept constant at the changeover time.

14. The display device for a vehicle of claim 12 wherein, at a changeover time when the control mode is changed from the first mode to the second mode, the controller reduces the gradation ratio of the normal display pixel to a value lower than before the changeover time, and wherein, in the second mode, the controller controls the gradation ratio of the normal display pixel to within a range equal to or lower than the value to which the ratio is reduced at the changeover time.

15. The display device for a vehicle of claim 10 wherein, in the first mode, the controller keeps the gradation ratio of the particular display pixel at the particular time constant.

16. The display device for a vehicle of claim 15 wherein the controller makes an upper-limit ratio of the gradation ratio of the particular display pixel at the particular time in the gradation processing identical with the ratio kept constant in the first mode.

17. The display device for a vehicle of claim 15 wherein the controller makes an upper-limit ratio of the gradation ratio of the particular display pixel at the particular time in the gradation processing lower than the ratio kept constant in the first mode.

18. The display device for a vehicle of claim 1:

wherein, in the gradation processing, the controller makes both the gradation ratio of the normal display pixel and the gradation ratio of the particular display pixel at the particular time variable.

19. The display device for a vehicle of claim 18, further comprising:

an inputting element accepting input from a passenger of the vehicle, wherein the inputting element accepts an adjustment value for adjusting lightness of the image including the particular image and the normal image as the input, wherein, in the gradation processing, the controller reduces the gradation ratio of the normal display pixel and the gradation ratio of the particular display pixel at the particular time from an identical set ratio in response to change in the adjustment value.

20. The display device for a vehicle of claim 1 wherein the controller executes the gradation processing during the second mode.

21. The display device for a vehicle of claim 1, further comprising:

an inputting element for accepting input from a passenger of the vehicle, wherein the controller executes the gradation processing according to the input accepted by the inputting element in the second mode.

22. The display device for a vehicle of claim 1 wherein, in the gradation processing, the controller keeps light emission brightness of the light source constant.

23. The display device for a vehicle of claim 1 wherein, in the gradation processing, the controller makes light emission brightness of the light source variable within a range lower than in the first mode.

24. The display device for a vehicle of claim 1 wherein, the controller changes the control mode from the first mode to the second mode on condition that a light switch of the vehicle is turned on.

25. The display device for a vehicle of claim 1 wherein the controller changes the control mode from the first mode to the second mode on condition that outside light intensity becomes equal to or lower than a threshold value.

26. The display device for a vehicle of claim 1 wherein the particular image includes a warning image for giving a warning about an anomaly in the vehicle to alert a passenger of the vehicle, and the normal image includes a meter image for indicating a status value pertaining to the vehicle.

27. The display device for a vehicle of claim 1 wherein the particular image includes an external scene image obtained by picking up an image of scene external to the vehicle to alert a passenger of the vehicle, and wherein the normal image includes a meter image for indicating a status value pertaining to the vehicle.

28. A display device for a vehicle comprising:

a liquid crystal panel displaying an image;

a light source illuminating the liquid crystal panel by light emission; and a controller controlling the liquid crystal panel and the light source, wherein the liquid crystal panel includes: a particular display pixel for-displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets first and second modes as control modes, the first mode in which the light source emits light, and the second mode in which the light source emits light with brightness lower than in the first mode, wherein, in the first mode, the controller sets the gradation ratio of the normal display pixel to maximum, and further sets the gradation ratio of the particular display pixel at the particular time to maximum, the display device further comprising: an inputting element accepting an input from a passenger of the vehicle, wherein the inputting element accepts an adjustment value for adjusting lightness of the image including the particular image and the normal image as the input, wherein, in the second mode, according to the adjustment value, the controller executes:

main gradation processing as a gradation processing to make the gradation ratio of the particular display pixel at the particular time lower than the gradation ratio of the normal display pixel when the adjustment value is reduced from a predetermined threshold adjustment value; and sub gradation processing in which the gradation ratio of the normal display pixel is decreased from a set ratio in response to an increasing change in the adjustment value, and further the gradation ratio of the particular display pixel at the particular time is kept at the set ratio, so that the gradation ratio of the particular display pixel at the particular time is made larger than the gradation ratio of the normal display pixel when the adjustment value is increased from the predetermined threshold adjustment value.

29. A display device for a vehicle comprising:

a liquid crystal panel displaying an image;

a light source illuminating the liquid crystal panel by light emission; and a controller controlling the liquid crystal panel and the light source, wherein the liquid crystal panel includes: a particular display pixel for-displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets first and second modes as control modes, the first mode in which the light source emits light, and the second mode in which the light source emits light with brightness lower than in the first mode, wherein, in the first mode, the controller sets the gradation ratio of the particular display pixel at the particular time to maximum, wherein, in the second mode, the controller executes a gradation processing to make the gradation ratio of the particular display pixel at the particular time larger than the gradation ratio of the normal display pixel, and wherein, in the first mode, the controller makes the gradation ratio of the normal display pixel variable.

30. The display device for a vehicle of claim 29 wherein the controller makes a variable range of the gradation ratio of the normal display pixel in the gradation processing wider than a variable range thereof in the first mode.

31. The display device for a vehicle of claim 29 wherein the controller makes an upper-limit ratio of the gradation ratio of the normal display pixel in the gradation processing lower than a maximum ratio thereof in the first mode.

32. The display device for a vehicle of claim 29 wherein wherein the controller makes an upper-limit ratio of the gradation ratio of the normal display pixel in the gradation processing identical with a maximum ratio thereof in the first mode.

33. A display device for a vehicle comprising:

a liquid crystal panel displaying an image;

a light source illuminating the liquid crystal panel by light emission; and a controller controlling the liquid crystal panel and the light source;

wherein the liquid crystal panel includes: a particular display pixel for-displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets first and second modes as control modes, the first mode in which the light source emits light, and the second mode in which the light source emits light with brightness lower than in the first mode, the display device further comprising: an inputting element accepting an input from a passenger of the vehicle, wherein the inputting element accepts an adjustment value for adjusting lightness of the image including the particular image and the normal image as the input, wherein, in the first mode, the controller sets the gradation ratio of the normal display pixel to maximum, and further sets the gradation ratio of the particular display pixel at the particular time to maximum, wherein, in the second mode, according to the adjustment value, the controller executes:

main gradation processing as a gradation processing to make the gradation ratio of the particular display pixel at the particular time larger than the gradation ratio of the normal display pixel when the adjustment value is reduced from a predetermined threshold adjustment value; and sub gradation processing in which the gradation ratio of the normal display pixel is kept at a set ratio, and the gradation ratio of the particular display pixel at the particular time is reduced from the set ratio in response to change in the adjustment value, so that the gradation ratio of the particular display pixel at the particular time is made lower than the gradation ratio of the normal display pixel when the adjustment value is increased form the predetermined threshold adjustment value, wherein, in the gradation processing, the controller keeps the gradation ratio of the normal display pixel constant, and further makes the gradation ratio of the particular display pixel at the particular time variable, and wherein, in the gradation processing, the controller keeps the gradation ratio of the normal display pixel at the set ratio, and further decreases the gradation ratio of the particular display pixel at the particular time from the set ratio in response to an increasing change in the adjustment value.

34. A display device for a vehicle comprising:

a liquid crystal panel displaying an image;

a light source illuminating the liquid crystal panel by light emission; and a controller controlling the liquid crystal panel and the light source;

wherein the liquid crystal panel includes: a particular display pixel for-displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets first and second modes as control modes, the first mode in which the light source emits light, and the second mode in which the light source emits light with brightness lower than in the first mode, the display device further comprising: an inputting element accepting an input from a passenger of the vehicle, wherein the inputting element accepts an adjustment value for adjusting lightness of the image including the particular image and the normal image as the input, wherein, in the first mode, the controller sets the gradation ratio of the normal display pixel to maximum, and further sets the gradation ratio of the particular display pixel at the particular time to maximum, wherein, in the second mode, according to the adjustment value, the controller executes:

main gradation processing as a gradation processing to make the gradation ratio of the particular display pixel at the particular time lower than the gradation ratio of the normal display pixel when the adjustment value is increased from the predetermined threshold adjustment value; and sub gradation processing in which the gradation ratio of the normal display pixel and the gradation ratio of the particular display pixel at the particular time are decreased from the set ratio in response to change in the adjustment value, so that the gradation ratio of the particular display pixel at the particular time is made larger than the gradation ratio of the normal display pixel when the adjustment value is increased from the predetermined threshold adjustment value, wherein, in the gradation processing, the controller makes both the gradation ratio of the normal display pixel and the gradation ratio of the particular display pixel at the particular time variable, wherein, in the gradation processing, the controller reduces the gradation ratio of the normal display pixel and the gradation ratio of the particular display pixel at the particular time from an identical set ratio in response to change in the adjustment value.

35. A display device for a vehicle comprising:

a liquid crystal panel displaying an image;

a light source illuminating the liquid crystal panel by light emission; and a controller controlling the liquid crystal panel and the light source, wherein the liquid crystal panel includes: a particular display pixel for-displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets first and second modes as control modes, the first mode in which the light source emits light, and the second mode in which the light source emits light with brightness lower than in the first mode, wherein, in the first mode, the controller makes the gradation ratio of the normal display pixel variable, and further sets the gradation ratio of the particular display pixel at the particular time to maximum, wherein, in the second mode, the controller executes a gradation processing to make the gradation ratio of the particular display pixel at the particular time larger than the gradation ratio of the normal display pixel, wherein, in the gradation processing, the controller makes both the gradation ratio of the normal display pixel and the gradation ratio of the particular display pixel at the particular time variable.

36. The display device for a vehicle of claim 35 wherein the controller makes a variable range of the gradation ratio of the normal display pixel in the gradation processing wider than a variable range thereof in the first mode.

37. The display device for a vehicle of claim 35 wherein the controller makes an upper-limit ratio of the gradation ratio of the normal display pixel in the gradation processing lower than a maximum ratio thereof in the first mode.

38. The display device for a vehicle of claim 35 wherein the controller makes an upper-limit ratio of the gradation ratio of the normal display pixel in the gradation processing identical with a maximum ratio thereof in the first mode.

39. A display device for a vehicle comprising:

a liquid crystal panel displaying an image;

a light source illuminating the liquid crystal panel by light emission; and a controller controlling the liquid crystal panel and the light source, wherein the liquid crystal panel includes: a particular display pixel for-displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets first and second modes as control modes, the first mode in which the light source emits light, and the second mode in which the light source emits light with brightness lower than in the first mode, wherein, in the first mode, the controller sets the gradation ratio of the normal display pixel to maximum, and further makes the gradation ratio of the particular display pixel at the particular time variable, wherein, in the second mode, the controller executes a gradation processing to make the gradation ratio of the particular display pixel at the particular time larger than the gradation ratio of the normal display pixel, and wherein, in the gradation processing, the controller keeps the gradation ratio of the normal display pixel constant, and further makes the gradation ratio of the particular display pixel at the particular time variable.

40. The display device for a vehicle of claim 39 wherein, the controller makes an upper-limit ratio of the gradation ratio of the particular display pixel at the particular time in the gradation processing identical with a maximum ratio thereof in the first mode.

41. The display device for a vehicle of claim 39 wherein, the controller makes an upper-limit ratio of the gradation ratio of the particular display pixel at the particular time in the gradation processing lower than a maximum ratio thereof in the first mode.

42. A display device for a vehicle comprising:

a liquid crystal panel displaying an image;

a light source illuminating the liquid crystal panel by light emission; and a controller controlling the liquid crystal panel and the light source, wherein the liquid crystal panel includes: a particular display pixel for-displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets first and second modes as control modes, the first mode in which the light source emits light, and the second mode in which the light source emits light with brightness lower than in the first mode, wherein the controller executes a gradation processing both in the first mode and in the second mode, wherein, in the first mode, the controller executes the gradation processing to make the gradation ratio of the particular display pixel at the particular time larger than the gradation ratio of the normal display pixel, wherein, in the second mode, the controller executes the gradation processing to make the gradation ratio of the particular display pixel at the particular time larger than the gradation ratio of the normal display pixel, wherein, in the gradation processing, the controller makes both the gradation ratio of the normal display pixel and the gradation ratio of the particular display pixel at the particular time variable.

43. A display device for a vehicle comprising:

a liquid crystal panel;

a light source illuminating the liquid crystal panel by light emission; and a controller controlling the liquid crystal panel and the light source, wherein the liquid crystal panel includes: a particular display pixel for displaying a particular image at a particular time; and a normal display pixel for displaying a normal image at a normal time when the particular image is not display by the particular display pixel and at the particular time, wherein, the controller sets first and second modes as control modes, the first mode in which the light source emits light, and the second mode in which the light source emits light with brightness lower than in the first mode, wherein, in the first mode, the liquid crystal panel displays both of the normal image and the particular image at the particular time, and the liquid crystal panel displays only the normal image at the normal time, wherein, in the second mode, the controller makes a gradation value of the normal display pixel at the normal time and at the particular time variable, and further keeps the gradation value of the particular display pixel at the particular time constant, and wherein, in the second mode, the liquid crystal panel displays both of the normal image and the particular image at the particular time, and the liquid crystal panel displays only the normal image at the normal time.

44. The display device for a vehicle of claim 43 wherein wherein the controller keeps the gradation value of the particular display pixel at the particular time both in the first mode and in the second mode.

45. The display device for a vehicle of claim 43 wherein, in the first mode, the controller keeps the gradation value of the normal display pixel at the normal time and at the particular time constant.

46. The display device for a vehicle of claim 45 wherein at a changeover time when the control mode is changed from the first mode to the second mode, the controller keeps the gradation value of the normal display pixel constant, and wherein, in the second mode, the controller controls a variable range of the gradation value of the normal display pixel to a range equal to or lower than the value kept constant at the changeover time.

47. The display device for a vehicle of claim 45 wherein wherein at a changeover time when the control mode is changed from the first mode to the second mode, the controller reduces the gradation value of the normal display pixel to a value lower than before the changeover time, and wherein, in the second mode, the controller controls a variable range of the gradation value of the normal display pixel to a range equal to or lower than the value to which the gradation value is reduced at the changeover time.

48. The display device for a vehicle of claim 43 wherein the controller changes the control mode from the first mode to the second mode on condition that a light switch of the vehicle is turned on.

49. The display device for a vehicle of claim 43 wherein wherein the controller changes the control mode from the first mode to the second mode on condition that outside light intensity becomes equal to or lower than a threshold value.

50. The display device for a vehicle of claim 43 wherein the particular image includes a warning image for giving a warning about an anomaly in the vehicle, and wherein the normal image includes a meter image for indicating a status value pertaining to the vehicle.

51. A display device for a vehicle comprising:

a liquid crystal panel;

a light source illuminating the liquid crystal panel by light emission; and a controller controlling the liquid crystal panel and the light source, wherein the liquid crystal panel includes: a particular display pixel for displaying a particular image at a particular time; and a normal display pixel for displaying a normal image at a normal time when the particular image is not display by the particular display pixel and at the particular time, wherein the controller sets first and second modes as control modes, the first mode in which the light source emits light, and the second mode in which the light source emits light with brightness lower than in the first mode, wherein, in the first mode, the controller makes a gradation value of the normal display pixel at the normal time and at the particular time variable, and wherein, in the second mode, the controller makes the gradation value of the normal display pixel at the normal time and at the particular time variable, and further keeps a gradation value of the particular display pixel at the particular time constant.

52. A display device for a vehicle comprising:

a liquid crystal panel displaying an image;

a light source illuminating the liquid crystal panel by light emission; and a controller controlling the liquid crystal panel and the light source, wherein the liquid crystal panel includes: a particular display pixel for displaying a particular image at a particular time; and a normal display pixel for displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets first and second modes as control modes, the first mode in which the light source emits light, and the second mode in which the light source emits light with brightness lower than in the first mode, wherein, in the first mode, the controller sets the gradation ratio of the particular display pixel at the particular time to maximum, wherein, in the second mode, the controller executes a gradation processing to make the gradation ratio of the particular display pixel at the particular time larger than the gradation ratio of the normal display pixel, and wherein, in the second mode, the controller makes the gradation ratio of the normal display pixel variable.

53. The display device for a vehicle of claim 52, wherein, in the second mode, the controller makes the gradation ratio of the particular display pixel variable.

54. A display device for a vehicle comprising:

a liquid crystal panel apparatus displaying an image; and a controller controlling the liquid crystal panel apparatus, wherein the liquid crystal panel apparatus includes: a particular display pixel displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets a control mode, which includes a first mode and a second mode, wherein, in the first mode, the controller sets the gradation ratio of the normal display pixel to maximum, and further sets the gradation ratio of the particular display pixel to maximum, wherein the first mode is switched to the second mode when intensity of light external to the vehicle is equal to or lower than a predetermined intensity, or when a light switch for a lamp of the vehicle turns on, and wherein, in the second mode, the controller sets the gradation ratio of the particular display pixel at the particular time to be larger than the gradation ratio of the normal display pixel.

55. The display device for a vehicle of claim 54, wherein, in the particular time of the first mode, the controller controls the liquid crystal panel apparatus to display both of the normal image and the particular image at the same time, and wherein, in the particular time of the second mode, the controller controls the liquid crystal panel apparatus to display both of the normal image and the particular image at the same time.

56. The display device for a vehicle of claim 54, wherein, in the second mode, the controller sets the gradation ratio of the normal display pixel or the gradation ratio of the particular display pixel to be variable.

57. The display device for a vehicle of claim 54, further comprising:

an illuminance sensor for detecting the intensity of light external to the vehicle, wherein an output signal from the illuminance sensor is input into the controller, and wherein the controller switches the first mode to the second mode when the intensity of light external to the vehicle is equal to or lower than the predetermined intensity.

58. The display device for a vehicle of claim 54, wherein an on-off signal from the light switch is input into the controller, and wherein the controller switches the first mode to the second mode when the light switch turns on the lamp.

59. The display device for a vehicle of claim 58, wherein, in the first mode, when the liquid crystal panel apparatus displays both of the normal image and the particular image at the same time, the controller controls the gradation ratio of the normal display pixel and the gradation ratio of the particular display pixel according to the adjustment value in such a manner that the gradation ratio of the normal display pixel is equal to the gradation ratio of the particular display pixel when the adjustment value is null, and the gradation ratio of the particular display pixel is larger than the gradation ratio of the normal display pixel when the adjustment value is the same and larger than null.

60. The display device for a vehicle of claim 58, wherein, in the second mode, when the liquid crystal panel apparatus displays both of the normal image and the particular image at the same time, the controller controls the gradation ratio of the normal display pixel and the gradation ratio of the particular display pixel according to the adjustment value in such a manner that the gradation ratio of the normal display pixel is equal to the gradation ratio of the particular display pixel when the adjustment value is null, and the gradation ratio of the particular display pixel is larger than the gradation ratio of the normal display pixel when the adjustment value is the same and larger than null.

61. The display device for a vehicle of claim 54, further comprising:

an input element for receiving an input operation of a passenger of the vehicle, wherein an input signal from the input element is input into the controller, and wherein the input signal of the input element provides an adjustment value for adjusting brightness of the normal image and the particular image.

62. The display device for a vehicle of claim 61, wherein, in the second mode, when the liquid crystal panel apparatus displays both of the normal image and the particular image at the same time, the controller controls the gradation ratio of the normal display pixel and the gradation ratio of the particular display pixel according to the adjustment value in such a manner that the gradation ratio of the normal display pixel is larger than the gradation ratio of the particular display pixel when the adjustment value is null, and the gradation ratio of the particular display pixel is larger than the gradation ratio of the normal display pixel when the adjustment value is the same and larger than null.

63. The display device for a vehicle of claim 61, wherein the particular image includes an external scene image obtained by picking up an image of scene external to the vehicle, wherein the input signal of the input element represents whether the controller allows the liquid crystal panel apparatus to display the external scene image, and wherein controller includes: an image pickup unit for shooting the image of scene external to the vehicle and for obtaining the external scene image; and a gradation ratio adjusting unit for adjusting the gradation ratio of the particular display pixel in the external scene image when the controller allows the liquid crystal panel apparatus to display the external scene image.

64. The display device for a vehicle of claim 54, wherein the particular image includes a warning image for giving a warning about an anomaly in the vehicle to alert a passenger of the vehicle, and wherein the normal image includes a meter image for indicating a status value pertaining to the vehicle.

65. The display device for a vehicle of claim 54, wherein the particular image includes a warning image for giving a warning about an anomaly in the vehicle to alert a passenger of the vehicle, wherein the controller includes: an anomaly sensor for detecting the anomaly of the vehicle; an image memory for storing the warning image; and a gradation ratio adjusting unit for adjusting the gradation ratio of the particular display pixel in the warning image when the anomaly sensor detects the anomaly.

66. The display device for a vehicle of claim 54, wherein the liquid crystal panel apparatus includes a liquid crystal panel and a light source for illuminating the liquid crystal panel by light emission.

67. A display device for a vehicle comprising:

a liquid crystal panel apparatus displaying an image; and a controller controlling the liquid crystal panel apparatus, wherein the liquid crystal panel apparatus includes: a particular display pixel displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets a control mode, which includes a first mode and a second mode, wherein, in the first mode, the controller sets the gradation ratio of the normal display pixel or the gradation ratio of the particular display pixel to be variable, wherein the first mode is switched to the second mode when intensity of light external to the vehicle is equal to or lower than a predetermined intensity, or when a light switch for a lamp of the vehicle turns on, and wherein, in the second mode, the controller sets the gradation ratio of the particular display pixel at the particular time to be larger than the gradation ratio of the normal display pixel.

68. The display device for a vehicle of claim 67, wherein, in the first mode, the controller sets the gradation ratio of the normal display pixel to be equal to or smaller than the gradation ratio of the particular display pixel.

69. The display device for a vehicle comprising:

a liquid crystal panel apparatus displaying an image; and a controller controlling the liquid crystal panel apparatus, wherein the liquid crystal panel apparatus includes: a particular display pixel displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets a control mode, which includes a first mode and a second mode, wherein, in the first mode, the controller sets the gradation ratio of the normal display pixel to be equal to or smaller than the gradation ratio of the particular display pixel, wherein the first mode is switched to the second mode when intensity of light external to the vehicle is equal to or lower than a predetermined intensity, or when a light switch for a lamp of the vehicle turns on, and wherein, in the second mode, the controller sets the gradation ratio of the particular display pixel at the particular time to be larger than the gradation ratio of the normal display pixel.

70. A display device for a vehicle comprising:

a liquid crystal panel apparatus displaying an image; and a controller controlling the liquid crystal panel apparatus, wherein the liquid crystal panel apparatus includes: a particular display pixel displaying a particular image at a particular time; and a normal display pixel displaying a normal image at a normal time when the particular image is not displayed by the particular display pixel and at the particular time, wherein the controller controls a ratio of a gradation value of the normal display pixel to a set gradation value of the normal display pixel as a gradation ratio of the normal display pixel, and further controls a ratio of a gradation value of the particular display pixel to a set gradation value of the particular display pixel as a gradation ratio of the particular display pixel, wherein the controller sets a control mode, which includes a first mode and a second mode, wherein, in the first mode, the controller sets the gradation ratio of the normal display pixel to maximum, and further sets the gradation ratio of the particular display pixel to maximum, wherein, in the second mode, the controller sets the gradation ratio of the particular display pixel at the particular time to be larger than the gradation ratio of the normal display pixel, wherein the first mode is set when intensity of light external to the vehicle is equal to or higher than a predetermined intensity, and the second mode is set when the intensity of light external to the vehicle is lower than the predetermined intensity, wherein the first mode is switched to the second mode when the intensity of light external to the vehicle is equal to or lower than the predetermined intensity, or when a light switch for a lamp of the vehicle turns on, wherein, in the particular time of the first mode, the controller controls the liquid crystal panel apparatus to display both of the normal image and the particular image at the same time under a condition that the gradation ratio of the normal display pixel is capable of setting to maximum, and the gradation ratio of the particular display pixel at the particular time is capable of setting to maximum, wherein, in the particular time of the second mode, the controller controls the liquid crystal panel apparatus to display both of the normal image and the particular image at the same time under a condition that the gradation ratio of the particular display pixel at the particular time is capable of setting to be larger than the gradation ratio of the normal display pixel.

71. The display device for a vehicle of claim 70, wherein, in the second mode, the controller sets the gradation ratio of the normal display pixel to be variable, and the gradation ratio of the particular display pixel at the particular time to be constant.

72. The display device for a vehicle of claim 71, further comprising:

an input element for receiving an input operation of a passenger of the vehicle, wherein an input signal from the input element is input into the controller, wherein the input signal of the input element provides an adjustment value for adjusting brightness of the normal image and the particular image, wherein, in the second mode, the controller reduces the gradation ratio of the normal display pixel from a predetermined ratio according to a change of the adjustment value, and maintains the gradation value of the particular display pixel to be the predetermined ratio.

73. The display device for a vehicle of claim 70, wherein the liquid crystal panel apparatus includes a liquid crystal panel and a light source for illuminating the liquid crystal panel by light emission.

74. A display device for a vehicle comprising:

a liquid crystal panel apparatus displaying an image; and a controller controlling the liquid crystal panel apparatus, wherein the liquid crystal panel apparatus includes: a warning display pixel displaying a warning image at a warning time in order to alert a passenger of the vehicle; and a meter display pixel displaying a meter image having a numerical image in order to indicate a vehicle speed at a normal time when the warning image is not displayed by the warning display pixel and at the warning time, wherein the controller controls a ratio of a gradation value of the meter display pixel to a set gradation value of the meter display pixel as a gradation ratio of the meter display pixel, and further controls a ratio of a gradation value of the warning display pixel to a set gradation value of the warning display pixel as a gradation ratio of the warning display pixel, wherein the controller sets a control mode, which includes a first mode and a second mode, wherein, in the first mode, the controller sets the gradation ratio of the meter display pixel to maximum, and further sets the gradation ratio of the warning display pixel at the warning time to maximum, wherein, in the second mode, the controller sets the gradation ratio of the warning display pixel at the warning time to be larger than the gradation ratio of the meter display pixel, wherein the first mode is set when intensity of light external to the vehicle is equal to or higher than a predetermined intensity during a daytime, and the second mode is set when the intensity of light external to the vehicle is lower than the predetermined intensity during a nighttime or while the vehicle passes through a dark area, wherein the first mode is switched to the second mode when a light switch for a lamp of the vehicle turns on, wherein, in the warning time of the first mode, the controller controls the liquid crystal panel apparatus to display both of the meter image and the warning image at the same time under a condition that the gradation ratio of the meter display pixel is capable of setting to maximum, and the gradation ratio of the warning display pixel at the warning time is capable of setting to maximum, and wherein, in the warning time of the second mode, the controller controls the liquid crystal panel apparatus to display both of the meter image and the warning image at the same time under a condition that the gradation ratio of the warning display pixel at the warning time is capable of setting to be larger than the gradation ratio of the meter display pixel.

75. The display device for a vehicle of claim 74, wherein, in the second mode, the controller sets the gradation ratio of the meter display pixel to be variable, and maintains the gradation value of the warning display pixel at the warning time to be constant.

76. The display device for a vehicle of claim 75, further comprising:

an input element for receiving an input operation of a passenger of the vehicle, wherein an input signal from the input element is input into the controller, wherein the input signal of the input element provides an adjustment value for adjusting brightness of the meter image and the warning image, wherein, in the second mode, the controller reduces the gradation ratio of the meter display pixel from a predetermined ratio according to a change of the adjustment value, and maintains the gradation value of the warning display pixel to be the predetermined ratio.

* * * * *